US005108888A

United States Patent [19]

Ikegawa et al.

[11] Patent Number: 5,108,888

[45] Date of Patent: Apr. 28, 1992

[54] DYE SENSITIZED SILVER HALIDE PHOTOGRAPHIC MATERIAL

[75] Inventors: Akihiko Ikegawa; Masaki Okazaki; Junji Nishigaki, all of Kanagawa, Japan

[73] Assignee: Fuji Photo Film Co., Ltd., Kanagawa, Japan

[21] Appl. No.: 567,573

[22] Filed: Aug. 15, 1990

[30] Foreign Application Priority Data

Aug. 15, 1989 [JP] Japan ..... 1-210452

[51] Int. Cl.[5] ..... G03C 1/12; G03C 1/06

[52] U.S. Cl. ..... 430/570; 430/551; 430/606; 430/955; 430/957; 430/963

[58] Field of Search ..... 430/223, 551, 570, 606, 430/955, 957, 963

[56] References Cited

U.S. PATENT DOCUMENTS

| | | | |
|---|---|---|---|
| Re. 31,893 | 5/1985 | Sugita et al. | 430/957 |
| 3,575,699 | 4/1971 | Bloom et al. | 430/955 |
| 4,659,651 | 4/1987 | Yagihara et al. | 430/955 |
| 4,690,885 | 9/1987 | Yagihara et al. | 430/955 |
| 4,906,553 | 3/1990 | Ikegawa et al. | 430/963 |
| 4,939,066 | 7/1990 | Toriuchi et al. | 430/223 |
| 4,966,835 | 10/1990 | Matushita et al. | 430/957 |
| 4,985,336 | 1/1991 | Ichijima et al. | 430/223 |

FOREIGN PATENT DOCUMENTS

| | | |
|---|---|---|
| 0125523 | 12/1986 | European Pat. Off. . |
| 1-131561 | 5/1989 | Japan . |

*Primary Examiner*—Richard L. Schilling

*Attorney, Agent, or Firm*—Sughrue, Mion, Zinn, Macpeak & Seas

[57] ABSTRACT

A silver halide photographic material comprising a support and at least one silver halide emulsion layer on the support, wherein at least one compound represented by general formula (I) is contained in the silver halide emulsion layer or another hydrophilic colloid layer:

A—B m(I)

wherein A represents a blocking group capable of releasing B during processing, and B represents a group capable of releasing a residual color improving agent which satisfies Condition 1 after being released from A—B, and is linked to A via a hetero atom in B.

Condition 1:

When a 2 ml aqueous solution of $4.0\times10^{-4}$ mole/l of anyhydro-5,5'-dichloro-9-ethyl-3,3'-bis(3-sulfopropyl)-thiacarbocyanine hydroxide.pyridinium salt is mixed with a 1 ml aqueous solution of $1.0\times10^{-1}$ mole/l of potassium chloride, and 4 ml of an aqueous solution of $8.0\times10^{-2}$ mol/l of the residual color improving agent are further added to this mixture, which is then diluted with water to a set volume of 10 ml to form a diluted aqueous solution, the molecular extinction coefficient of this diluted aqueous solution at 624 nm is $1.0\times10^{5}$ or less.

7 Claims, No Drawings

DYE SENSITIZED SILVER HALIDE PHOTOGRAPHIC MATERIAL

FIELD OF THE INVENTION

The present invention relates to a silver halide photographic material, and more particularly to a silver halide photographic material containing a compound in which there is blocking of the adsorption group or the active group of a residual color improving agent, and to a silver halide photographic material in which the residual coloration and fixing properties have been improved.

BACKGROUND OF THE INVENTION

Along with progress and developments in the field of electronics, there has arisen a demand for greater rapidity in all fields and the field of silver halide photographic processing is no exception.

In particular, the need for rapid processing has greatly increased in the development processing of sheet-shaped photographic materials such as photographic materials for graphic arts, X-ray photographic materials, photographic materials for scanners, photographic materials for CRT image recording and the like.

Furthermore, rapid development processing has the advantage that with more rapid development processing, smaller tank capacities are required to develop a unit quantity of photographic material in a unit time, and hence smaller automatic processing equipment may be employed. Rapid development processing is therefore of great importance.

However, more rapid development processing increases the problem whereby the sensitizing dyes contained in silver halide photographic materials do not elute during processing. These dyes may leave the surface of the photographic material discolored (so-called residual coloration).

SUMMARY OF THE INVENTION

Accordingly, one object of the present invention is to provide a silver halide photographic material with which it is possible to carry out development processing rapidly.

A further object of the present invention is to provide a silver halide photographic material which overcomes the problem of residual coloration which is caused by the non-eluted sensitizing dyes which may remain after rapid processing.

The above-mentioned and other objects of the present invention are achieved by preparing a silver halide photographic material comprising a support and at least one silver halide emulsion layer on the support, wherein at least one compound represented by general formula (I) is contained in the silver halide emulsion layer or another hydrophilic colloid layer:

$$A—B \qquad (I)$$

wherein A represents a blocking group capable of releasing B during processing, and B represents a group capable of releasing a residual color improving agent which satisfies Condition 1 after being released from A—B, and is linked to A via a hetero atom in B.

Condition 1:

When a 2 ml aqueous solution of $4.0\times10^{-4}$ mole/l of anhydro-5,5'-dichloro-9-ethyl-3,3'-bis(3-sulfopropyl)-thiacarbocyanine hydroxide.pyridinium salt is mixed with a 1 ml aqueous solution of $1.0\times10^{-1}$ mole/l of potassium chloride, and 4 ml of an aqueous solution of $8.0\times10^{-2}$ mole/l of the residual color improving agent are further added to this mixture, which is then diluted with water to a set volume of 10 ml to form a diluted aqueous solution, the molecular extinction coefficient of this diluted aqueous solution at 624 nm is $1.0\times10^{5}$ or less. The molecular extinction coefficient is measured by means of a conventional ultraviolet visible spectrograph.

Anhydro-5,5'-dichloro-9-ethyl-3,3'-bis(3-sulfopropyl)-thiacarbocyanine hydroxide.pyridinium salt;

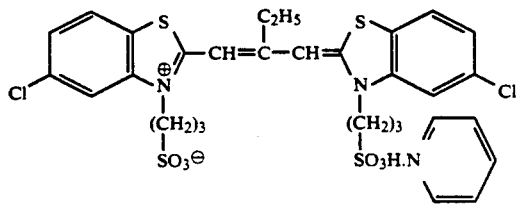

DETAILED DESCRIPTION OF THE INVENTION

General formula (I) is explained in detail below.

Any known blocking group may be employed as the blocking group. By way of example, there may be mentioned blocking groups such as an acyl group or a sulfonyl group as described in JP-B-48-9968 (the term "JP-B" as used herein means an "examined Japanese Patent publication"), JP-A-52-8828 (the term "JP-A" as used herein means an "unexamined Japanese Patent application"), JP-A-57-82834, U.S. Pat. No. 3,311,476 and JP-B-47-44805 (U.S. Pat. No. 3,615,617); blocking groups using a so-called reverse Michael reaction as described in JP-B-55-17369 (U.S. Pat. No. 3,888,677}, JP-B-55-9696 (U.S. Pat. No. 3,791,830), JP-B-55-34927 (U.S. Pat. No. 4,009,029), JP-A-56-77842 (U.S. Pat. No. 4,307,175), JP-A-59-105642 and JP-A-59-105640; blocking groups which make use of the production of quinomethide or a quinomethide analog by intramolecular electron transfer as described in JP-B-54-39727, U.S. Pat. Nos. 3,674,478, 3,932,480, 3,993,661, JP-A-57-135944, JP-A-57-135945 and JP-A-57-136640; those using an intramolecular sequestering reaction as described in JP-A-55-53330 and JP-A-59-218439; those using the opening of a five-membered or six-membered ring as described in JP-A-57-76541 (U.S. Pat. No. 4,335,200), JP-A-57-135949, JP-A-57-179842, JP-A-59-137945, JP-A-59-140445, JP-A-59-219741 and JP-A-60-41034; and blocking groups using the addition of a nucleophilic agent to an unsaturated bond as described in JP-A-201057, JP-A-61-437,739, JP-A-61-95347 and JP-A-1-245255.

General formula (I) can preferably be represented by general formula (II).

$$A'\text{-}(X_1)_{m1}D \qquad (II)$$

In general formula (II), A' represents a blocking group which is capable of releasing $\text{-}(X_1)_{m1}D$ during processing, D represents a residual color improving agent which satisfies the above-mentioned Condition 1 and is linked to $X_1$ via a hetero atom in D, $X_1$ represents a divalent linking group which is linked to A' via a hetero atom in $X_1$, and $m_1$ represents 0 or 1.

The residual color improving agent represented by D in general formula (II) contains a heteroatom and has a residual color improving effect by itself, although it gives rise to detrimental fogging, reduces the photographic speed and alters the photographic characteristics (speed, gradation, fogging and the like) or the photographic material during storage when it is incorporated in the silver halide photographic material. However, the disadvantages described above do not occur in this invention since D has been made dissociable from A' by photographic processing (development, fixing and the like), being either directly bonded to A' ($m_1=0$) via a hetero atom in D or being bonded to A' via $X_1$ ($m_1=1$).

There is a wide range of compounds which can be selected as D, but cyclic compounds with 2 to 4 rings are preferred, those with a molecular weight of 600 or less are preferred, and the compounds represented by the following general formula (III), general formula (IV) or general formula (V) are particularly preferred when D is represented by the structural formula as a leaving group.

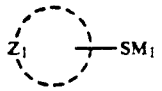

(III)

In general formula (III), $Z_1$ represents a group of atoms necessary to form an alicyclic group or a hetero ring system with 2 to 4 rings. $M_1$ represents a hydrogen atom or a counter-cation.

It is preferable that —$SM_1$ in general formula (III) be linked to a carbon atom in $Z_1$.

$Z_1$ may have substituent groups, preferred substituent groups including halogen atoms, —OM (where M represents a hydrogen atom or a monovalent metal (such as Na, K, Li)), a substituted or unsubstituted alkyl group, a substituted or unsubstituted aryl group, a substituted or unsubstituted alkoxy group, a substituted or unsubstituted amino group, cyano, a nitro group, a sulfo group, a carboxyl group, a substituted or unsubstituted aryloxy group, a substituted or unsubstituted arylthio group, a substituted or unsubstituted arylthio group, a substituted or unsubstituted acyl group, a substituted or unsubstituted aminosulfonyl group, a substituted or unsubstituted alkoxycarbonyl group, a substituted or unsubstituted aryloxycarbonyl group and a substituted or unsubstituted aminocarbonyl group.

Alkyl groups with up to and including 20 carbon atoms are preferred for the alkyl group, examples including a methyl group, an ethyl group, a 2-hydroxyethyl group, a 2-diethylaminoethyl group, a propyl group, an isopropyl group, a 3-dimethylaminopropyl group, a pentyl group, an isopentyl group, a hexyl group, a cyclohexyl group, a heptyl group, a benzyl group and an octadecyl group. Aryl groups with up to and including 15 carbon atoms are preferred for the aryl group, examples including a phenyl group, a tolyl group, a sulfophenyl group, a carboxyphenyl group, a naphthyl group and a sulfonaphthyl group. Alkoxy groups with up to and including 20 carbon atoms are preferred as the alkoxy group, examples including a methoxy group, an ethoxy group, a propyloxy group, a butoxy group and an octadecyloxy group. Substituted amino groups with up to and including 20 carbon atoms are preferred for the substituted amino group, examples including a dimethylamino group, a diethylamino group, a hydroxyamino group, a 2-hydroxyethylamino group, a 2-sulfoethylamino group, a 2-diethylaminoethylamino group, an anilino group and a β-naphthylamino group. Aryloxy groups with up to and including 20 carbon atoms are preferred for the aryloxy group, examples including a phenoxy group, a 4-sulfophenoxy group and a β-naphthyloxy group. Alkylthio groups with up to and including 20 carbon atoms are preferred for the alkylthio group, examples including a methylthio group, an ethylthio group, a 2-hydroxyethylthio group, a 2-diethylaminoethylthio group, a dodecylthio group, a 2-sulfoethylthio group, a 3-sulfopropylthio group and a 4-sulfobutylthio group. Arylthio groups with up to and including 20 carbon atoms are preferred for the arylthio group, examples including a phenylthio group, β-naphthylthio group and 4-sulfophenylthio group. Acyl groups with up to and including 20 carbon atoms are preferred for the acyl group, including an acetyl group, a propionyl group, a butyryl group, a stearoyl group and a benzoyl group. Substituted aminosulfonyl groups with up to and including 20 carbon atoms are preferred for the substituted aminosulfonyl group, including a diethylaminosulfonyl group, a di(2-hydroxyethyl)-aminosulfonyl group, an anilinosulfonyl group, a 2-sulfoethylaminocarbonyl group and a dodecylaminosulfonyl group. Alkoxycarbonyl groups with up to and including 20 carbon atoms are preferred for the alkoxycarbonyl group, including a methoxycarbonyl group, an ethoxy carbonyl group, a methoxyethoxycarbonyl group, a diethylaminoethoxycarbonyl group and a benzyloxycarbonyl group. Aryloxycarbonyl groups with up to and including 20 carbon atoms are preferred for the aryloxycarbonyl group, examples including a phenoxycarbonyl group, a 4-sulfophenyloxycarbonyl group and a tolyloxycarbonyl group. Substituted aminocarbonyl groups with up to and including 20 carbon atoms are preferred for the substituted aminocarbonyl group, including a dimethylaminocarbonyl group, a diethylaminocarbonyl group, a propylaminocarbonyl group, a octadecylaminocarbonyl group and a 2-sulfoethylaminocarbonyl group.

Preferable Examples of a hetero ring system with 2 to 4 rings produced by $Z_1$ include a saturated or unsaturated pyrrole ring system, an imidazole ring system, a triazole ring system, a thiadiazole ring system, a tetrazole ring system, a thiazole ring system, an isothiazole ring system, a pyrazole ring system, an oxazole ring system, an isoxazole ring system, a selenazole ring system, a pyridine ring system, a pyrimidine ring system, a pyridazine ring system a triazine ring system, a quinoxaline ring system, a tetrazaindene ring system, an oxadiazole ring system, a selenadiazole ring system, an indazole ring system, a triazaindene ring, a tellurazole ring system, an indole ring system, an isoindole ring system, an indolenine ring system, a chromene ring system, a chroman ring system, a quinoline ring system, an isoquinoline ring system, a quinolidine ring system, a cinnoline ring system, a phthalazine ring system, a quinazoline ring system, a naphthyridine ring system, a purine ring system, a pteridine ring system, an indolidine ring system, a furan ring system, a thiophene ring system, a pyran ring system, an azepine ring system, an oxazine ring system, a thiazepine ring system, a carbazole ring system, a xanthene ring system, a phenanthridine ring system, an acridine ring system, a perimidine ring system, a phenanthroline ring system, a thianthrene ring system, a phenoxathiin ring system, a phenoxazine ring system, a phenothiazine ring system, a phenazine ring system, a benzene ring system, a naphthalene ring system or an anthracene ring system and the like, or the hetero ring system with 2 to 4 rings formed by mutual fusion .

$M_1$ may be a counter-cation of, for example, a conjugated acid of an organic base (such as triethylamine, pyridine, DBU (1,8-diazabicyalo(5.4.0) undec-7-ene) and the like) or an alkali metal (such as sodium, potassium or the like), or it may represent a hydrogen atom.

(IV)

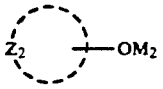

In general formula (IV), $Z_2$ has the same signification as $Z_1$ and $M_2$ has the same signification as $M_1$ in general formula (III)

(V)

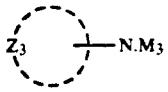

In general formula (V), $Z_3$ represents a group of atoms necessary not only to form a hetero ring system with 2 to 4 rings but also to form a compound which can form iminosilver. Examples of the hetero ring system with 2 to 4 rings are the same as those of the hetero ring system with 2 to 4 rings formed by $Z_1$ in formula (III). $M_3$ has the same signification as $M_1$ in general formula (III).

In this invention, D having the hetero rings shown below are particularly preferred. The positions to be bonded to XI or A' are denoted by arrows.

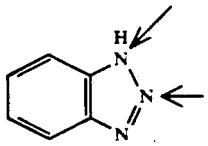

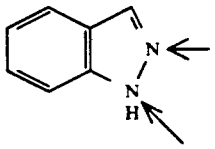

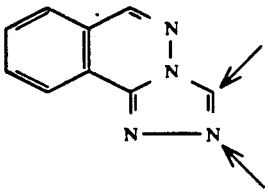

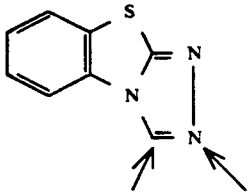

-continued

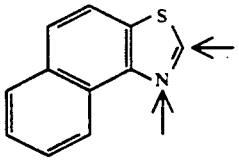

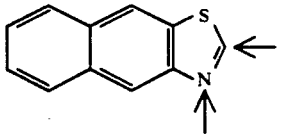

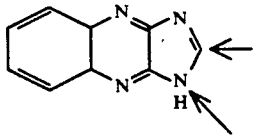

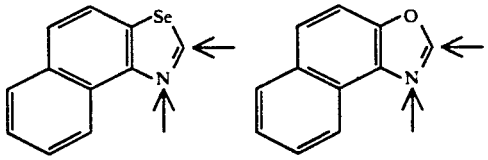

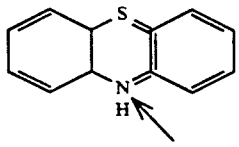

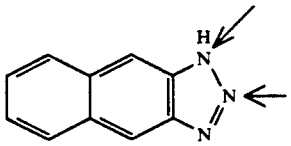

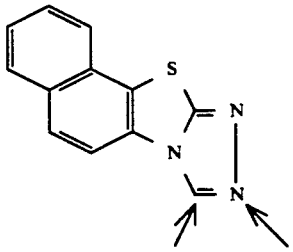

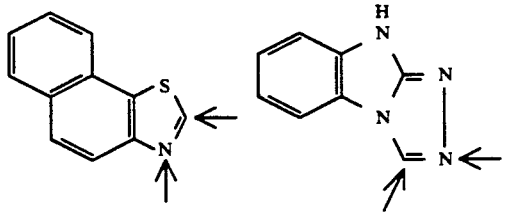

Furthermore, these polycyclic compounds may have substituent groups, preferred substituent groups including halogen atoms, —OM (where M represents a hydrogen atom or a monovalent metal (such as Na, K, Li)), a substituted or unsubstituted alkyl group, a substituted or unsubstituted aryl group, a substituted or unsubstituted alkoxy group, a substituted or unsubstituted amino group, cyano, a nitro group, a sulfo group, a carboxyl group, a substituted or unsubstituted aryloxy group, a substituted or unsubstituted arylthio group, a substituted or unsubstituted arylthio group, a substituted or unsubstituted acyl group, a substituted or unsubstituted aminosulfonyl group, a substituted or unsubstituted alkoxycarbonyl group, a substituted or unsubstituted aryloxycarbonyl group and a substituted or unsubstituted aminocarbonyl group.

Alkyl groups with up to and including 20 carbon atoms are preferred for the alkyl group, examples including a methyl group, an ethyl group, a 2-hydroxyethyl group, a 2-diethylaminoethyl group, a propyl group, an isopropyl group, a 3-dimethylaminopropyl group, a pentyl group, an isopentyl group, a hexyl group, a cyclohexyl group, a heptyl group, a benzyl group and an octadecyl group. Aryl groups with up to and including 15 carbon atoms are preferred for the aryl group, examples including a phenyl group, a tolyl group, a sulfophenyl group, a carboxyphenyl group, a naphthyl group and a sulfonaphthyl group. Alkoxy groups with up to and including 20 carbon atoms are preferred as the alkoxy group, examples including a methoxy group, an ethoxy group, a propyloxy group, a butoxy group and an octadecyloxy group. Substituted amino groups with up to and including 20 carbon atoms are preferred for the substituted amino group, examples including a dimethylamino group, a diethylamino group, a hydroxyamino group, a 2-hydroxyethylamino group, a 2-sulfoethylamino group, a 2-diethylaminoethylamino group, an anilino group and a 8-naphthylamino group. Aryloxy groups with up to and including 20 carbon atoms are preferred for the aryloxy group, examples including a phenoxy group, a 4 sulfophenoxy group and a β-naphthyloxy group. Alkylthio groups with up to and including 20 carbon atoms are preferred for the alkylthio group, examples including a methylthio group, an ethylthio group, a 2-hydroxyethylthio group, a 2-diethylaminoethylthio group, a dodecylthio group, a 2-sulfoethylthio group, a 3-sulfopropylthio group and a 4-sulfobutylthio group. Arylthio groups with up to and including 20 carbon atoms are preferred for the arylthio group, examples including a phenylthio group, β-naphthylthio group and 4-sulfophenylthio group. Acyl groups with up to and including 20 carbon atoms are preferred for the acyl group, including an acetyl group, a propionyl group, a butyryl group, a stearoyl group and a benzoyl group. Substituted aminosulfonyl groups with up to and including 20 carbon atoms are preferred for the substituted aminosulfonyl group, including a diethylaminosulfonyl group, a di(2-hydroxyethyl)aminosulfonyl group, an anilinosulfonyl group, a 2-sulfoethylaminocarbonyl group and a dodecylaminosulfonyl group. Alkoxycarbonyl groups with up to and including 20 carbon atoms are preferred for the alkoxycarbonyl group, including a methoxycarbonyl group, an ethoxycarbonyl group, a methoxyethoxycarbonyl group, a diethylaminoethoxycarbonyl group and a benzyloxycarbonyl group. Aryloxycarbonyl groups with up to and including 20 carbon atoms are preferred for the aryloxycarbonyl group, examples including a phenoxycarbonyl group, a 4-sulfophenyloxycarbonyl group and a tolyloxycarbonyl group. Substituted aminocarbonyl groups with up to and including 20 carbon atoms are preferred for the substituted aminocarbonyl group, including a dimethylaminocarbonyl group, a diethylaminocarbonyl group, a propylaminocarbonyl group, a octadecylaminocarbonyl group and a 2-sulfoethylaminocarbonyl group.

Further, the polycyclic compound in question may take the form of a salt of an inorganic or organic acid. Preferred examples of the inorganic or organic acid include hydrochloric acid, sulfuric acid, nitric acid, hydroboric acid, hydriodric acid, perchloric acid, oxalic acid, p-toluenesulfonic acid, methanesulfonic acid and trifluoromethanesulfonic acid.

In the present invention, D which contains a structure represented by general formula (i) or (ii) is particularly preferable.

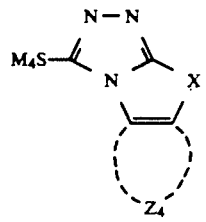

(i)

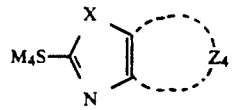

(ii)

wherein $Z_4$ represents a group of non-metallic atoms necessary to form a benzene ring, a naphthalene ring, or a 5-membered or 6-membered hetero ring (e.g., a pyrizine ring) and may have the same substituents as the above-mentioned polycyclic compounds may have, X represents —O—, —S—, or

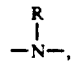

wherein R represents a hydrogen atom, an alkyl group, an aryl group, an acyl group, an allyl group, an alkanesulfonyl group, or an allenesulfonyl group, and $M_4$ has the same signification as $M_1$ in general formula (III).

The compounds represented by general formula (i) or (ii) are bonded to $X_1$ or A' in the following forms.

In case of the compound represented by general formula (i)

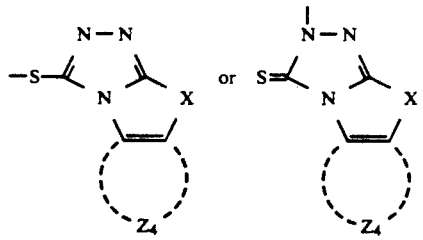

In case of the compound represented by general formula (ii)

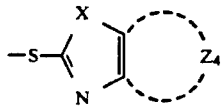

Furthermore, the residual color improving agent represented by D is preferably water soluble or colorless.

$X_1$ in general formula (II) represents a divalent linking group, which is linked to A' via a hetero atom and represents a group which releases D rapidly after opening as $X_1-D$ during photographic processing (such as development, fixing and the like).

Such linking groups include those which release D by means of an intramolecular sequestering reaction as described in JP-A-54-145135 (laid-open United Kingdom Patent 2,010,818A), U.S. Pat. Nos. 4,248,962 and 4,409,323 nd G.B. Patent 2,096,783, those which release D by means of intramolecular electron transfer as described in, for example, G.B. Patent 2,072,363 and JP-A-57-154234, those which release D in conjunction with carbon dioxide gas as described in, for example, JP-A-57-179842, and those which release D in conjunction with the dissociation of formalin as described in JP-A-59-93422. The structural formulae of representative examples of $X_1$ as described above are shown below together with D.

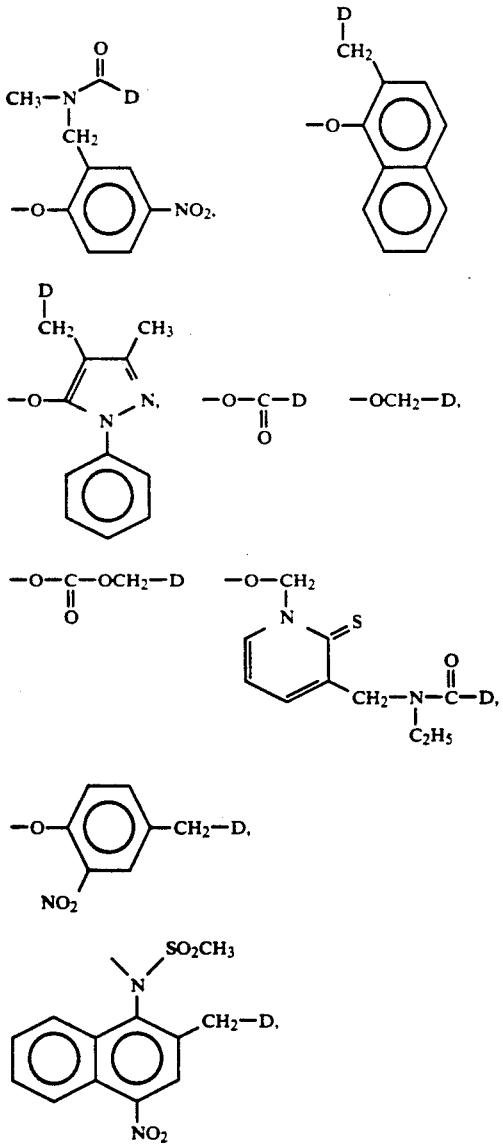

-continued

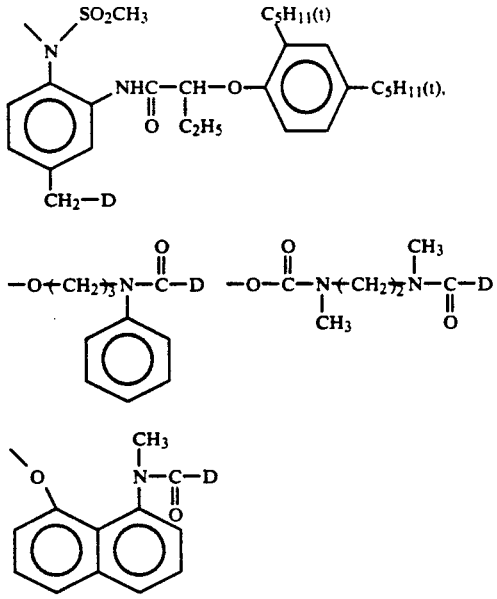

In addition to using such structures as $X_1$ the selection is made in accordance with the release timing and release control for D and the type of residual color improving agent D which is employed.

Preferably, the group represented by A' in general formula (II) has at least one of the following groups:

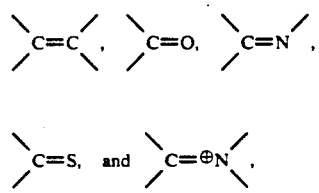

and releases $X_1-D$ by the attack of a nucleophilic substance on a carbon in the functional group (representative examples including $OH^-$ ions and $SO_3^{2-}$ ions) and the subsequent reaction. Among these, particularly preferable groups for A' are represented by the following general formula (VI) together with $X_1-D$ defined above.

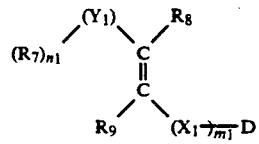

(VI)

In general formula (VI), $R_7$, $R_8$ and $R_9$ may be identical or different and each represents a hydrogen atom or a group capable of being substituted, and $R_7$ and $R_8$ or $R_7$ and $R_9$ may link to form a carbon ring or hetero ring system. $n_1$ represents 0 or 1, with the proviso that when $n_1=1$, $Y_1$ represents

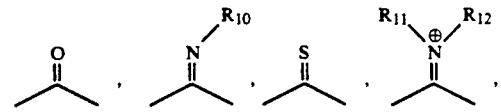

-continued

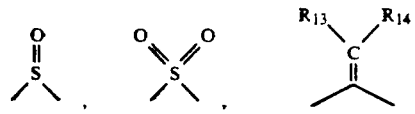

and when $n_1=0$, $Y_1$ represents a cyano group or a nitro group (here, $R_{10}$, $R_{11}$, $R_{12}$, $R_{13}$ and $R_{14}$ may be identical or different and each represents a hydrogen atom or a group capable of being substituted), and D, $X_1$ and $m_1$ have the same signification as they do in the preceding general formula (II).

In the case of the compounds represented by general formula (VI), the residual color improving agent represented by D can dissociate by the addition of a nucleophilic agent in a processing solution (such as a $OH^-$ ion, $SO_3^{2-}$ ion or hydroxylamine) to the unsaturated bond during photographic processing (development, fixing and the like). Furthermore, a preferred mode is that in which the compound of general formula (VI) is oil soluble before processing and releases a water-soluble residual color improving agent during processing.

By way of a blocking method for the active group which makes use of the addition of a nucleophilic agent to the unsaturated bond in this way, it is possible to use those described in JP-A-59-201057, JP-A-61-43739 and JP-A-61-95347.

General formula (VI) is discussed in detail below.

$R_7$ represents a hydrogen atom or a group which can be substituted. A group which can be substituted denotes an alkyl group (preferably with 1 to 20 carbon atoms), an alkenyl group (preferably with 2 to 20 carbon atoms), an aryl group (preferably with 6 to 20 carbon atoms), an alkoxy group (preferably with 1 to 20 carbon atoms), an aryloxy group (preferably with 6 to 20 carbon atoms), an alkylthio group (preferably with 1 to 20 carbon atoms), an arylthio group (preferably with 6 to 20 carbon atoms), an amino group (unsubstituted amino, preferably secondary or tertiary amino substitute with an alkyl group with 1 to 20 carbon atoms or an aryl group with 6 to 20 carbon atoms), or a hydroxyl group; and these substituent groups may have one or more of the following substituent groups, and when there are two or more substituent groups, these may be identical or different.

Actual examples of substituent groups in this case include halogen atoms (fluorine, chlorine, bromine), alkyl groups (preferably with 1 to 20 carbon atoms), aryl groups (preferably with 6 to 20 carbon atoms), alkoxy groups (preferably with 1 to 20 carbon atoms), aryloxy groups (preferably with 6 to 20 carbon atoms), alkylthio groups (preferably with 1 to 20 carbon atoms), arylthio groups (preferably with 6 to 20 carbon atoms), acyl groups (preferably with 2 to 20 carbon atoms), acylamino groups (preferably alkanoylamino with 1 to 20 carbon atoms or benzoylamino with 6 to 20 carbon atoms), nitro groups, cyano groups, oxycarbonyl groups (preferably alkoxycarbonyl with 1 to 20 carbon atoms or aryloxycarbonyl with 6 to 20 carbon atoms), hydroxyl groups, carboxy groups, sulfo groups, ureido groups (preferably alkylureido with 1 to 20 carbon atoms or arylureido with 6 to 20 carbon atoms), sulfonamido groups (preferably alkylsulfonamido with 1 to 20 carbon atoms or arylsulfonamido with 6 to 20 carbon atoms), sulfamoyl groups (preferably alkylsulfamoyl with 1 to 20 carbon atoms or arylsulfamoyl with 6 to 20 carbon atoms), carbamoyl groups (preferably alkylcarbamoyl with 1 to 20 carbon atoms or arylcarbamoyl with 6 to 20 carbon atoms), acyloxy groups (preferably with 1 to 20 carbon atoms), amino groups (unsubstituted amino, preferably secondary or tertiary amino substituted with an alkyl group with 1 to 20 carbon atoms or an aryl group with 1 to 20 carbon atoms), carbonic acid ester groups (preferably an alkyl carbonic acid ester with 1 to 20 carbon atoms or an aryl carbonic acid ester with 6 to 20 carbon atoms), sulfone groups (preferably alkylsulfone with 1 to 20 carbon atoms or arylsulfone with 6 to 20 carbon atoms) or sulfinyl groups (preferably slkylsulfinyl with 1 to 20 carbon atoms or arylsulfinyl with 6 to 20 carbon atoms).

Furthermore, $R_7$ may link with $R_8$ or $R_9$ to form a carbon ring or hetero ring system (for example a 5 to 7-membered ring). $R_8$ and $R_9$ may be identical or different, each representing a hydrogen atom or a group which can be substituted; a group which can be substituted denoting a halogen atom (fluorine, chlorine, bromine), an alkyl group (preferably with 1 to 20 carbon atoms), an aryl group (preferably with 6 to 20 carbon atoms), an alkoxy group (preferably with 1 to 20 carbon atoms), an aryloxy group (preferably with 6 to 20 carbon atoms), an alkylthio group (preferably with 1 to 20 carbon atoms), an arylthio group (preferably with 6 to 20 carbon atoms), an acyloxy group (preferably with 2 to 20 carbon atoms), an amino group (unsubstituted amino, preferably secondary or tertiary amino substituted with an alkyl group with 1 to 20 carbon atoms or an aryl group with 6 to 20 carbon atoms), a carboxamido group (preferably alkylcarboxamido with 1 to 20 carbon atoms or arylcarboxamido with 6 to 20 carbon atoms), an ureido group (preferably alkylureido with 1 to 20 carbon atoms or arylureido with 6 to 20 carbon atoms), a carboxy group, a carbonic acid ester group (preferably an alkyl carbonic acid ester with 1 to 20 carbon atoms or an aryl carbonic acid ester with 6 to 20 carbon atoms), an oxycarbonyl group (preferably alkyloxycarbonyl with 1 to 20 carbon atoms or aryloxycarbonyl with 6 to 20 carbon atoms), a carbamoyl group (preferably alkylcarbamoyl with 1 to 20 carbon atoms or arylcarbamoyl with 6 to 20 carbon atoms), an acyl group (preferably alkylcarbonyl with 1 to 20 carbon atoms or arylcarbonyl with 6 to 20 carbon atoms), a sulfo group, a sulfonyl group (preferably alkylsulfonyl with 1 to 20 carbon atoms or arylsulfonyl with 6 to 20 carbon atoms), a sulfinyl group (preferably alkylsulfinyl with 1 to 20 carbon atoms or arylsulfinyl with 6 to 20 carbon atoms), a sulfamoyl group (preferably alkylsulfamoyl with 1 to 20 carbon atoms or arylsulfamoyl with 6 to 20 carbon atoms), a cyano group or a nitro group.

These substituent groups given for $R_8$ and $R_9$ may have one or more substituent groups, and, when there are two or more substituent groups, these may be identical or different; actual examples of the substituent groups being the same as the substituent groups for $R_7$ mentioned above.

$R_{10}$, $R_{11}$, $R_{12}$, $R_{13}$ and $R_{14}$ may be identical or different and each represents a hydrogen atom or a group capable of being substituted; actual examples of substituent groups include an alkyl group (preferably with 1 to 20 carbon atoms), an alkenyl group (preferably with 2 to 20 carbon atoms), an aryl group (preferably with 6 to 20 carbon atoms), an alkoxy group (preferably with 1 to 20 carbon atoms), an aryloxy group (preferably with 6 to 20 carbon atoms), an acyloxy group (preferably with 2 to 20 carbon atoms), an amino group (unsubstituted amino, preferably a secondary or tertiary amino substituted with an alkyl group with 1 to 20 carbon atoms or an aryl group with 6 to 20 carbon atoms), a carboxamido group (preferably alkylcarboxamido with 1 to 20 carbon atoms or arylcarboxamido with 6 to 20 carbon atoms), an ureido group (preferably alkylureido with 1 to 20 carbon atoms or arylureido with 6 to 20 carbon atoms), an oxycarbonyl group (preferably alkyloxycarbonyl with 1 to 20 carbon atoms or aryloxycarbonyl with 6 to 20 carbon atoms), a carbamoyl group (preferably alkylcarbamoyl with 1 to 20 carbon atoms or arylcarbamoyl with 6 to 20 carbon atoms), an acyl group (preferably alkylcarbonyl with 1 to 20 carbon atoms or arylcarbonyl with 6 to 20 carbon atoms), a sulfonyl group (preferably alkylsulfonyl with 1 to 20 carbon atoms or arylsulfonyl with 6 to 20 carbon atom), a sulfinyl group (preferably alkylsulfinyl with 1 to 20 carbon atoms or arylsulfinyl with 6 to 20 carbon atoms), or a sulfamoyl group (preferably alkylsulfamoyl with 1 to 20 carbon atoms or arylsulfamoyl with 6 to 20 carbon atoms). Of these, preferred substituent groups for $R_{13}$ and $R_{14}$ include an oxycarbonyl group, a carbamoyl group, an acyl group, a sulfonyl group, a sulfamoyl group, a sulfinyl group, a cyano group and a nitro group. These substituent groups may have one or more substituent groups, and, when there are two or more substituent groups, these may be identical or different; actual examples of substituent groups include the same substituent groups as those for $R_7$ described above.

Of the structures represented by general formula (VI), those represented by general formula (VII) and (VIII) are preferred.

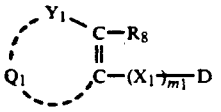

(VII)

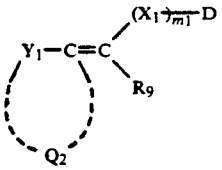

(VIII)

In general formula (VII), $Q_1$ represents a group of atoms necessary to form a carbon ring or hetero ring system.

More specifically, these are a 5-membered, 6-membered or 7-membered carbon ring system, or a 5-membered, 6-membered or 7-membered hetero ring system containing one or more nitrogen, oxygen or sulfur atoms or the like, and these carbon rings or hetero rings also include those in which a fused ring has been formed at a suitable position.

More specifically there may be mentioned cyclopentenone, cyclohexenone, cycloheptenone, benzocycloheptenone, benzocyclopentenone, benzocyclohexenone, 4-pyridone, 4-quinolone, 2-pyrone, 4-pyrone, 1-thio-2-pyrone, 1-thio-4-pyrone, coumatin, chroman, uracil, and also

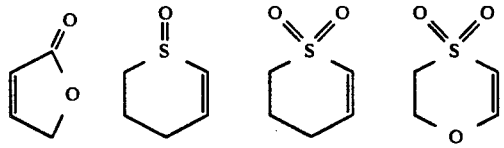

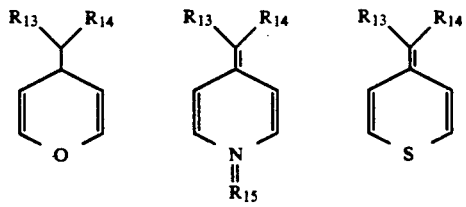

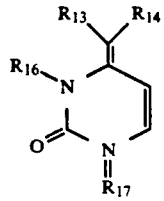

$R_{13}$ and $R_{14}$ have the same signification as they do in general formula (VI) above, and $R_{15}$, $R_{16}$ and $R_{17}$ represent hydrogen atoms, alkyl groups, alkenyl groups, aryl groups, aralkyl groups, acyl groups and the like.

The carbon rings or hetero rings may have one or more substituent groups, and, when there are two or more substituent groups, these may be identical or different. Actual examples of substituent groups include the same ones as the substituent groups for $R_7$ described above.

Furthermore, $Q_2$ in general formula (VIII) has the same signification as $Q_1$ in general formula (VII), specific examples including cyclopentanone, cyclohexanone, cycloheptanone, benzocycloheptanone, benzocyclopentanone, benzocyclohexanone, 4-tetrahydropyridone, 4-dihydroquinolone and 4-tetrahydropyrone. These carbon rings or hetero rings may have one or more substituent groups, and, when there are two or more substituent groups, these may be identical or different. Specific examples of the substituent groups include the same ones as the substituent groups for $R_7$ described above.

$R_8$, $R_9$, $X_1$, $Y_1$ and D and $m_1$ are the same as given in general formula (VI).

In general formula (VI), $R_7$, $R_8$, $R_9$, $R_{10}$, $R_{11}$, $R_{12}$, $R_{13}$ and $R_{14}$ are selected in accordance with the pH and the composition of the processing solution in which the photographic element having general formula (VI) is processed and in accordance with the timing required.

Furthermore, with the compound of this invention it is possible to control the speed of release of the residual color improving agent by the use of a nucleophilic substance such as, in particular, a sulfite ion, hydroxylamine, a thiosulfate ion, metabisulfite ion, hydroxamic acid and compounds analogous thereto as described in JP-A-59-198453, oxime compounds as described in JP-A-60-35729 and the dihydroxybenzene-based developing agents, 1-phenyl-3-pyrazolidone-based developing agents and p-aminophenol-based developing agents discussed hereinafter, as well as by the pH during photographic processing (such as development, fixing and the like).

The amount of the nucleophilic substance which is added is generally about 1 to $10^8$, and preferably $10^2$ to $10^6$ times by mole greater than the amount of the compound of this invention.
Actual examples of the compound of this invention are given below, but the invention is not limited to these.
(1)
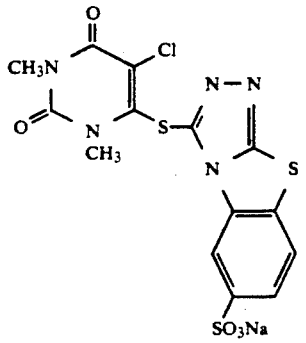
(2)
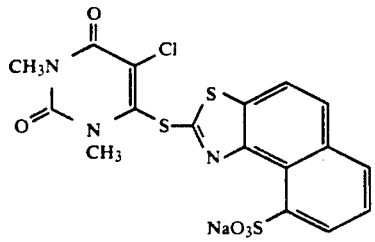
(3)
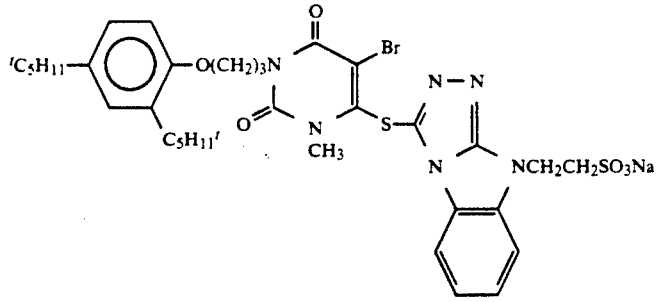
(4)
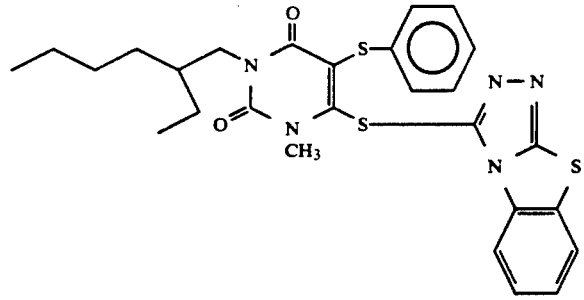
(5)
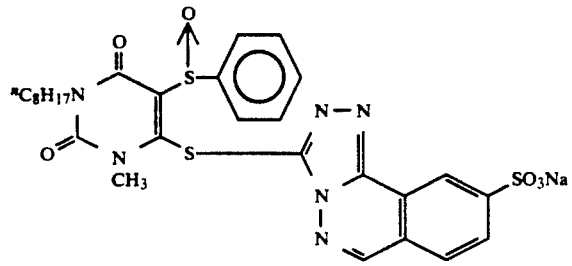

-continued
(6)
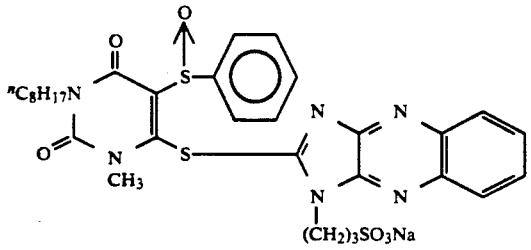
(7)
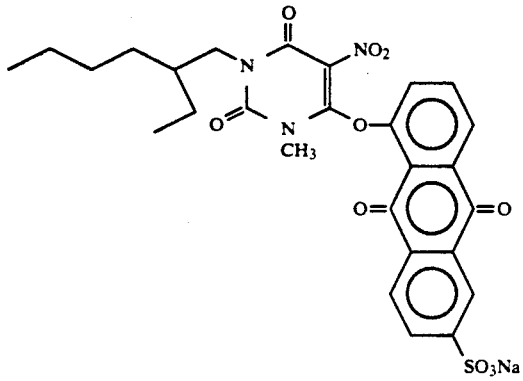
(8)
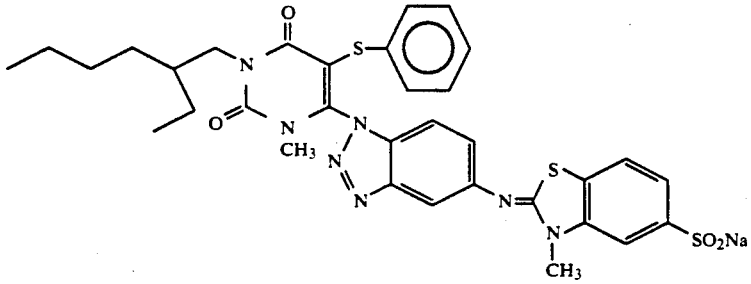
(9)
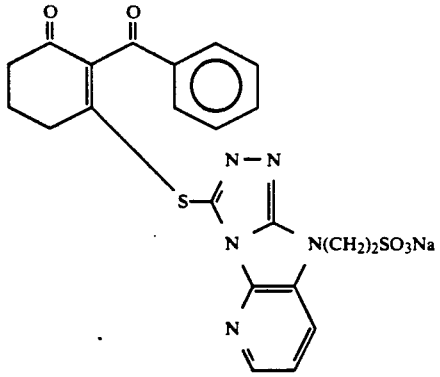
(10)
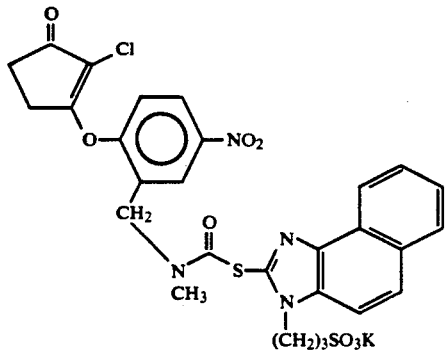

-continued
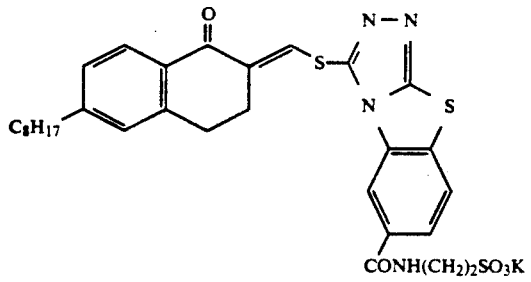
(11)
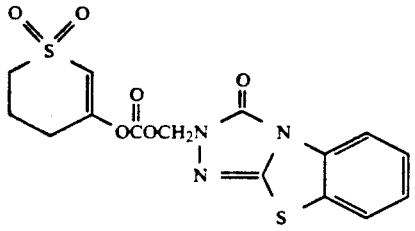
(12)
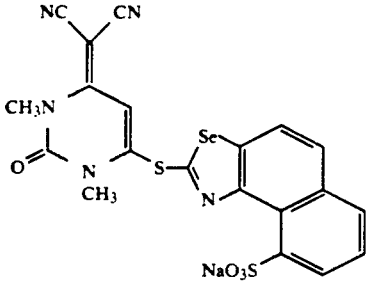
(13)
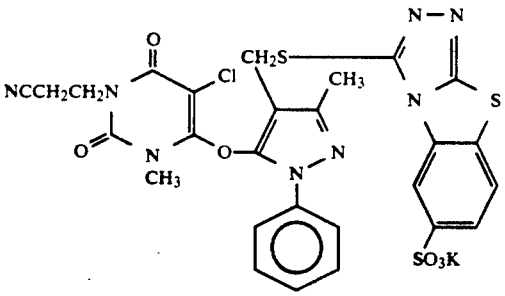
(14)
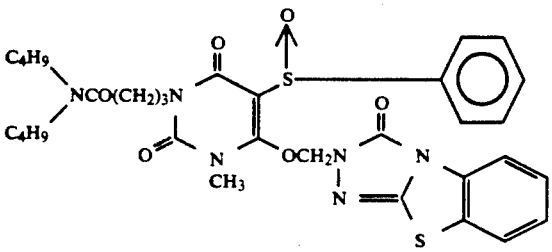
(15)

-continued
(16)
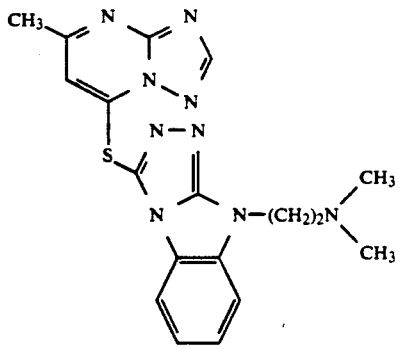
(17)
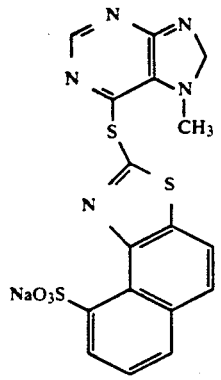
(18)
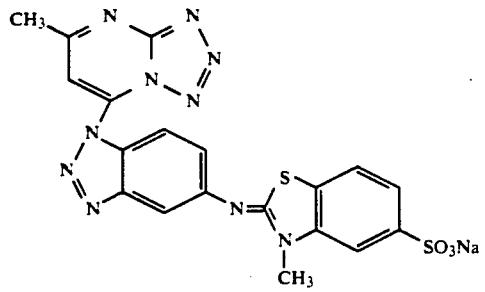
(19)
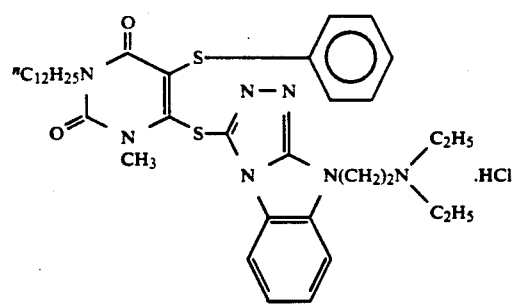
(20)
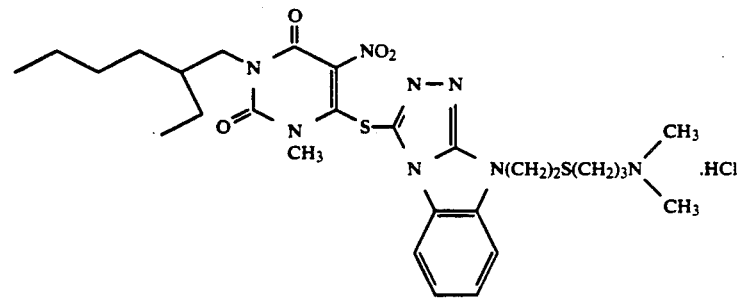

-continued (21)

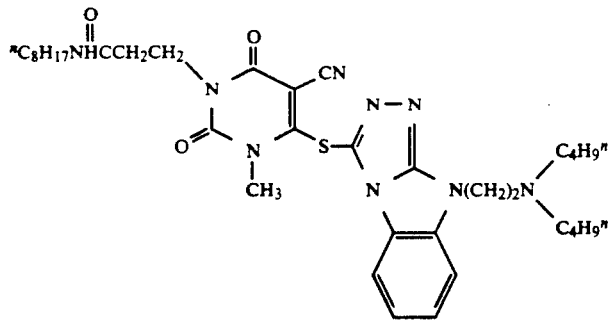

The molecular extinction coefficients directed to the residual color improving agents released from Compounds (1) to (21) were all zero under the measurement of Condition 1 described above.

Compounds (1), (2), (3), (5), (8), (10), (14), (15), (16), (19), (20), and (21) are preferable in the present invention.

The compound represented by general formula (I) can be synthesized by the methods described in JP-A-59-201057, JP-A-61-43739, JP-A-61-95347.

The compound of general formula (I) of the present invention may be added to any of photosensitive emulsion layers or non-photosensitive layers and may be added to one or more layers. The compound of general formula (I) of the present invention is added preferably to a non-photosensitive layer such as an intermediate layer, a protective layer, a antihalation layer, and a back layer which is provided on the side opposed to a emulsion layer-side of a support. More preferably, the compound of general formula (I) of the present invention is added to an intermediate layer, a protective layer, or an antihalation layer.

The total amount of the compound of the present invention which is added is 0.001 mol % to 100 mol %, preferably 0.001 mol % to 50 mol %, and particularly preferably 0.01 mol % to 20 mol % based on the total coverage of silver.

The compound of this invention can be added to the coating solution by dissolving and dispersing it with an alcohol such as methanol, water, tetrahydrofuran (hereinafter reffered to as THF), acetone, gelatin or a surfactant. Further, it can be dissolved in a high-boiling organic solvent in the same way as a coupler and subjected to emulsification and dispersion using a homogenizer. Further, it can be dispersed in a polymer or dispersed as fine particles.

The silver halide photographic material of this invention exhibits pronounced effects when a silver halide photographic material which has been spectrally sensitized using sensitizing dyes has been processed rapidly, preferably for 90 seconds or less and particularly preferably for 70 seconds or less.

The residual color improving agent to be released in the present invention prevents sensitizing dyes from being agglomerated or destroys the agglomerates of sensitizing dyes in a layer and, therefore, the residual color is improved.

When the silver halide photographic material of this invention is a black-and-white photographic material, the exposed silver halide photographic material can be processed by a development processing method consisting of development, fixing, washing and drying or of development, fixing, stabilizing and drying stages.

In view of the ease of obtaining good photographic performance, a combination of a dihydroxybenzene and a 1-phenyl-3-pyrazolidone is most preferred as the principal developing agent used in the developing solution employed in the development processing. Of course, other p-aminophenol-based developing agents may also be included.

Dihydroxybenzene developing agents include hydroquinone, chlorohydroquinone, bromohydroquinone, isopropylhydroquinone, methylhydroquinone, 2,3-dichlorohydroquinone, 2,5-dichlorohydroquinone,2,3-dibromohydroquinone and 2,5-dimethylhydroquinone, and hydroquinone is particularly preferred.

p-Aminophenol-based developing agents include N-methyl-p-aminophenol, p-aminophenol, N-(β-hydroxyethyl)-p-aminophenol N-(4-hydroxyphenyl)glycine, 2-methyl-p-aminophenol and p-benzylaminophenol, and N-methyl-p-aminophenol is preferred amongst these.

3-Pyrazolidone-based developing agents include 1-phenyl-3-pyrazolidone, 1-phenyl-4,4-dimethyl-3-pyrazolidone, 1 phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminphenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone.

The developing agent is preferably used in an amount of 0.01 mole/l to 1.2 mole/l.

Sulfite preservatives include sodium sulfite, potassium sulfite, lithium sulfite, ammonium sulfite, sodium bisulfite and potassium metabisulfite. The sulfites are preferably used at 0.2 mol/l or more, and particularly preferably at 0.4 mole/l. Furthermore, it is preferable to adopt an upper limit of 2.5 mole/l.

The pH of the developing agent is preferably in a range of 9 to 13. A pH range of 10 to 12 is even more preferable.

Alkalis used to set the pH include pH adjusters such as sodium hydroxide, potassium hydroxide, sodium carbonate, potassium carbonate, sodium triphosphate and potassium triphosphate.

Buffers such as those in JP-A-62-186259 (borates), those in JP-A-60-93433 (such as sucrose, acetoxime and 5-sulfosalicylic acid), phosphates and carbonates may also be used.

Film hardeners may also be used in the developing solution mentioned above. Dialdehyde-based film hardeners or the bisulfite addition compounds thereof are preferably used as the film hardener, and actual examples of these include glutaraldehyde and the bisulfite addition compound thereof.

Additives which may be used in addition to the above-mentioned constituents include development inhibitors such as sodium bromide, potassium bromide and potassium iodide; organic solvents such as ethylene glycol, diethylene glycol, triethylene glycol, dimethylformamide, methylcellosolve, hexylene glycol, ethanol and methanol; and antifoggants such as 1-phenyl-5-mercaptotetrazole, 2-mercaptobenzimidazole-5-sulfonic acid, sodium salt and other such mercapto compounds, 5-bitroindazole and other such indazole-based compounds and 5-methylbenzotriazole and other such benzotriazole-based compounds, the development accelerators described in Research Disclosure Vol. 176, No. 17643, Section XXI (December 1978), and, if required, toners, surfactants, defoaming agents, water softeners and the amino compounds described in JP-A-56-106244.

Silver-staining preventors such as the compounds described in JP-A-56-24347 can be used in the developing solution in the development processing.

Amino compounds such as the alkanolamines described in European Patent 0,136,582 and JP-A-56-06244 can be used in the developing solution.

Additionally, it is possible to use the substances described, for example, on pages 226 to 229 of "Photographic Processing Chemistry" by L.F.A. Mason (Focal Press, 1966), in U.S. Pat. Nos. 2,193,015, 2,592,364 and JP-A-48-64933.

The fixing solution is an aqueous solution containing a thiosulfate as the fixer and has a pH of 3.8 or more, and preferably of 4.2 to 7.0. More preferably it has a pH of 4.5 to 5.5.

Fixers include sodium thiosulfate and ammonium thiosulfate, and ammonium thiosulfate is particularly preferred from the point of view of the speed of fixing. The amount of fixer which is used can be varied as appropriate, but is generally about 0.1 to about 6 mole/l.

A water-soluble aluminum salt which acts as a film hardener may be included in the fixing solution, such salts including, for example, aluminum chloride, aluminum sulfate and potash alum.

Tartaric acid, citric acid, gluconic acid and derivatives thereof can also be used, either singly or two or more, in the fixing solution. These compounds are effective if included at 0.005 mole or more per liter of the fixing solution and are particularly effective at 0.01 mole/l to 0.03 mole/l.

If desired, the fixing solution can contain preservatives (such as sulfites and bisulfites), pH buffers (such as acetic acid and boric acid), pH adjusters (such as sulfuric acid), chelating agents with a water-softening potential and the compounds described in JP-A-62-78551.

It is preferable to weaken the processing hardening by reducing the percentage swelling of the photographic material (preferably 150% to 50%) since this facilitates faster processing. Thus, it is preferable that there be no hardening in development and also preferably that there be no hardening in fixing, and the hardening reaction may also be weakened by adopting a pH of 4.6 or more in the fixing solution. In this way, it is possible to construct a replenishing agent composed of a developing solution and a fixing solution respectively in a single solution, which has the advantage that a simple dilution with water is sufficient for adjusting the replenishment solution.

The above-mentioned silver halide photographic materials of this invention are processed with washing water or a stabilizing solution after the developing and fixing stages. The stabilizing solution is the same as for the washing, the nomenclature being all that is different.

The replenishment amount for the washing water or stabilizing solution is preferably 2 l or less (including 0, which is to say a standing water wash) per 1 $m^2$ of photographic material.

This not only makes it possible to effect a water-saving processing but also obviates the need for piping in the automatic development apparatus.

The multi-stage countercurrent system (for example with 2 or 3 stages) has long been known as a method for reducing the replenishment amount. Even more efficient washing is carried out if the multi-stage countercurrent system is applied in this invention since, after it has been fixed, the photographic material progressively makes contact in a gradually cleaner direction, which is to say in the direction of the processing solution which is not contaminated by the fixing solution.

When the above-mentioned development processing is carried out as a water-saving processing or as a pipeless processing, it is preferable to have an antimicrobial means in the washing water or stabilizing solution.

By way of an antimicrobial means, it is possible to use the ultraviolet irradiation method described in JP-A-60-263939, the method using a magnetic field described in JP-A-60-263940, the method in which he water is purified using an ion-exchange resin described in JP-A-61-131632, and the methods using antibacterial agents described in JP-A-62-115154, JP-A-62-153952, JP-A-62-220951 and JP-A-62-209532.

Furthermore, it is also possible to use the antibacterial agents, antifungal agents and surfactants described, for example, in "Water Quality Criteria" by L. E. West, Photo. Sci. & Eng. Vol. 9 No. 6 (1965), "Microbiological Growths in Motion-Picture Processing" by M. W. Beach, SMPTE Journal, Vol. 85 (1976), "Photo Processing Wash Water Biocides" by R.0. Deegan, J. Imaging Tech. 10, No. 6 (1984) and in JP-A-57-8542, JP-A-57-58143, JP-A-58-105145, JP-A-57-132146, JP-A-58-18631, JP-A-57-97530 and JP-A-57-157244.

Furthermore, in the washing bath and stabilization bath, it is also possible to use microbiocides such as the isothiazoline-based compounds described in J. Image. Tech. by R. T. Kreiman, 10 (6) page 242 (1984), the isothiazoline-based compounds described in Research Disclosure Vol. 205, No. 20526 (May 1981), the isothiazoline-based compounds described in Research Disclosure Vol. 228, No. 22845 (April 1983), and the compounds described in JP-A-62-209532.

In addition, compounds such as those described in "Bokin Bobai No Kagaku" (The Chemistry of Antimicrobial and Antifungal Agents) by H. Horiguchi, Mitsutomo Publishing (1982), and in "Bokin Bobai Gijutsu Handbook" (Antimicrobial and Antifungal Technology Handbook) by the Japanese Antimicrobial and Antifungal Society, Hakuhodo (1986) may also be included.

When the silver halide photographic material of this invention is stabilized in a stabilizing solution or washed with a small amount of washing water, it is preferably to provide a squeeze roller washing tank as described in JP-A-63-18350. Furthermore, it is preferable to adopt a washing stage configuration such as that in JP-A-63-143548.

Moreover, part or all of the overflow from the washing or stabilization bath, which is produced by replenishing the washing or stabilization bath with water which has undergone an antifungal stage according to the processing, can be used in a processing solution having a fixing capability, which is the preceding processing stage, as described in JP-A-60-235133.

When the silver halide photographic material of this invention is a black-and-white material, and when it is processed in an automatic developing apparatus including at least the above developing, fixing and washing or stabilizing and drying stage, it is preferable that the stages from development to drying be completed within 90 seconds, which is to say that the time taken from when the front edge of the photographic material is immersed in the developing solution, as it passes through fixing and washing (or stabilization) stages and is dried and until the said front edge emerges from the drying zone (the so-called dry to dry time) is 90 seconds or less, and this is particularly preferably 70 seconds or less. More preferably, this dry to dry time is 60 seconds or less.

In a similar way to that described above, in this invention "the time taken in the developing stage" or the "developing time" refers to the time from when the front end of the photographic material being processed is immersed in the solution in the developing tank in the automatic developing apparatus until it is immersed in the fixing solution which follows, "the fixing time" refers to the time from when it is immersed in the solution in the fixing tank until it is immersed in the washing tank solution (stabilizing solution) which follows, and the "washing time" refers to the time during which it is immersed in the washing tank solution.

Furthermore, normally an automatic developing apparatus is equipped with a drying zone through which a hot blast of 35° C. to 100° C., and preferably 40° C. to 80° C., is blown, and the "drying time" refers to the time spent in this drying zone.

To achieve a rapid processing with a dry to dry time of 90 seconds or less as discussed above, the developing time is 30 seconds or less and preferably 25 seconds or less, and the developing temperature is preferably 25° C. to 50° C. and more preferably 30° C. to 40° C.

The fixing temperature and time in this invention are preferably about 20° C. to about 50° C. and 6 sec. to 30 sec., and more preferably 30° C. to 40° C. and 6 sec. to 20 sec.

The washing or stabilization temperature and time are preferably 0 to 50° C. and 6 sec. to 20 sec., and more preferably 15° C. to 40° C. and 6 sec. to 15 sec.

In this invention, the photographic material which has been developed, fixed and washed or stabilized is dried by pressing out the washing water, which is to say by passing it through squeeze rollers. Drying is varied out at about 40° C. to about 100° C. and the drying time is suitably varied according to the surrounding conditions, but it is normally about 5 seconds to 30 seconds, and more preferably 40° C. to 80° C. for about 5 seconds to 20 seconds.

In order to prevent development unevenness, which is a characteristic feature of rapid processing, when effecting a development processing from dry to dry in 90 seconds or less using a photographic material/processing system of this invention, it is preferable to use rubber rollers as described in JP-A-63-151943 as the rollers at the developing tank outlet, to adopt a discharge running rate of 10 m/min. or more for the developing solution stirring within the developing solution tank as described in JP-A-63-151944, or to stir more strongly than in the holding mechanism in the development processing at least as described in JP-A-63-264758. Moreover, for rapid processing of the kind of this invention, it is particularly preferable that the structure of the rollers in the fixing solution tank makes the fixing rate more rapid and involves facing rollers. By adopting a facing-roller construction it is possible to reduce the number of rollers and make the processing tank smaller. Thus it is possible to make the automatic processing apparatus more compact.

There are no particular limitations on the photographic material of this invention which may be used as would any common photographic material. For example, it can be used as a scanner material for printing or a photographic material for laser printers in medical imaging, or a direct X-ray material for medical purposes, an indirect X-ray material for medical purposes, a CRT image-recording material, a high-contrast material for printing, a color negative material, a color reversal material, a color printing paper and the like.

The production of the photographic material of this invention can be carried out, for example, by one, or a combination of two or more of the following methods.

(1) Using a silver halide containing a little or no iodine, which is to say, suing silver chloride, silver bromide, silver chlorobromide, silver iodobromide, silver chloroiodobromide or the like with a silver iodide content of 0 to 5 mol %.

(2) Including a water-soluble iridium salt in the silver halide emulsion.

(3) Reducing the amount of coated silver in the silver halide emulsion layers; for example, with 1 to 5 $g/m^2$ and preferably 1 to 4 $g/m^2$ on one side, and more preferably 1 to 3 $g/m^2$.

(4) Reducing the average grain size of the silver halide in the emulsion; for example, 1.0 $\mu$ or less and preferably 0.7 $\mu$ or less.

(5) Having tabular grains as the silver halide grains in the emulsion; for example, using those with an aspect ratio of 4 or more and preferably of 5 or more.

(6) Achieving a percentage swelling of 200% or less in the silver halide photographic material.

The silver halide grains in the photographic emulsion may be so-called regular grains having a cubic, octahedral, tetradecahedral or other such regular crystal form, or those having a spherical or other such irregular crystal form, those having twin crystal surfaces or other such crystal defects, or they may be tabular grains or complex forms of these.

The aspect ratio of the tabular grains is given by the ratio between the average value of the diameters of circles having the same surface area as the projected surface area of each of he tabular grains and the average value of the grain thickness of each of the tabular grains. In this invention, the preferred grain from for tabular grains is an aspect ratio of 4 or more and under 20 and more preferably 5 or more and under 10. Moreover, the grain thickness is preferably 0.3 $\mu$ or less and particularly preferably 0.2 $\mu$ or less.

It is preferable that 80% by weight, and more preferably 90% by weight or more of all the grains be tabular grains.

There may be employed a monodisperse emulsion in which the silver halide grain size has a narrow distribution or a polydisperse emulsion in which it has a wide distribution.

The silver halide photographic emulsion of this invention can be prepared by known methods. For example, it is possible to follow the methods described in Research Disclosure No. 17643 (December 1978) pages 22 to 23 'I. Emulsion Preparation (emulsion preparation and types)" and Research Disclosure No. 18716 (November 1979), page 648.

The photographic emulsion used in this invention can be prepared using the methods described in, for example, "Chimie et Physique Photographique", P. Glafkides (Paul Montel, 1967), "Photographic Emulsion Chemistry" by G. F. Duffin (Focal Press, 1966), and "Making and Coating Photographic Emulsion" by V. L. Zelikman et al., (Focal Press 1964).

In order to control the growth of the grains during the formation of the silver halide grains used in this invention, it is possible to use, as silver halide solvents, ammonia, potassium thiocyanate, ammonium thiocyanate, thioether compounds (for example, U.S. Pat. Nos. 3,271,157, 3,574,628, 3,704,130, 4,297,439 and 4,276,374), thione compounds (for example JP-A-54-144319, JP-A-53-82408 and JP-A-55-77737) and amine compounds (for example JP-A-54-100717).

Water-soluble rhodium salts and the water-soluble iridium salts mentioned above can be used in this invention. The one-sided mixing method, the simultaneous mixing method, a combination thereof and the like may all be used as the system for reacting the soluble silver salts and soluble halogen salts in this invention.

It is also possible to use the methods in which the grains are formed in an excess of silver ions (the so-called reverse mixing method). As one form of the simultaneous mixing method, it is possible to use the method in which the pAg is kept constant in the liquid phase in which the silver halide is formed, in other words the controlled double jet method, and this method provides silver halide grains with a regular grain form and a nearly uniform grain size.

The silver halide emulsion used in this invention is preferably chemically sensitized.

When it is chemically sensitized the usual sulfur sensitization, reduction sensitization, precious metal sensitization and combinations thereof may be used.

More specifically, chemical sensitizers include sulfur sensitizers such as allyl thiocarbamides, thioureas, thiosulfates, thioethers and cistines; precious metal sensitizers such as potassium chloroaurate, aurous thiosulfate and potassium chloropalladate; and reducing sensitizers such as tin chloride, phenyl hydrazine and redactone.

The silver halide emulsion of this invention is spectrally sensitized by a known spectrally sensitizing dye as required. By way of spectrally sensitizing dyes which may be used, it is possible to make use of the cyanine, merocyanine, rhodacyanine, styryl, hemicyanine, oxonol, benzylidene and holopolar sensitizing dyes described in "Heterocyclic Compounds—The Cyanine Dyes and Related Compounds" by F. M. Hamer (John Wiley & Sons, 1964) and in "Heterocyclic Compound—Special Topics in Heterocyclic Chemistry" by D. M. Sturmer (John Wiley & Sons, 1977), and cyanine and merocyanine sensitizing dyes are particularly preferred.

Examples of sensitizing dyes which can preferably be used in this invention include the cyanine dyes and merocyanine dyes and the like represented by the general formulae described in, for example, JP-A-60-133442, JP-A-61-75339, JP-A-62-6251, JP-A-59-212827, JP-A-50-122928 and JP-A-59-1801553. More preferable examples include sensitizing dyes which spectrally sensitize silver halides in the blue region, green region, red region or infrared region of the spectrum as described on, for example, pages 8 to 11 of JP-A-60-133442, pages 5 to 7 and 24 to 5 of JP-A-61-75339, pages 10 to 15 of JP-A-62-6251, pages 5 to 7 of JP-A-59-212827, pages 7 to 9 of JP-A-50-122928, and pages 7 to 18 of JP-A-59-180553.

These sensitizing dyes may be used alone or in combination, combinations of sensitizing dyes often being used for stronger sensitization in particular. Dyes which do not themselves have spectrally sensitizing action and substances exhibiting a supersensitizing effect, being substances which essentially do not absorb visible light, may be included in the emulsion together with the sensitizing dyes. For example, it is possible to include substituted aminostilbene compounds (for example those described in U.S. Pat. Nos. 2,933,390 and 3,635,721), aromatic organic acid formaldehyde condensates (for example those described in U.S. Pat. No. 3,743,510), cadmium salts and azaindene compounds which are nitrogen-containing heterocyclic ring nuclei. The combinations described in U.S. Pat. Nos. 3,615,613, 3,615,641, 3,617,295 and 3,635,721 are particularly effective.

The above sensitizing dyes are included in the silver halide photographic emulsion in a proportion of $5\times10^{-7}$ mole to $5\times10^{-2}$ mole, preferably $1\times10^{-6}$ mole to $1\times10^{-3}$ mole and particularly preferably $2\times10^{-6}$ mole to $5\times10^{-4}$ mole per mole of silver halide.

The above sensitizing dyes can be directly dispersed into the emulsion layer. Furthermore, these may be first dissolved in a suitable solvent such as methyl alcohol, ethyl alcohol, methyl cellosolve acetone, water, pyridine or a mixed solvent thereof and added to the emulsion in the form of a solution. Further, ultrasonic waves can be used to make the solution. Further, as the method of addition of the above sensitizing dyes, it is possible to use the method in which the dye is dissolved in a volatile organic solvent, the resulting solution is dispersed in a hydrophilic colloid and this dispersion is added to the emulsion as described in U.S. Pat. No. 3,469,987; the method in which a water-insoluble dye is dispersed in a water-soluble solvent without being dissolved and this dispersion is added to the emulsion as described in JP-B-46-24185; the method in which a water-insoluble dye is mechanincally crushed and dispersed in a water-based solvent and this dispersion is added to the emulsion as described in JP-B-61-45217; the method in which the dye is dissolved in a surfactant and the resulting solution is added to the emulsion as described in U.S. Pat. No. 3,822,135; the method in which it is dissolved using a red-shifting compound and the resulting solution is added to the emulsion as described in JP-A-51-74624; and the method in which the dye is dissolved in an acid containing virtually no water and the resulting solution is added to he emulsion as described in JP-A-50-80826. In addition, the methods described in, for example, U.S. Pat. Nos. 2,912,343, 3,342,605, 2,996,287 and 3,429,835 can also be used for the addition to the emulsion. Further, the above sensitizing dyes may be dispersed uniformly in the silver halide emulsion before it is coated onto an appropriate support, and needless to say they can also be dispersed in any stage in the preparation of the silver halide emulsion.

Other sensitizing dyes can be used in combination with the above sensitizing dyes. For example, it is possible to use the sensitizing dyes described in, for example, U.S. Pat. Nos. 3,703,377, 2,688,545, 3,397,060, 3,615,635 and 3,628,964, G.B. Patents 1,242,588 and 1,293,862, JP-B-43-4936, JP-B-44-14030 and JP-B-43-10773, U.S. Patent 3,416,927, JP-B-43-4930, and U.S. Pat. Nos. 2,615,613, 3,615,632, 3,617,295 and 3,635,721.

In order to rapidly process the silver halide photographic material, it is preferable to keep the percentage swelling of the silver halide photographic material at 200% or less.

It is preferable that the percentage swelling is no lower than required since if it is too low there is a reduction in the rapidity of development, fixing, washing and the like.

The preferred percentage swelling is between 200% and 30% and particularly preferably between 150% and 50%.

A person skilled in the art can easily control the percentage swelling to 200% or less, for example by increasing the amount of film hardener which is used in the photographic material.

The percentage swelling can be determined by (a) incubating the photographic material for three days at 38° C., 50% RH, (b) measuring the thickness of the hydrophilic colloid layer, (c) immersing the said photographic material in distilled water at 21° C., and (d) comparing the thickness of the hydrophilic colloid layer with that measured in stage (b).

Known film hardeners which can be used in this invention include aldehyde compounds, compounds having active halogens as described in U.S. Pat. No. 3,288,775, compounds having a reactive ethylenically unsaturated group as described in U.S. Pat. No. 3,635,718, epoxy compounds as described in U.S. Pat. No. 3,091,537, halogenocarboxaldehydes such as mucochloric acid and other such organic compounds. Of these, vinyl sulfone-based film hardeners are preferred. Moreover, macromolecular film hardeners are also preferred.

Polymers having an active vinyl group or a group constituting a precursor thereof are preferred as macromolecular film hardeners, and of these particular preference is given to polymers of the kind in which the active vinyl group or the group constituting a precursor thereof is joined to the main polymer chain via a long spacer as described in JP-A-56-142524. The amount of these film hardeners which is added to achieve the percentage swelling discussed above will vary in accordance with the type of film hardener and the type of gelatin used.

Hydrophilic colloids used for the emulsion layers and/or other hydrophilic colloid layers of the present invention include gelatin, polyacrylamide, polyvinylalcohol, polyvinylpyrroridone, dexstran, saccharose, and pullulan.

The coated amount of the hydrophilic colloid is generally from 0.1 g/m$^2$ to 100 g/m$^2$.

When the silver halide photographic material of this invention is processed rapidly, it is preferable to include an organic substance of a type which flows out in the development processing stage from the emulsion layers and/or other hydrophilic colloid layers. When the substance which flows out is gelatin, preference is given to the type of gelatin which is unaffected by the gelatin crosslinking reaction of the film hardener, acetylated gelatin and phthalated gelatin and the like corresponding to this definition for example, and it is preferable to have a gelatin with a low molecular weight. Moreover, in addition to gelatin, hydrophilic polymers such as a polyacrylamide as described in U.S. Pat. No. 3,271,158 or polyvinyl alcohol or polyvinylpyrrolidone and the like can be used to advantage as macromolecular substances, and dextran and sucrose, pullulan and other such sugars are also advantageous. Of these, polyacrylamide and dextran are preferred, and polyacrylamide is a particularly preferred substance. The average molecular weight of these substances is preferably 20,000 or less and more preferably 10,000 or less. In addition, it is also possible to use stabilizers and antifoggants as described in Research Disclosure Vol. 176, No. 17643, Section VI (December 1978).

The silver halide photographic materials of this invention can be put to use as silver halide photographic materials capable of providing the photographic characteristics of high speed and ultrahigh contrast by the use of a hydrazine derivative as described in, for example, U.S. Pat. Nos. 4,224,401, 4,168,977, 4,166,742, 4,311,781, 4,272,606, 4,221,857 and 4,243,739.

Further, this invention can also be used for silver halide color photographic materials. Its use for silver halide color photographic materials is discussed in detail below.

In this invention, the first stage in the processing of a color photographic material designates the processing stage which is carried out first of all, and this normally corresponds to color development in the processing of color negative films.

When the so-called wet processing time, which is the time taken from when the photographic material is immersed in the processing solution of the first stage until it leaves the processing solution of the final stage, is 6 minutes or less, this invention has a good effect, and the effect is more pronounced when this is reduced to 5 minutes 30 seconds or less, which is therefore preferred, 5 minutes or less being even more preferred.

It may be said that, with a wet processing time of 6 minutes or less, it is preferable that the fixing or bleach-fixing time be 2 minutes or less and, when this is reduced to 1 minute 30 seconds or less this is even more preferred from the standpoint of the clarity of the effect. Further, this invention is appropriately used when the total replenishment amount for each of the processing solutions is 2,500 ml or less per 1 m$^2$ of color photographic material, and, in particular, preference is given to 2,000 ml or less, 1,800 ml or less being even more preferred.

Because the effects of the invention become more pronounced, preference is given to the case in which the replenishment amount for the fixing solution or bleach-fixing solution is 1,200 ml or less, and further preference is given to the case in which it is reduced to 800 ml or less and particular preference to the case in which it is reduced to 600 ml or less.

Further, the case in which the replenishment amount for the color developing solution is 700 ml or less is preferred and the case in which it is 500 ml or less is particularly preferred. Additionally, the case in which the replenishment amount for the bleaching solution is 600 ml or less is preferred and the case in which it is 300 ml or less is further preferred.

Further, when this invention is applied to color photographic materials, the effects are pronounced with color photographic materials for picture taking which make use of silver iodobromide emulsions; in particular, even more outstanding effects are exhibited in color photographic materials in which the total thickness of all the photographic structural layers excluding the support is 20 μ or less and the film-swelling rate T½ for the binder for the photographic emulsion layers is 10 seconds or less, further preference being given to the case in which he thickness of all the photographic structural layers is 18 μ or less and the film-swelling rate $T_{\frac{1}{2}}$ is 8 seconds or less.

"Photographic structural layers" refers to all the hydrophilic colloid layers contributing to image formation on the same side of the support as that having the silver halide emulsion layers and includes, for example, antihalation layers (black colloidal silver antihalation layers and the like), underlayers, intermediate layers (simple intermediate layers or filter layers, ultraviolet absorbing layers and the like), protective layers and the like as well as the silver halide emulsion layers.

The thickness of the photographic structural layers is the total thickness of the above hydrophilic colloid layers and may be measured with a micrometer.

The film swelling rate $T_{\frac{1}{2}}$ of the binder for the silver emulsion layers in the silver halide color photographic material of this invention is 25 seconds or less. This is to say, gelatin is normally used for the hydrophilic binder employed in the coating of the silver halides of the silver halide color photographic material, material, although there are cases in which macromolecular polymers are also used, and, in this invention, the film swelling rate $T_{\frac{1}{2}}$ of the binder must be 25 seconds or less. The swelling rate $T_{\frac{1}{2}}$ of the binder can be measured following any desired technique in the field of the art; for example, it can be measured using the swellometer of the type described on pages 124 to 129 of "Photographic Science and Engineering" by A. Green, Vol. 19, No. 2, and $T_{\frac{1}{2}}$ is defined as the time taken to reach half the saturated film thickness which is taken to be 90% of the maximum swollen film thickness which is achieved upon processing in a color developing solution at 30° C. for 3 minutes and 15 seconds. Thus, the film swelling rate is taken to be $T_{\frac{1}{2}}$, the time taken to reach half the film thickness when the swollen film thickness is saturated.

The film swelling rate $T_{\frac{1}{2}}$ can be adjusted by adding a film hardener to the gelatin acting as the binder.

By way of film hardeners, it is possible to use, either singly or in combination, film hardeners of the aldehyde type, azylidine type (for example those described in PB Report 19,921, U.S. Pat. Nos. 2,950,197, 2,964,404, 2,983,611, and 3,271,175, JP-B-46-40898 and JP-A-50-91315), isoxazolium type (for example those described in U.S. Pat. No. 3,321,323), epoxy type (for example those described in U.S. Pat. No. 3,047,394, West German Patent 1.008,663, G.B. Patent 1,033,518 and JP-B-48-35495), vinylsulfone type (for example those described in PB Report 19,920, West German Patents 1,100,942, 2,337,412, 2,545, 722, 2,635,518, 2,742,308, 2,749,260, G.B. Patent 1,251,091 and U.S. Pat. Nos. 3,539,644 and 3,490,911), acryloyl type (for example those described in U.S. Pat. No. 3,640,720), carbodiimide type (for example those described in U.S. Pat. Nos. 2,938,892, 4,043,818, 4,061,499 and JP-B-46-38715), triazine type (for example those described in West German Patents 2,410,973, 2,553,915, U.S. Pat. No. 3,325,287 and JP-A-52-12722), macromolecular type (for example those described in G.B. Patent 822,061, U.S. Pat. Nos. 3,623,878, 3,396,029, 3,226,234, JP-B-47-18578, JP-B-47-18579 and JP-B-47-48896), in addition to film hardeners of the maleimide type, acetylene type, metasulfonic acid ester type and N-metolol type. By way of useful combining techniques, it is possible to mention the combinations described in, for example, West German Patents 2,447,587, 2,505,746, 2,514,245, U.S. Pat. Nos. 4,047,957, 3,832,181, 3,840,370, JP-A-48-43319, JP-A-50-63062, JP-A-52-127329 and JP-B-48-32364.

Processing stage which can be used with this invention are now given.

1 Color development - bleach fixing - washing
2. Color development - bleaching - fixing - washing - stabilization
3. Color development - bleaching - bleach fixing -washing - stabilization
4. Color development bleach fixing stabilization
5. Color development bleaching fixing stabilization
6. Color development - bleaching - bleach fixing -stabilization
7. Color development -fixing bleach fixing washing - stabilization
8. Color development -fixing bleach fixing stabilization
9. Black-and-white development - washing - color development - reversal - conditioning bleaching - fixing - washing - stabilization Details of the processing solutions are given below.

The principal color developing agents used in the color developing solution and color development replenishing solution are primary aromatic amine compounds including known compounds which are widely used in various color photographic processes. However, in this invention the preferred color developing agents are (1) 4-(N-ethyl-N-β-hydroxyethylamino)-2-methylaniline sulfate
(2) 4-(N-ethyl-N-β-methanesulfonamidoethylamino)-2-methylaniline sulfate
(3) 4-(N-ethyl-N-β-methoxyethylamino)-2-methylaniline-p-toluenesulfonate
(4) 4-(N,N-diethylamino)-2-methylaniline hydrochloride
(5) 4-(N-ethyl-N-dodecylamino)-2-methylaniline sulfate
(6) N,N-diethyl-p-phenylenediamine hydrochloride and other such N,N-dialkyl-p-phenylenediamine-based color developing agents. These compounds are added to the color developing solution in the range 0.005 to 0.05 mol/l, more preferably in the range 0.01 to 0.04 mol/l, and particularly preferably in the range 0.015 to 0.03 mole/l. Further, they are preferably added to the color development replenishing solution so as to yield an even higher concentration than the concentrations given above. More specifically, the exact magnitude of the concentration varies depending upon the amount of replenishment selected, but in general they are added within a range 1.05 to 2.0 times greater, or more often 1.2 to 1.8 times greater than the color developing solution (parent solution).

The above color developing agents may be used alone, but they may also be used in combination depending on the intended result. Examples of preferred combinations include (1) and (2), (1) and (3) as well as (2) and (3) in the above color developing agents.

In this invention, the bromide ion concentration in the color developing solution is preferably within the range 0.005 to 0.02 mol/l, for which purpose it is preferable to keep the bromine compound content of the replenishment solution at no more than 0.005 mole/l. Generally, the bromine compound content of the replenishment solution ought to be lowered as the replenishment amount is reduced, and in this invention in particular it is preferable that the replenishment solution contains no bromine compounds since it provides for a great reduction in the replenishment amount.

Moreover, the above bromine compounds include potassium bromide, sodium bromide, lithium bromide and hydrobromic acid.

Preservatives, notably hydroxylamine, diethylhydroxylamine and triethanolamine, and the compounds described in West German Patent (OLS) 2,622,950, the hydrazines described in JP-A-63-146041, sulfites and hydrogen sulfites may be used in the color developing solution and the color development replenishing solution.

Further, various chelating agents are added for the purposes of water softening and metal sequestering, and in this invention it is particularly preferable to include at least one type of compound represented by the following general formulae (A) and/or (B).

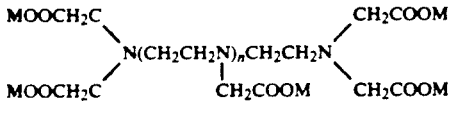
(A)

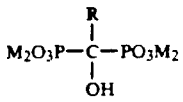
(B)

In the formulae, n represents 1 or 2, R represents a lower alkyl group, M may be identical or different and represents a hydrogen atom, alkali metal atom or ammonium. R is particularly preferably a methyl group or an ethyl group, and M is preferably a hydrogen atom or a sodium atom.

Actual examples of compounds represented by general formulae (A) and (B) are given below.

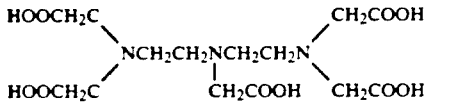
(A-1)

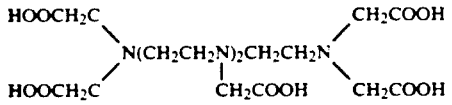
(A-2)

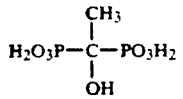
(B-1)

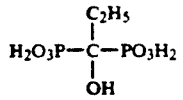
(B-2)

In addition to the above compounds, in he color developing solution used in this invention it is possible to use, either singly or in combination, pH buffers such as alkali metal carbonates, borates or phosphates; antifoggants or development inhibitors such as iodine compounds, benzimidazoles, benzothiazoles and mercapto compounds; organic solvents such as diethylene glycol; development accelerators such as benzyl alcohol, polyethylene glycol, quaternary ammonium, amines and thiocyanates; nucleating agents such as sodium borohydride; auxiliary developers such as 1-phenyl-3-pyrazolidone; viscosity enhancers; and various chelating agents, such as ethylenediaminetetraacetic acid, nitrilotriacetic acid, cyclohexanediaminetetraacetic acid, iminodiacetic acid hydroxyethyliminodiacetic acid and the organic phosphonates described in Research Disclosure 18170 (May 1979) in addition to the compounds represented by general formulae (A) and (B).

In this invention, the pH value of the color developing solution and its replenishment solution is normally 9 or more, is preferably 9.5 to 12, and is particularly preferably 9.5 to 11.0. In the above ranges, it is preferable to set the replenishment solution pH at a value which is higher than the color developing solution by about 0.05 to 0.5.

Further, the temperature in the color development processing is 30° to 45° C. and is preferably at a high temperature in order to achieve a greater degree of low-replenishment processing, and the development processing is preferably carried out at 35° C. to 45° C., and particularly preferably at 38° to 42° C. in this invention.

This invention can be employed with both automatic developing apparatuses and in manual processing, but it is preferably employed with automatic developing apparatuses. When processing with an automatic developing apparatus, there may be one or a plurality of color development solution tanks, and lower replenishment can be achieved by the use of a multi-stage sequential current replenishment system in which a plurality of tanks are employed and sequential flow into the subsequent tanks is achieved by replenishing a first tank. Furthermore it is preferable to keep the area of contact between the air and the developing solution within the tank(s) as limited as possible, and, more specifically, the effects of the invention are further improved by the use of a shielding means such as a floating lid, a seal using a high-boiling liquid with a lower relative density than the developing solution, or a constricted tank structure at the opening as described in JP-A-63-216050.

Moreover, in order to compensate for concentration by evaporation in the developing solution, it is preferable to replenish water in an amount corresponding to the evaporated amount as a means of improving the effects of this invention. The replenished water is preferably deionized water which has undergone an ion-exchange treatment or deionized water which has undergone a treatment such as reverse osmosis or distillation.

The color developing solution and color development replenishing solution are prepared by progressively adding and dissolving the above chemicals in a fixed amount of water, and it is preferable to use the deionized water described above as the water for the preparation.

In this invention the photographic material is processed in a bleaching solution or bleach-fixing solution after color development. The bleaching agents are generally complex salts of chelating agents such as an aminocarboxylic acid, polycarboxylic acid, aminopolycarboxylic acid and ferric ions. Examples of preferred chelating agents which are used as complex salts with ferric ions include (1) ethylenedimainetetraacetic acid
(2) diethylenetriaminepentaacetic acid
(3) cyclohexanediaminetetraacetic acid
(4) 1,3-diaminopropanetetraacetic acid
(5) nitrilotriacetic acid
(6) iminodiacetic acid
(7) glycol ether-diaminetetraacetic acid, and (1), (2), (3) and (4) are particularly preferred from the standpoint of the final performance and the rapidity of bleaching.

The ferric ion complexes may be used in the form of complex salts or they may be used by forming ferric ion complexes in solution using chelating agents such as an aminopolycarboxylic acid, aminopolyphosphonic acid and phosphonocarboxylic acid with ferric sulfate, ferric chloride, ferric nitrate, ferric ammonium sulfate, ferric phosphate and the like. When used in the form of a complex salt one type of complex salt may be used or two or more types of complex salt may be used. In such cases, the combined use of the chelating agents of (1) and (4) is particularly preferred. Furthermore, when forming a complex salt in solution by the use of a chelating agent and ferric salt, one or two or more types of ferric salt may be used. Moreover one or two or more types of chelating agent may be used. In addition, in all these cases, the chelating agent may b used in excess of the amount needed to form the ferric ion complex. An aminopolycarboxylic acid iron complex is preferred amongst the iron complexes, and the addition amount for this is 0.1 to 1 mol/l and preferably 0.2 to 0.4 mole/l in the bleaching solution for a color photographic material for picture taking such as a color negative film, and is 0.05 to 0.5 mole/l and preferably 0.1 to 0.3 mole/l in the bleach-fixing solution for this type of material. Further, with the bleaching solutions or bleach-fixing solutions for a color photographic material for prints such as a color paper, the addition amount is 0.03 to 0.3 mole/l and preferably 0.05 to 0.2 mole/l.

Further, bleach accelerators cab be used in the bleaching solution and bleach-fixing solution as required. By way of actual examples of useful bleach accelerators, compounds having a mercapto group or disulfide group are preferred in that they have a large accelerating effect, and the compounds described in U.S. Pat. No. 3,893,858, West German Patent 1,290,812 and JP-A-53-95630 are preferred.

In addition, the bleaching solution or bleach-fixing solution of this invention can contain rehalogenating agents such as bromine compounds (for example potassium bromide, sodium bromide and ammonium bromide), chlorine compounds (for example potassium chloride, sodium chloride and ammonium chloride) or iodine compounds (for example ammonium iodide). If required, it is possible to add corrosion preventers such as one or more type of inorganic acid or organic acid with a pH buffering capacity such as boric acid, borax, sodium metaborate, acetic acid, sodium acetate, sodium carbonate, potassium carbonate, phosphorus aid, phosphoric acid, sodium phosphate, citric acid, sodium citrate and tartaric acid and the alkali metal or ammonium salts hereof, ammonium nitrate, guanidine and the like.

Moreover, the above bleaching solution is normally used in a pH range of 3 to 7, preferably of 3.5 to 6.5 and particularly preferably of 4.0 to 6.0. Furthermore, for the bleach-fixing solution, the pH is 4 to 9, preferably 5 to 8 and particularly preferably 5.5 to 7.5. When the pH is above this range, bleaching imperfections are liable to occur, and, when it is below this range, color imperfections are liable to occur in the cyan dye.

The fixers used in the fixing solution used after the processing with the bleach-fixing solution or bleaching solution of this invention are known fixers, which is to say they are water-soluble silver halide solvents such as thiosulfates such as sodium thiosulfate and ammonium thiosulfate; thiocyanates such as sodium thiocyanate and ammonium thiocyanate; and thioureas and thioether compounds such as ethylenebisthioglycolic acid and 3,6-dithia-1,8-ocatanediol, and these can be used either singly or as mixtures of two or more. Furthermore, it is also possible to use, for example, special bleach-fixing solutions consisting of a combination of a fixer and a large amount of a halogen compound such as potassium iodide as described in JP-A-51-155354. In this invention, the use of a thiosulfate, and in particular ammonium thiosulfate, is preferred.

The amount of fixer in 1 liter is preferably 0.5 to 3 moles, and more particularly it is in the range of 1 to 2 moles for the processing of color photographic materials for picture taking, and is within the range of 0.5 to 1 mole for the processing of color photographic materials for prints.

The pH range for the fixing solution in this invention is preferably 4 to 9 and particularly preferably 5 to 8. The deterioration of the solution is marked when it is below this, and conversely staining is liable to occur due to the volatilization of ammonia from the ammonium salt contained in the solution when the pH is higher than this.

When adjusting the pH, it is possible to add hydrochloric acid, sulfuric acid, nitric acid, acetic acid, bicarbonates, ammonia, caustic potash, caustic soda, sodium carbonate, potassium carbonate and the like as required.

The bleach-fixing solutions and fixing solutions used in this invention contain, as preservatives, sulfites (such as sodium sulfite, potassium sulfite and ammonium sulfite), bisulfites (such as ammonium bisulfite, sodium bisulfite and potassium bisulfite), metabisulfites (such as potassium metabisulfite, sodium metabisulfite and ammonium metabisulfite) and other such sulfite-ion-releasing compounds, benzenesulfinic acid, paratoluenesulfinic acid and other such aromatic sulfinic acids and he salts thereof. These compounds are preferably included at about 0.02 to 0.50 mole/l and more preferably at 0.04 to 0.40 mole/l.

Sulfites are generally added as preservatives but ascorbic acid and carbonyl bisulfite adducts or carbonyl compounds and the like may also be added.

Moreover, buffers, fluorescent brighteners, chelating agents, antifungal agents and the like may also be added as required.

Washing, stabilization and other such processing stages are generally undertaken after the fixing stage or bleach-fixing stage, but it is also possible to use simplified processing methods such as where washing alone is undertaken or, conversely, where a stabilization processing stage alone is undertaken essentially without a washing stage.

The washing stage removes processing solution constituents which have stuck to or been absorbed into the color photographic material and the unwanted constituents in the color photographic material and so has the effect of preserving the image stability and good film properties after processing. On the other hand, the stabilization stage is a stage in which the image-storage properties are improved to a level which cannot be attained by washing.

There are cases in which the washing stage involves a single tank, but more often it involves a multi-stage countercurrent washing system with two or more tanks. The amount of water in the washing stage can be set arbitrarily in accordance with the type of color photographic material and the intended results, and it can be calculated, for example, using the method described in "The Journal of Motion Picture and Television Engineering", Vol. 64, pages 248 to 253 (May 1955), "Water Flow Rates in Immersion-Washing of Motion Picture Film" by S. R. Goldwasser.

Bacterial and fungal propagation will prove to be a problem when economizing on the amount of washing water, and it is preferable to use washing water in which the calcium and magnesium levels have been reduced as described in JP-A-62-288838 as a countermeasure to this. In addition, it is also possible to add bactericides and antifungal agents (such as the compounds described on pages 207 to 223 of "The Journal of Antibacterial and Antifungal Agents" Vol. 11, No. 5 and in "Sakkin Bobai no Kagaku" (Bactericidal and Antifungal Chemistry) by H. Horiguchi. Furthermore, it is also possible to add chelating agents such as ethylenediaminetetraacetic acid and diethylenetriaminepentaacetic acid as water softeners.

A water amount of 100 ml to 1500 ml per 1 $m^2$ of color photographic material is normally used when economizing on the amount of washing water, and the range of 200 ml to 800 ml is particularly preferred in that this brings out the twin advantages of the color image stability and the water-saving effect.

The pH in the washing stage is normally within the range 5 to 9. In addition, various compounds are added to the stabilizing bath in order to stabilize the image. For example, it is possible to add various buffering agents to adjust the film pH after processing (for example, the combined use of borates, metaborates, borax, phosphates, carbonates, potassium hydroxide, sodium hydroxide, aqueous ammonia, monocarboxylic acids, dicarboxylic acids, and polycarboxylic acids), and, in the same way as they can be added to the washing water, chelating agents, bactericides, formalin and formalin-releasing compounds such as hexamethylenetetramine as well as fluorescent brighteners according to the application, and it is also possible to add various ammonium salts such as ammonium chloride, ammonium sulfite, ammonium sulfate and ammonium thiosulfate.

The pH of the stabilizing bath is normally 3 to 8, but there are also cases in which a low pH range of 3 to 5 is particularly preferred due to variations in the type of sensitive material and its intended use.

This invention can be applied to the processing of various color photographic materials. Representative examples include color negative films for general use and cinema, color reversal films for slides and television and the like.

The production of the silver halide color photographic material in the present invention can be also carried out as described above.

Various color couplers can be used in this invention and specific examples of these are described in the patents described in the previously cited Research Disclosure (RD) No. 17643, VII - C to G. Couplers which provide the three subtractive primary colors (namely yellow, magenta and cyan) during color development are the most important of the color couplers, and the following couplers and the couplers described in the patents described in the previously cited RD 17643, VII C and D can be used for preference in this invention as specific examples of diffusion-resistant 4-equivalent and 2-equivalent couplers.

Known yellow couplers of the oxygen atom leaving type or known yellow couplers of the nitrogen atom leaving type are representative examples of yellow couplers which can be used. α-Pivaloylacetoanilide-based couplers are outstanding in the fastness, particularly the light-fastness of the color-forming dye, while u-benzoylacetoanilide-based couplers provide a high color density.

Hydrophobic 5-pyrazolone-based and pyrazoloazole-based couplers with ballast groups can be mentioned as magenta couplers which can be used in this invention. With 5-pyrazolone-based couplers, couplers in which the 3-position has been substituted with an arylamino group or an acylamino group are preferred from the standpoint of the hue and color density of the color forming dye.

Cyan couplers which can be used in this invention include hydrophobic, diffusion-resistant nephtholic and phenolic couplers, typical examples including, for preference, 2-equivalent naphtholic couplers of the oxygen atom leaving type. Further, couplers able to form a cyan dye which is fast to both humidity and temperature are used for preference, typical examples of these including, as described in U.S. Pat. No. 3,772,002, phenolic cyan couplers having an ethyl or higher alkyl group in the meta position of the phenol nucleus, 2,5-diacylamino-substituted phenolic couplers, phenolic couplers having a phenylureido group in the 2-position and a cyalamino group in the 5-position or, as described in European Patent 161,626 A, 5-aminonaphtholic cyan couplers and the like.

The graininess can be improved by the conjoint use of a coupler in which the color forming dye has a suitable degree of diffusibility. With respect to such couplers, actual examples of magenta couplers are described in, for example, U.S. Pat. No. 4,366,237, and actual examples of yellow, magenta and cyan couplers are described in, for example, European Patent 96,570.

Dye forming couplers and the special couplers mentioned above may form dimers and higher polymers. Typical examples of polymerized dye forming couplers are described in, for example, U.S. Pat. No. 3,451,820. Specific examples of polymerized magenta couplers are described in, for example, U.S. Pat. No. 4,367,282.

Couplers which release a photographically useful group upon coupling can also be used for preference in this invention. The couplers in the patents contained in the previously cited RD 17643, section VII - F are useful as DIR couplers which release development inhibitors.

Couplers which release nucleating agents in the form of the image or development accelerators or precursors thereof during development can be used in the photographic materials of this invention. Actual examples of such compounds are described in G.B. Patents 2,097,140 and 2,131,188. In addition, it is also possible to use the couplers which release DIR redox compounds as described in JP-A-60-185950, couplers which release color-restoring dyes after dissociation as described in European Patent 173,302 A and the like.

The couplers used in this invention can be introduced into the photographic material by various known dispersion methods. Examples of high-boiling organic solvents used in the oil-in-water dispersion method are described in, for example, U.S. Pat. No. 2,322,027. Further, actual examples of the processes, effects and impregnation latexes used in the latex dispersion method are described in, for example, U.S. Pat. No. 4,199,363, West German Patent Applications (OLS) 2,541,274 and 2,541,230.

Actual examples of this invention are given below, but he invention is not limited to these.

EXAMPLE 1

Preparation of an Emulsion

The double jet method was used for 1 minute, with stirring, to add an aqueous solution of silver nitrate (5 g as silver nitrate) and an aqueous solution of potassium bromide containing 0.15 g of potassium iodide to a vessel in which 30 g of gelatin and 6 g of potassium bromide had been added to 1 l of water and which was maintained at 60° C. In addition, the double jet method was used to add an aqueous solution solution of silver nitrate (145 g as silver nitrate) and an aqueous solution of potassium bromide containing 4.2 g of potassium iodide. At this time, the addition flow rate was accelerated so that the flow rate at the end of addition was 5 times that at the start of addition. After the end of the addition, the soluble salts were removed by precipitation at 35° C. and then the temperature was raised to 40° C., 75 g of gelatin were added and the pH was adjusted to 6.7. The resulting emulsion comprised tabular grains with a projected surface area diameter of 0.98 μm and an average thickness of 0.138 μm and had a silver iodide content of 3 mol %. The emulsion was chemically sensitized by conjoint use of gold and sulfur sensitization.

Preparation of Photographic Material 101

Use was made of an aqueous gelatin solution containing a film hardener and a $10^{-3}$ mole methanol solution of a compound of this invention (refer to Table 1) in an amount of 200 ml per 1 mole of Ag in the emulsion layer, polyacrylamide with an average molecular weight of 8,000 poly(sodium sulfonate), poly(methyl methacrylate) particles (average particle size 3.0 μm), poly(ethylene oxide) as well as gelatin acting as the surface protective layer.

By way of a sensitizing dye, anhydro-5,5'-dichloro-9-ethyl-3,3'-di(3-sulfopropyl)oxacarbocyanine hydroxide, sodium salt was added to the above emulsion in a ratio of 500 ml/1 mole of Ag and potassium iodide was added in a ratio of 200 mg/1 mole of Ag. Furthermore, a photographic material was produced by preparing a coating solution by adding 4-hydroxy-6-methyl-1,3,3*a*,7-tetraazaindene and 2,6-bis(hydroxyamino)-4-diethylamino-1,3,5-triazine and nitron as stabilizers, trimethylol propane as a dry antifoggant and adding auxiliary coating agents and film hardeners, coating this onto both sides of a polyethylene terephthalate support simultaneously with the respective surface protective layers and drying. The coated silver amount in this photographic material was 2 g/m$^2$ on each side.

Preparation of a Development Processing Kit

A development processing kit consisting of the following part (A), part (B) and part (C) (a concentrated solution) was prepared.

| Part (A) Developing solution (solution used) for 10 l | |
|---|---|
| Potassium hydroxide | 291 g |
| Potassium sulfite | 442 g |
| Sodium hydrogen carbonate | 75 g |
| Boric acid | 10 g |
| Diethylene glycol | 120 g |
| Ethylenediaminetetraacetic acid | 17 g |
| 5-Methylbenzotriazole | 0.6 g |
| Hydroquinone | 300 g |
| 1-Phenyl-4,4-dimethyl-3-pyrazolidone | 20 g |
| Water added to | 2.5 l |
| pH adjusted to 11.0. | |

-continued

| Part (B) Developing solution (solution used) for 10 l | |
|---|---|
| Triethylene glycol | 20 g |
| 5-Nitroindazole | 2.5 g |
| Glacial acetic acid | 3 g |
| 1-Phenyl-3-pyrazolidone | 15 g |
| Water added to | 250 ml |

| Part (C) Developing solution (solution used) for 10 l | |
|---|---|
| Glutaraldehyde | 99 g |
| Sodium metabisulfate | 126 g |
| Water added to | 250 ml |

In addition to which a starter of the following composition was prepared.

| Starter | |
|---|---|
| Glacial acetic acid | 270 g |
| Potassium bromide | 300 g |
| Water added to | 1.5 l |

Preparation of a Developing Solution 2.5 l part (A), 250 ml of part (B) and 250 ml of part (C) were dissolved by being added sequentially to about 6 l of water while stirring and the overall amount was finally set at 10 l using water.

Following this, the starter was added in a proportion of 20 ml per liter of solution used.

Fuji F (made by the Fuji Photo Film Co. Ltd.) was used in the fixing.

Water containing 0.5 g/l of disodium ethylenediamine-tetraacetate dihydrate (antifungal aent) was used in the washing.

Following this, development processing as noted below was carried out using an automatic developing system of the roller-conveyor type.

| Processing stage | Temperature | Processing time |
|---|---|---|
| Development | 35° C. | 12.5 sec. |
| Fixing | 30° C. | 10 sec. |
| Washing and squeezing | 20° C. | 12.5 sec. |
| Drying | 50° C. | 12.5 sec. |

Table 1 shows the residual color after processing (the value obtained by measuring the transmitted optical density of the non-image portion using a green light).

TABLE 1

| Sample No. | Compound of this invention which was added | Residual color after processing |
|---|---|---|
| 1 | None | 0.210 |
| 2 | (1) | 0.140 |
| 3 | (3) | 0.139 |
| 4 | (5) | 0.139 |
| 5 | (8) | 0.143 |
| 6 | (14) | 0.141 |
| 7 | (16) | 0.139 |
| 8 | (19) | 0.137 |
| 9 | (20) | 0.136 |
| 10 | (21) | 0.138 |

EXAMPLE 2

A photographic material was prepared by the same method as that in Example 1 adding the same amounts of the various compounds of this invention to the emulsion, and this material was subjected to an X-ray exposure, and to development processing using the same developing bath, fixing bath and washing bath formulations as in Example 1.

For the residual color after processing, the transmitted optical density of the non-image portion was measured using green light and the results are given in Table 2.

It will be seen that the photographic materials to which a compound of this invention had been added were less in the residual color after processing.

TABLE 2

| Sample No. | Compound of this invention which was added | Residual color after processing |
|---|---|---|
| 1 | None | 0.210 |
| 2 | (1) | 0.138 |
| 3 | (3) | 0.138 |
| 4 | (5) | 0.139 |
| 5 | (8) | 0.141 |
| 6 | (14) | 0.140 |
| 7 | (16) | 0.138 |
| 8 | (19) | 0.137 |
| 9 | (20) | 0.136 |
| 10 | (21) | 0.138 |

EXAMPLE 3

Photographic materials 301 to 314 were prepared in the same way as in Example 1 using the various sensitizing dyes shown below as their sensitizing dyes, and were subjected to development processing in the same way as in Example 1 using an automatic developing apparatus.

TABLE 3

| Sample | Sensitizing dye (amount added mg/1 mol Ag) | Compound added to the photo sensitive material | (Residual color density when a compound of this invention was not used) - (residual color density when a compound of this invention was used) |
|---|---|---|---|
| 301 | A (500) | (2) | 0.068 |
| 302 | B (500) | (3) | 0.065 |
| 303 | C (400) | (3) | 0.065 |
| 304 | D (500) | (2) | 0.070 |
| 305 | E (500) | (3) | 0.069 |
| 306 | F (500) | (3) | 0.069 |
| 307 | G (500) | (5) | 0.068 |
| 308 | A (500) | (19) | 0.070 |
| 309 | B (500) | (20) | 0.067 |
| 310 | C (400) | (21) | 0.068 |
| 311 | D (500) | (16) | 0.070 |
| 312 | E (500) | (19) | 0.073 |
| 313 | F (500) | (20) | 0.075 |
| 314 | G (500) | (21) | 0.070 |

In all cases, there was less residual color when a photographic material containing a compound of this invention was processed.

Sensitizing dye

A

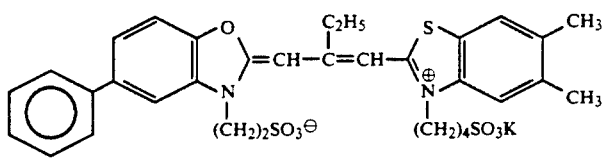

B

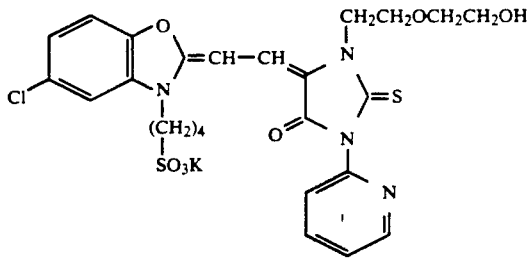

C

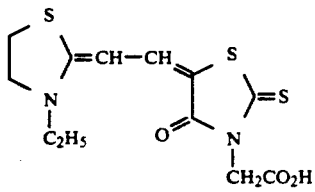

D

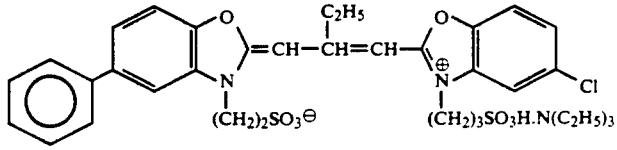

-continued

Sensitizing dye

E

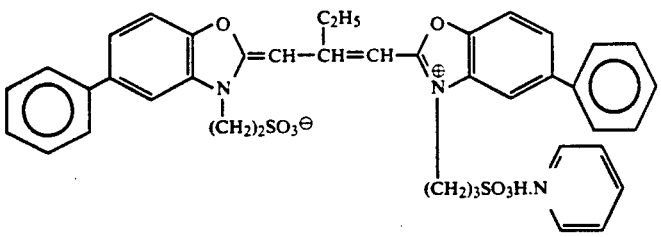

F

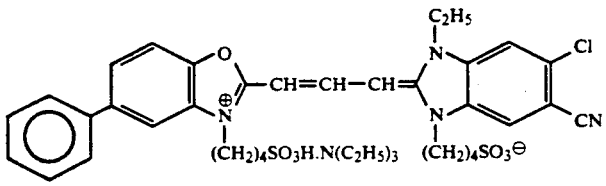

G

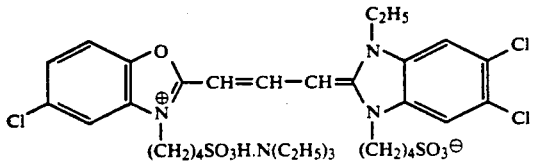

EXAMPLE 4

A 0.3 $\pi$ cubic silver iodobromide emulsion containing 2.5 mol % of iodine had added to it 230 mg/1 mole Ag of anhydro-5,5-dichloro-9-ethyl-3,3'-bis(3-sulfopropyl) oxacarbocyanine hydroxide, sodium salt (sensitizing dye), 1.3 g/1 mole Ag of a hydrazine derivative (the compound given below), and 300 mg/1 mole Ag of polyethylene glycol (molecular weight about 1,000), and also had added to it 200 ml/1 mole Ag of a $10^{-3}$ mole methanol solution of the compound (3) of this invention, sodium 2-hydroxy-1,3,5-triazine, a dispersion of polyethylene acrylate, 4-hydroxy-6-methyl-1,3,3*a*,7-tetrazaindene and 5-methylbenzotriazole. Furthermore, 1,3-divinylsulfonyl-2-propanol was added as a film hardener in an amount adjusted so that the percentage swelling was 120%.

A film was obtained by coating the coating solution prepared in this way onto a polyethylene terephthalate film support together with a protective layer such that the coated silver amount was 3.5 g/m$^2$ and the coated gelatin amount (in both the emulsion layers and protective layer) was 3.0 g/m$^2$.

Hydrazine derivative

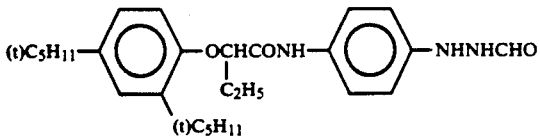

These films were subjected to exposures through a sensitometric optical wedge using a 150 line magenta contact screen and then developed for 15 seconds at 40° C. in a developing solution with the following composition, following which they were fixed using the fixing solution GR-Fl made by the Fuji Photo Co. Ltd., washed and dried.

The dry to dry time in the automatic developing apparatus used here was set at 65 seconds.

| (Developing solution composition) | |
|---|---|
| Sodium ethylenediamine tetraacetate | 1.0 g |
| Sodium hydroxide | 9.0 g |
| 5-Sulfosalicyclic acid | 44.0 g |
| Potassium sulfite | 100.0 g |
| 5-Methylbenzotriazole | 0.5 g |
| Potassium bromide | 6.0 g |
| N-Methyl-p-aminophenol hemisulfate | 0.4 g |
| Hydroquinone | 54.0 g |
| Sodium p-toluenesulfonate | 30.0 g |
| Water added to | 1 l |
| pH | 11.7 |

An identical aqueous solution to that used in Example 1 was used for the washing water and 250 ml of this was replenished per full size sheet (20 inch×24 inch).

When the residual color after processing was measured in the same way as in Example 1, the residual color density was less than in the photographic material in which a compound of this invention had not been used by 0.057.

EXAMPLE 5

A cubic monodisperse emulsion with an average grain size of 0.25 $\mu$ and an average silver iodide content of 1 mol % was prepared by simultaneously adding, over 60 minutes while maintaining the pAg at 7.8, an aqueous solution of a silver nitrate and an aqueous solution of potassium iodide and potassium bromide to an aqueous gelatin solution kept at 50° C., in the presence of $4\times10^{-7}$ mole per mole of silver of potassium hexachloroiridate(III). These silver iodobromide emulsions had added to them $5.6\times10^{-5}$ mole per mole of silver of the following compound as a sensitizing dye

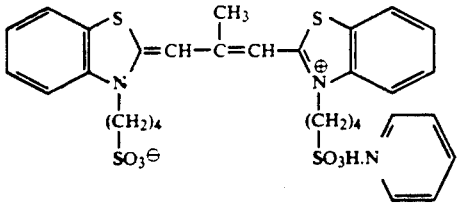

and had added to them, as stabilizers, 4-hydroxy-6-methyl-1,3,3a,7-tetrazaindene, a dispersion of polyethylene acrylate, polyethylene glycol, 1,3-vinylsulfonyl-2-propanol, 1-phenyl-5-mercaptotetrazole, 1,4-bis(3-(4-acetylaminopyridinio)propionyloxy)tetramethylene dibromide, the same hydrazine derivative as in Example 4 ($4.8\times10^{-3}$ mole per mole of silver) and an identical amount of the same compound of this invention as that in Example 4, the pH on the film surface was adjusted to 5.5 using ascorbic acid and coating was carried out to a silver amount of 3.4 g/m$^2$ on a polyethylene terephthalate film (moreover the measurement of the film surface pH was in accordance with the method described in JP-A-62-25745). At the same time, a gelatin layer was coated onto the emulsion layer to a coated gelatin amount of 1.0 g/m$^2$. The resulting samples were exposed and developed and the photographic characteristics were measured.

The developing solution formulation was as follows.

| Development solution formualtion | |
|---|---|
| Hydroquinone | 35.0 g |
| N-Methyl-p-aminophenol hemisulfate | 0.8 g |
| Sodium hydroxide | 13.0 g |
| Potassium triphosphate | 74.0 g |
| Potassium sulfite | 90.0 g |
| Tetrasodium ethylenediaminetetraacetate dihydrate | 1.0 g |
| Potassium bromide | 4.0 g |
| 5-Methylbenzotriazole | 0.6 g |
| 3-Diethylamino-1,2-propanediol | 15.0 g |
| Water | added to 1 l |
| (pH = 11.65) | |

The fixing solution formulation was as follows.

| | |
|---|---|
| Ammonium thiosulfate | 150.0 g |
| Sodium sulfite | 30.0 g |

-continued

| | | |
|---|---|---|
| Acetic acid | | 30.0 g |
| Water added to 1 l, pH = 5.00 using NaOH | | |
| Development | 40° C. | 15 sec. |
| Fixing | 37° C. | 16 sec. |
| Washing | | 12 sec. |
| Dry to dry | | 67 sec. |

Beneficially, there was less residual color in the photographic performance (the density $D_{max}$) in the above samples after processing (red density 0.037).

EXAMPLE 6

A monodisperse cubic silver iodobromide emulsion with an average grain size of 0.20 μm and containing 2.0 mol % of silver iodide was obtained using the double jet method while controlling conditions at 60° C., pAg 8.0 and pH=2.0. Part of this emulsion was used as a core which was grown in the following way. The double jet method was used to add an ammonia-containing solution of silver nitrate and a solution containing potassium iodide and potassium bromide to a solution containing the core grains and gelatin at 40° C, a pAg of 9.0 and a pH of 9.0, so forming a first covering layer containing 30 mol % of silver iodide. Then, the double jet method was used to add an ammonia-containing solution of silver nitrate and a potassium bromide solution again at a pAg of 9.0 and a pH of 9.0, so forming a second covering layer of pure silver bromide and completing the preparation of a cubic monodisperse silver iodobromide emulsion with an average grain size of 0.57 μm which was designated E-1. The average silver iodide content of this emulsion was 2.0 mol %.

The following sensitizing dyes A and B were added to E-1 in the following amounts, optimal gold and sulfur sensitization was effected with the addition of $8\times10^{-7}$ mole of a chloroaurate, $7\times10^{-6}$ mole of sodium thiosulfate and $7\times10^{-4}$ mole of ammonium thiocyanate, stabilization was effected with $2\times10^{-2}$ mole of 4-hydroxy-6-methyl-1,3,3a,7-tetraazaindene and the gelatin concentration was adjusted to a gelatin amount of 2.25 g/m$^2$ (per side).

Sensitizing dye A 450 mg/mole of AgX

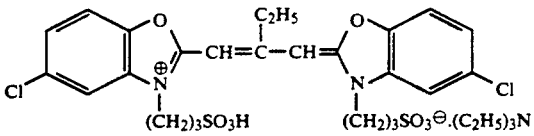

Sensitizing dye B 20 mg/mole of AgX

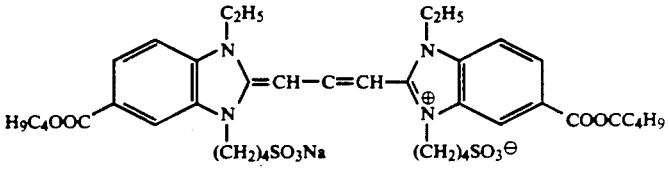

The additives given below were respectively added to the emulsion and the protective film solution while the following film hardener was also added such that the melting time was 20 minutes.

Film hardener

-continued

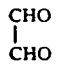

Thus, by way of emulsion layer additives, there were added for every mole of silver halide, $2\times10^{-4}$ mole of a compound of this invention (refer to Table 6), 400 mg of t-butylcatechol, 1.0 g of polyvinylpyrrolidone (molecular weight 10,000), 2.5 g of a styrene/maleic anhydride copolymer, 10 g of trimethylolpropane, 5 g of diethylene glycol, 50 mg of nitrophenyl-triphenylphosphonium chloride, 4 g of ammonium 1,3-dihydroxybenzene-4-sulfonate, 15 mg of sodium 2-mercaptobenzimidazole-5-sulfonate, 70 mg of

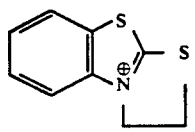

$CH_3SO_3\ominus$, 1 g of

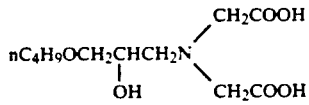

and 10 mg of 1,1-dimethylol-1-bromo-1-nitromethane.

The photographic material 401 was obtained by the multi-layer coating, in sequence from the support, of a silver halide emulsion layer (viscosity 11 cp, surface tension 35 dyn/cm, coated film thickness 50 μm), and a protective layer (viscosity 11 cp, surface tension 25 dyn/cm, coated film thickness 20 μm) at a coating rate of 60m m/min, 2 layers at a time, simultaneously onto both sides of a polyester film support to which the various additives discussed below and a film hardener had been added, in addition to the above emulsion, such that the melting time was 20 minutes and which had been uncoated using the slide hopper method with a protective layer with a gelatin amount of 1.15 g/m$^2$ (per side). The silver amount was 45 mg/dm$^2$ in each case.

Further, the following compounds were added as protective laye additives. Thus, with respect to 1 g of gelatin, there were added

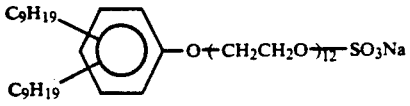

10 mg,

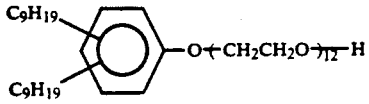

2 mg,

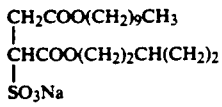

7 mg,

-continued

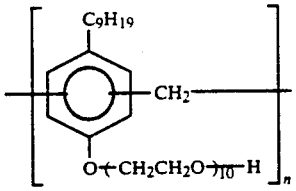

15 mg (a mixture of n = 2 to 5)

7 mg of a matting agent consisting of polymethyl methacrylate with an average particle size of 5 μm, and 70 mg of colloidal silica with an average particle size of 0.013 μm.

The amount of film hardener was adjusted such that the melting time of each sample was 20 minutes when measured by the following method.

Namely, 1 cm×2 cm cut samples were immersed in a 1.5% sodium hydroxide solution kept at 50° C. and the time taken until the emulsion layer began to elute was taken as the melting time.

Further, the speed and fogging were measured in the following ways. Namely, a sample was sandwiched between two optical wedges which were metched so that the density gradient was in mirror symmetry, and was exposed from both sides simultaneously and in equal amounts for 1/12.5 second using a light source with a color temperature of 5,400° K.

The processing was carried out in accordance with the following stages for a total processing time of 45 seconds using an automatic developing apparatus of the roller conveyor type.

| | Processing temperature | Processing time |
|---|---|---|
| Insertion | — | 1.2 sec. |
| Development + transfer | 35° C. | 14.6 sec. |
| Fixing + transfer | 33° C. | 8.2 sec. |
| Washing + transfer | 25° C. | 7.2 sec. |
| Squeezing | 40° C. | 5.7 sec. |
| Drying | 45° C. | 8.1 sec. |
| Total | — | 45.0 sec. |

Moreover, as regards the structure of the automatic developing apparatus in this example, a device with the following specifications was used.

Rubber rollers were used for the rollers, the material being silicone rubber (hardness 48 degrees) in the transfer and EPDM (hardness 46 degrees), which is a type of ethylene propylene rubber, in the processing solutions. The surface roughness of the rollers $R_{max}$ was 4 μm, there were 6 rollers in the developing section and a total of 84 rollers. There were 51 facing rollers and the proportion of the number of facing rollers to the total number of rollers was 51/84 which equals 0.61. The developing solution replenishment amount was 20 cc/quarter (10"×12"), the fixing solution replenishment amount was 45 cc/quarter (10"×12") and the washing water amount was 1.5 l/min. The blown amount in the drying section was 11 m$^2$/min. and a heater with a capacity of 3KW (200 V)was used.

The total processing time was 45 seconds as mentioned above.

The following developing solution 1 was used as the developing solution. The following fixing solution 1 was used as the fixing solution.

The relative speeds and the exposure at base density + fog density + 1.0 were determined from the resulting characteristic curve.

| Composition of the developing solution and fixing solution | |
|---|---|
| Developing solution 1 | |
| Made up to 1 l by the addition of water: | |
| Potassium sulfite | 65.0 g |
| Hydroquinone | 25.0 g |
| 1-phenyl-3-pyrazolidone | 2.5 g |
| boric acid | 10.0 g |
| sodium hydroxide | 21.0 g |
| triethylene glycol | 17.5 g |
| 5-methylbenzotriazole | 0.06 g |
| 5-nitroindazole | 0.14 g |
| glutaraldehyde bisulfite | 15.0 g |
| glacial acetic acid | 16.0 g |
| potassium bromide | 4.0 g |
| triethylenetetraminehexaacetic acid | 2.5 g |
| Fixing solution 1 | |
| Made up to 1 l by the addition of water: | |
| ammonium thiosulfate | 130.9 g |
| anhydrous sodium sulfite | 7.3 g |
| boric acid | 7.0 g |
| acetic acid (90 wt %) | 5.5 g |
| sodium acetate trihydrate | 25.8 g |
| aluminum sulfate octadecahydrate | 14.6 g |
| sulfuric acid (50 wt %) | 6.77 g |

The residual coloration was then evaluated. The transmitted optical density was measured in the non-image portion using green light.

The photographic speed was also determined for each of the samples when using a conventional 90 second processing by halving the line speed in the 45 second automatic developing apparatus described above. The results are given in Table 6.

As is clear from Table 6 the samples according to this invention are outstanding overall in their speed, fogging and residual coloring characteristics and the like, and it will be seen that they are suitable for ultra-rapid processing.

Further, in a comparison with a conventional 90 second processing, it will be seen that it is possible to reduce the residual color and to halve the processing time while maintaining a high photographic speed as compared with a conventional system. In other words, the processing performance is doubled.

Comparative compounds (a)

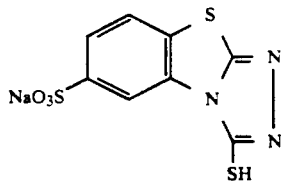

(Compound released by compound of this invention (1))

Comparative compounds (b)

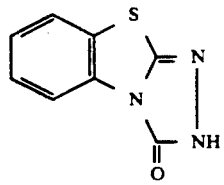

(Compound released by compound (15) of this invention)

Comparative compounds (c)

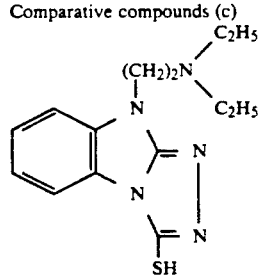

TABLE 6

| No. | Compound added | | 90 second processing Speed | 90 second processing Residual color after processing (transmitted optical density) | 45 second processing Speed | 45 second processing Fog | 45 second processing Residual color after processing (transmitted optical density) |
|---|---|---|---|---|---|---|---|
| 1 | (Comparative example) | — | 100 | 0.185 | 95 | 0.04 | 0.209 |
| 2 | (Comparative example) | (a) | 95 | 0.180 | 85 | 0.01 | 0.200 |
| 3 | (Comparative example) | (b) | 100 | 0.178 | 95 | 0.04 | 0.209 |
| 4 | (Comparative example) | (c) | 95 | 0.165 | 95 | 0.01 | 0.195 |
| 5 | (This invention) | (1) | 110 | 0.145 | 100 | 0.01 | 0.155 |
| 6 | (This invention) | (2) | 105 | 0.143 | 95 | 0.01 | 0.148 |
| 7 | (This invention) | (3) | 100 | 0.142 | 95 | ±0 | 0.145 |
| 8 | (This invention) | (5) | 110 | 0.145 | 100 | 0.02 | 0.149 |
| 9 | (This invention) | (8) | 100 | 0.150 | 95 | 0.03 | 0.155 |
| 10 | (This invention) | (10) | 105 | 0.151 | 100 | 0.01 | 0.154 |
| 11 | (This invention) | (14) | 100 | 0.153 | 95 | 0.02 | 0.157 |
| 12 | (This invention) | (15) | 100 | 0.148 | 100 | 0.01 | 0.150 |
| 13 | (This invention) | (16) | 105 | 0.148 | 100 | 0.01 | 0.153 |
| 14 | (This invention) | (19) | 100 | 0.140 | 95 | 0.01 | 0.146 |
| 15 | (This invention) | (20) | 100 | 0.138 | 100 | 0.01 | 0.140 |
| 16 | (This invention) | (21) | 105 | 0.138 | 100 | 0.01 | 0.143 |

EXAMPLE 7

A silver halide emulsion was prepared which consisted of silver chlorobromide (5 mol % silver bromide, average grain size 0.25 μ) containing $1\times10^{-5}$ mole of Rh per mole of silver.

500 mg/mole of Ag of anhydro-5,5'-dichloro-9-ethyl-3,3'-di(3-sulfopropyl)oxacarbocyanine hydroxide, sodium salt as sensitizing dye and $2\times10^{-4}$ mole, per mole of Ag, of a compound of this invention (refer to Table 7) were added to the above emulsion. Furthermore, sodium 2-hydroxy-4,6-dichloro-1,3,5-triazine was added as a film hardener and potassium polystyrene sulfonate was added as a viscosity enhancer and then coating was carried out onto a polyethylene terephthalate film to a coated silver amount of 4 g/m². A gelatin solution was coated onto this emulsion layer as a protective layer to a gelatin amount of 1.0 g/m². Sodium p-dodecylbenzenesulfonate was used as an auxiliary coating agent for this protective layer, and the same compound as in the emulsion layer was used as a viscosity enhancer.

A model P-607 printer made by the Dai Nippon Screen Company was used to expose the resulting samples via an optical wedge and development processing was carried out using the following developing solution and fixing solution formulations.

Developing Solution

Developing solution LD-8-35 made by the Fuji Photo Film Company, 38° C., 20 seconds.

Fixing Solution

Fixing solution LF308 made by the Fuji Photo Film Company.

Automatic Developing Apparatus

FD-800RA made by the Fuji Photo Film Company.

The transmitted optical density of the samples is measured by means of a conventional ultraviolet visible spectrograph using visible light (by tungsten lamp).

TABLE 7

| Compound added to the photographic material | Residual density after processing (transmitted optical density) |
|---|---|
| (Control) | 0.211 |
| (a) (Comparative example) | 0.209 |
| (b) (Comparative example) | 0.200 |
| (2) (This invention) | 0.160 |
| (3) (This invention) | 0.163 |
| (5) (This invention) | 0.161 |
| (8) (This invention) | 0.165 |
| (15) (This invention) | 0.159 |
| (16) (This invention) | 0.158 |
| (19) (This invention) | 0.155 |
| (20) (This invention) | 0.155 |
| (21) (This invention) | 0.156 |

The comparative compounds (a) and (b) are the same as those employed in Example 6.

In all cases, these was less residual color in the photographic materials containing a compound of this invention.

EXAMPLE 8

A sulfur-sensitized silver halide emulsion consisting of 93 mol % of silver bromide and 7 mol % of silver iodide was prepared. The average diameter of the silver halide grains contained in this emulsion was 0.7 microns. 1 kg of this emulsion contained 0.52 mole of silver halide.

1 kg portions of this emulsion were measured out into pots, 32 mg of the sensitizing dye SD were added for each kilogram of emulsion and this was mixed and stirred at 40° C. A photographic material was obtained by the sequential addition of 0.01 g per kilogram of emulsion of 4-hydroxy-6-methyl-1,3,3*a*,7-tetraazaindene, 0.1 g per kilogram of emulsion of sodium 1-hydroxy-3,5-dichlorotriazine, and $2\times10^{-4}$ mole per kilogram of emulsion of a compound of this invention and 0.1 g per kilogram of emulsion of sodium dodecylbenzenesulfonate, and coating this onto a polyethylene terephthalate film base.

Sensitizing dye SD

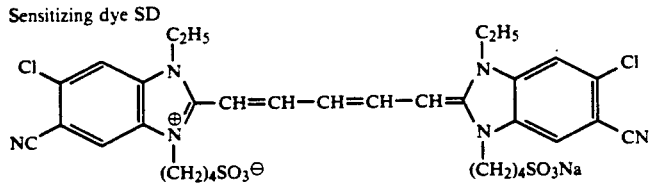

The film samples were subjected to an optical wedge exposure using a sensitometer with a light source with a color temperature of 2854° K with a dark red filter (SC-74) made by the Fuji Photo Film Company attached to the light source. After the exposure, developing was carried out for 3 minutes at 20° C. using a developing solution with the following composition, stopping was effected and then fixing carried out using the following fixing solution after which the sample was washed.

The residual color (the transmitted optical density in the non-image portion) after processing is shown in Table 8.

| Developing solution | |
|---|---|
| Water | 500 ml |
| N-Methyl-p-aminophenol | 2.2 g |
| Anhydrous sodium sulfite | 96.0 g |
| Hydroquinone | 8.8 g |
| Sodium carbonate, monohydrate | 56.0 g |
| Potassium bromide | 5.0 g |
| Water | added to 1 l |

Fixing Solution

Fixing solution LF308 made by the Fuji Photo Film Company.

TABLE 8

| No. | Compound added to the photosensitive material | (Residual density when a compound of this invention was not used) - (residual) density when a compound of this invention was used) |
|---|---|---|
| 1 | (2) | 0.062 |
| 2 | (8) | 0.063 |
| 3 | (10) | 0.065 |
| 4 | (16) | 0.065 |
| 5 | (19) | 0.067 |
| 6 | (21) | 0.067 |

There was less residual color in any of the photographic materials containing a compound of this invention.

EXAMPLE 9

The double jet method was used to prepare a cubic monodisperse silver chloroiodobromide solution with an average grain size of 0.3 μ (variation coefficient 0.13, silver iodide 0.1 mol %, silver bromide 33 mol %).

After this emulsion had been desalted by a common method, it was subjected to sulfur sensitization and 6-methyl-4-hydroxy-1,3,3*a*,7-tetraazaindene was added as a stabilizer, and it was dye sensitized by the addition of a sensitizing dye shown in Table 9 at 150 mg per mole of silver contained in the emulsion.

There were then added, with respect to 1 mole of silver halide, 500 mg of potassium bromide, 100 mg of sodium p-dodecylbenzenesulfonate, 30 mg of 5-nitroindazole, 20 mg of 5-methylbenzotriazole, 1.5 g of a styrene/maleic acid copolymer and 15 g of a styrene/butyl acrylate copolymer latex (average particle size 0.25 μ) and $2\times10^{-4}$ mole of a compound of this invention (refer to Table 9).

Furthermore, $1\times10^{-3}$ mole of a tetrazolium salt compound with the following structural formula was added for every mole of silver and then this was coated onto a support which had undergone the subbing disclosed in Example 1 of JP-A-59-19941 to a coated silver amount of 4.0 g/m² and gelatin amount of 2.1 g/m².

At this time, the sample was prepared by the simultaneous multi-layer coating of a protective layer containing 25 mg/m² of formalin as a film hardener and

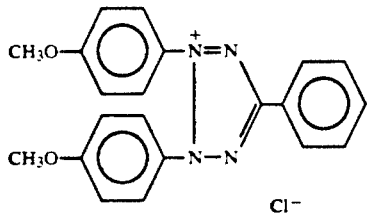

30 mg/m² of sodium 1-decyl-2-(3-isopentyl)succinate-2-sulfonate as an extender so that the gelatin amount was 1.2 g/m². These samples were processed for 30 seconds at 28° C. with the GR-27 automatic developing apparatus made by Konica Co. Ltd. and under developing conditions using the Konica Developer CDM-651K and the Konica Fixer CFL-851.

Further, the coating of a backing layer with the formulation shown below was also carried out.

| Backing layer formulation | |
|---|---|
| Gelatin | 4 g/m² |
| Matting agent polymethyl methacrylate (particle size 3.0 to 4.0μ) | 10 mg/m² |
| Latex polyethyl acrylate | 2 g/m² |
| Surfactant sodium p-dodecylbenzenesulfonate | 40 mg/m² |
| Fluorine-based surfactant $C_8F_{17}SO_2N(C_3H_7)CH_2COOK$ | 5 mg/m² |
| Gelatin hardener | 110 mg/m² |
| Dye: a mixture of the dyes (a), (b) and (c) | |
| $CH_2{=}CHSO_2CH_2CONH$ | |
| $(CH_2)_2$ | |
| $CH_2{=}CHSO_2CH_2CONH$ | |
| Dye (a) | 50 mg/m² |
| Dye (b) | 100 mg/m² |

-continued

| Backing layer formulation | |
|---|---|
| Dye (c) | 50 mg/m² |

Dye (a)

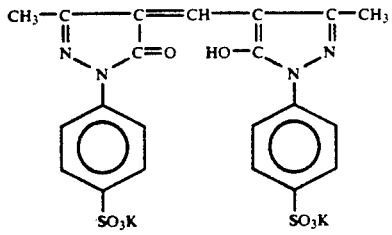

Dye (b)

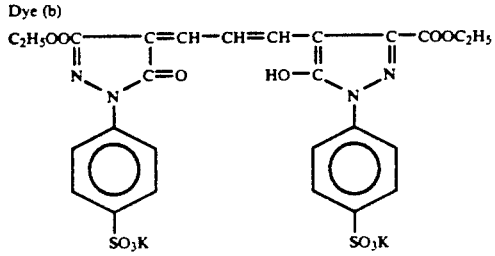

Dye (c)

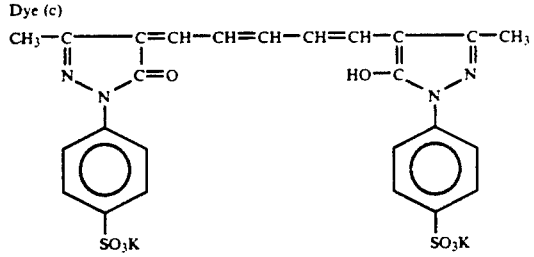

Sensitizing dye A 1-(β-Hydroxyethyl)-3-phenyl-5-((3-α-sulfopropyl-α-benzoxazolidene)ethylidene)thiohydantoin Sensitizing dye B Anhydro-5,5'-dichloro-9-ethyl-3,3'-di(3-sulfopropyl)oxacarbocyanine hydroxide, sodium salt Sensitizing dye C Potassium 4-(5-chloro-2-{2-[1-(5-hydroxy-3-oxapentyl)-3-(2-pyridyl)-2-thiohydantoin-5-iridene)ethylidene}-3-benzoxazolinyl]butanesulfonate The density of the samples is measured by means of a conventional ultraviolet visible spectrograph using visible light (by tungsten lamp).

TABLE 9

| No. | Sensitizing dye | Compound added to the photo sensitive material | (Residual color density when a compound of this invention was not used) - (residual color density when a compound of this invention was used) |
|---|---|---|---|
| 1 | A | (2) | 0.048 |
| 2 | B | (2) | 0.050 |
| 3 | C | (3) | 0.050 |
| 4 | A | (3) | 0.047 |
| 5 | B | (15) | 0.045 |
| 6 | C | (15) | 0.044 |
| 7 | A | (16) | 0.046 |
| 8 | B | (16) | 0.047 |
| 9 | C | (20) | 0.052 |
| 10 | A | (20) | 0.053 |
| 11 | B | (21) | 0.050 |
| 12 | C | (21) | 0.052 |

In all cases, there was less residual color when the photographic materials containing a compound of this invention were processed.

EXAMPLE 10

Preparation of an Emulsion

The double jet method was used for 1 minute, with stirring, to add an aqueous solution of silver (5 g as silver nitrate) and an aqueous solution of potassium bromide containing 0.15 g of potassium iodide to a vessel in which 30 g of gelatin and 6 g of potassium bromide had been added to 1 of water and which was maintained at 60° C. In addition, the double jet method was used to add an aqueous solution of silver nitrate (145 g as silver nitrate) and an aqueous solution of potassium bromide containing 4.2 g of potassium iodide. At this time, the addition flow rate was accelerated so that the flow rate at the end of addition was 5 times that at the start of addition. After the end of the addition, the soluble salts were removed by precipitation at 35° C. and then the temperature was raised to 40° C., 75 g of gelatin were added and the pH was adjusted to 6.7. The resulting emulsion comprised tabular grains with a projected surface area diameter of 0.98 μm and an average thickness of 0.138 μm and had a silver iodide content of 3 mol %. The emulsion was chemically sensitized by conjoint use of gold and sulfur sensitization, so preparing an emulsion.

Preparation of a Photographic Material

Use was made of an aqueous gelatin solution containing a film hardener and 200 ml, per mole of Ag in the emulsion layer, of a $10^{-3}$ mole methanol solution of a compound of this invention (refer to Table 10), poly(sodium styrenesulfonate), poly(methyl methacrylate) particles (average particle size 3.0 μm), poly(ethylene oxide) as well as gelatin acting as the surface protective layer. The abovementioned emulsion-sensitizing dye anhydro-5,5'-dichloro-9-ethyl-3,3'-di(3-sulfopropyl)oxacarbocyanine hydroxide, sodium salt was added in a ratio of 500 mg/1 mole of Ag and potassium iodide was added in a ratio of 200 mg/1 mole of Ag. Furthermore, a photographic material was produced by preparing a coating solution by the addition of 4-hydroxy-6-methyl-1,3,3*a*,7-tetraazaindene and 2,6-bis(hydroxyamino)-4-diethylamino-1,3,5-triazine as stabilizers, trimethylol propane as a dry antifoggant and adding auxiliary coating agents and film hardeners, coating this onto both sides of a polyethylene terephthalate support simultaneously with the respective surface protective layers and drying. The total coated silver amount in this photographic material was 3.7 g/m$^2$ on both sides.

Processing Method

The developing solution and fixing solution (I) formulations were as follows.

| | |
|---|---|
| Developing solution | |
| Diethylenetriaminepentaacetic acid | 2 g |
| 1-Phenyl-3-pyrazolidone | 2 g |
| Hydroquinone | 30 g |
| 5-Nitroindazole | 0.25 g |
| 5-Methylbenzotriazole | 0.02 g |
| Potassium bromide | 1 g |
| Anhydrous sodium sulfite | 60 g |
| Potassium hydroxide | 30 g |
| Potassium carbonate | 5 g |
| Boric acid | 6 g |
| Diethylene glycol | 20 g |
| Glutaraldehyde | 5 g |
| Water added to a total of 1 l (the pH was adjusted to 10.50) | |
| Fixing solution (I) | |
| Ammonium thiosulfate | 175 g |
| Sodium sulfite (anhydrous) | 20.0 g |
| Boric acid | 8.0 g |
| Disodium ethylenediaminetetraacetate dihydrate | 0.1 g |
| Aluminum sulfate | 15.0 g |
| Sulfuric acid | 2.0 g |
| Glacial acetic acid | 22.0 g |
| Water (the pH was adjusted to 4.20) | added to 1.0 l |

| | Processing stages | | | |
|---|---|---|---|---|
| | Temperature | Time | Tank solution amount | Replenishment solution amount |
| Development | 35° C. | 13.7 sec. | 16.5 l | 25 ml/quarter size sheets (10 inch × 12 inch) |
| Fixing | 30° C. | 10.6 sec. | 13 l | 60 ml or 30 ml |
| Washing | Mains water (10° C.) running water | 6.2 sec. | 12 l | 5 l/min. |
| Squeezing | | 4.9 sec. | | |
| Dry | (55° C.) | 10.2 sec. | | |

A liquid in which contains 20 ml of an aqueous solution (starter) containing 2 g of potassium bromide and 4 g of acetic acid (90%) every 1 l of the abovementioned development solution was used as the replenishment solution for the developing in the tank of the automatic developing apparatus, after which the development solution was replenished in a fixed proportion every time a photographic material was processed. A liquid with the same composition as the fixing solution was also used in the tank of the automatic developing apparatus as the replenishment solution for the fixing .

When 500 quarter-sized sheets of the above photographic material were processed under the following varied conditions, the residual color caused by the sensitizing dyes in the processing solution (500th sheet) was as given below.

TABLE 10

| | Upon replenishment with 60 ml of fixing solution per quartered sheet | | Upon replenishment with 30 ml of fixing solution per quartered sheet | |
|---|---|---|---|---|
| | Amount of $I^-$ ions in the Fixing solution | Residual color | Amount of $I^-$ ions in the Fixing solution | Residual color |
| Control | 0.93 mmol/l | A slightly pink residual color | 1.87 mmol/l | Much pink residual color, cannot be used for diagnosis |
| Photosensitive material containing | 0.92 mmol/l | Absolutely no problem | 1.91 mmol/l | Absolutely no problem |

TABLE 10-continued

| | Upon replenishment with 60 ml of fixing solution per quartered sheet | | Upon replenishment with 30 ml of fixing solution per quartered sheet | |
|---|---|---|---|---|
| | Amount of $I^-$ ions in the Fixing solution | Residual color | Amount of $I^-$ ions in the Fixing solution | Residual color |
| the compound (2) of this invention | | | | |
| Photosensitive material containing the compound (20) of this invention | 0.93 mmol/l | Absolutely no problem | 1.90 mmol/l | Absolutely no problem |

EXAMPLE 11

The multi-layer color photographic material 1101 was prepared by the multi-layer coating of the various layers with the compositions shown below onto a subbed cellulose triacetate film support.

Photosensitive Layer Compositions

The figures corresponding to each of the constituents denote coated amounts given in units of g/m$^2$, while for the silver halides they denote the coated amount calculated as silver. However, the figures corresponding to the sensitizing dyes denote the molar unit for the coated amount with respect to 1 mole of silver halide in the same layer, and the figures corresponding to the compounds of this invention donate the molar unit for the coated amount with respect to 1 mole of silver halide in the total layers.

| (Sample 1101) | | |
|---|---|---|
| First layer: antihalation layer | | |
| Black colloidal silver | silver | 0.18 |
| Gelatin | | 0.48 |
| Second layer: intermediate layer | | |
| 2,5-Di-pentadecylhydroquinone | | 0.18 |
| EX-1 | | 0.07 |
| EX-3 | | 0.02 |
| EX-12 | | 0.002 |
| U-1 | | 0.06 |
| U-2 | | 0.08 |
| U-3 | | 0.10 |
| HBS-1 | | 0.10 |
| HBS-2 | | 0.02 |
| Compound of this invention (refer to Table 11) | | $1.0 \times 10^{-3}$ |
| Gelatin | | 1.24 |
| Third layer (1st red-sensitive emulsion layer) | | |
| Monodisperse silver iodobromide emulsion (silver iodide 6 mol %, average grain size 0.6μ, grain size variation coefficient 0.15) | silver | 0.55 |
| Sensitizing dye I | | $6.9 \times 10^{-5}$ |
| Sensitizing dye II | | $1.8 \times 10^{-5}$ |
| Sensitizing dye III | | $3.1 \times 10^{-4}$ |
| Sensitizing dye IV | | $4.0 \times 10^{-5}$ |
| EX-2 | | 0.350 |
| HBS-1 | | 0.005 |
| EX-10 | | 0.020 |
| Gelatin | | 1.45 |
| Fourth layer (2nd red-sensitive emulsion layer) | | |
| Tabular silver iodobromide emulsion (silver iodide 10 mol %, average grain size 0.7μ, average aspect ratio 5.5, average thickness 0.2μ) | silver | 1.0 |
| Sensitizing dye I | | $5.1 \times 10^{-5}$ |
| Sensitizing dye II | | $1.4 \times 10^{-5}$ |
| Sensitizing dye III | | $2.3 \times 10^{-4}$ |
| Sensitizing dye IV | | $3.0 \times 10^{-5}$ |
| EX-2 | | 0.400 |
| EX-3 | | 0.050 |

-continued

| (Sample 1101) | | |
|---|---|---|
| EX-10 | | 0.015 |
| Gelatin | | 1.50 |
| Fifth layer (3rd red-sensitive emulsion layer) | | |
| Silver iodobromide emulsion (silver iodide 16 mol %, average grain size 1.1μ) | silver | 1.60 |
| Sensitizing dye IX | | $5.4 \times 10^{-5}$ |
| Sensitizing dye II | | $1.4 \times 10^{-5}$ |
| Sensitizing dye III | | $2.4 \times 10^{-4}$ |
| Sensitizing dye IV | | $3.1 \times 10^{-5}$ |
| EX-3 | | 0.240 |
| EX-4 | | 0.120 |
| HBS-1 | | 0.22 |
| HBS-2 | | 0.10 |
| Gelatin | | 2.00 |
| Sixth layer (intermediate layer) | | |
| EX-5 | | 0.040 |
| HBS-1 | | 0.020 |
| EX-12 | | 0.004 |
| Gelatin | | 1.00 |
| Seventh layer (1st green-sensitive emulsion layer) | | |
| Tabular silver iodobromide emulsion (silver iodide 6 mol %, average grain size 0.6μ, average aspect ratio 6.0, average thickness 0.15μ) | silver | 0.40 |
| Sensitizing dye V | | $3.0 \times 10^{-5}$ |
| Sensitizing dye VI | | $1.0 \times 10^{-4}$ |
| Sensitizing dye VII | | $3.8 \times 10^{-4}$ |
| EX-6 | | 0.260 |
| EX-1 | | 0.021 |
| EX-7 | | 0.030 |
| EX-8 | | 0.025 |
| HBS-1 | | 0.100 |
| HBS-4 | | 0.010 |
| Gelatin | | 0.90 |
| Eighth layer (2nd green-sensitive emulsion layer) | | |
| Monodisperse silver iodobromide emulsion (silver iodide 9 mol %, average grain size 0.7μ, grain size variation coefficient 0.18) | silver | 0.80 |
| Sensitizing dye V | | $2.1 \times 10^{-5}$ |
| Sensitizing dye VI | | $7.0 \times 10^{-5}$ |
| Sensitizing dye VII | | $2.6 \times 10^{-4}$ |
| EX-6 | | 0.180 |
| EX-8 | | 0.010 |
| EX-1 | | 0.008 |
| EX-7 | | 0.012 |
| HBS-1 | | 0.160 |
| HBS-4 | | 0.008 |
| Gelatin | | 1.30 |
| Layer 9 (3rd green-sensitive emulsion layer) | | |
| Silver iodobromide emulsion (silver iodide 12 mol %, average grain size 1.0μ) | silver | 1.2 |
| Sensitizing dye V | | $3.5 \times 10^{-5}$ |
| Sensitizing dye VI | | $8.0 \times 10^{-5}$ |
| Sensitizing dye VII | | $3.0 \times 10^{-4}$ |
| EX-6 | | 0.065 |
| EX-11 | | 0.030 |
| EX-1 | | 0.025 |

-continued (Sample 1101)

| | | |
|---|---|---|
| HBS-1 | | 0.25 |
| HBS-2 | | 0.10 |
| Gelatin | | 2.00 |
| Tenth layer (yellow filter layer) | | |
| Yellow colloidal silver | silver | 0.05 |
| EX-5 | | 0.08 |
| HBS-3 | | 0.03 |
| Gelatin | | 1.10 |
| Eleventh layer (1st blue-sensitive emulsion layer) | | |
| Tabular silver iodobromide emulsion (silver iodide 6 mol %, average grain size 0.6μ, average aspect ratio 5.7, average thickness 0.15) | silver | 0.24 |
| Sensitizing dye VIII | | $3.5 \times 10^{-4}$ |
| EX-9 | | 0.85 |
| EX-8 | | 0.12 |
| HBS-1 | | 0.28 |
| Gelatin | | 1.50 |
| Twelfth layer (2nd blue-sensitive emulsion layer) | | |
| Monodisperse silver iodobromide emulsion (silver iodide 10 mol %, average grain size 0.8μ, grain size variation coefficient 0.16) | silver | 0.45 |
| Sensitizing dye VIII | | $2.1 \times 10^{-4}$ |
| EX-9 | | 0.20 |
| EX-10 | | 0.015 |
| HBS-1 | | 0.03 |
| Gelatin | | 0.55 |
| Thirteenth layer (3rd blue-sensitive emul -sion layer) | | |

-continued (Sample 1101)

| | | |
|---|---|---|
| Silver iodobromide emulsion (silver iodide 14 mol %, average grain size 1.3μ) | silver | 0.77 |
| Sensitizing dye VIII | | $2.2 \times 10^{-4}$ |
| EX-9 | | 0.20 |
| HBS-1 | | 0.07 |
| Gelatin | | 0.85 |
| Fourteenth layer (1st protective layer) | | |
| Silver iodobromide emulsion (silver iodide 1 mol %, average grain size 0.07μ) | silver | 0.5 |
| U-4 | | 0.11 |
| U-5 | | 0.17 |
| HBS-1 | | 0.90 |
| Gelatin | | 1.20 |
| Fifteenth layer (2nd protective layer) | | |
| Polymethyl acrylate grains (diameter about 1.5 μm) | | 0.54 |
| S-1 | | 0.15 |
| S-2 | | 0.05 |
| Gelatin | | 0.90 |

As well as the above constituents, the gelatin hardener H-1 and a surfactant were added to each layer.

The above sample 1101 has a total photographic structural layer thickness of 22 μ according to this invention and a film swelling rate $T\frac{1}{2}$ of 12 seconds.

Following this, a reduction was made in the amount of gelatin and the amount of film hardener in each layer of the sample 1101 to prepare a sample 1102 with a thickness of 19 μ and with $T\frac{1}{2}$ of 9 seconds, and a sample 1103 with a thickness of 17 μ and $T\frac{1}{2}$ of 7 seconds.

U-1

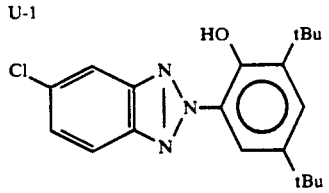

U-2

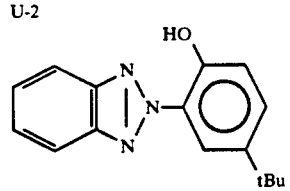

U-3

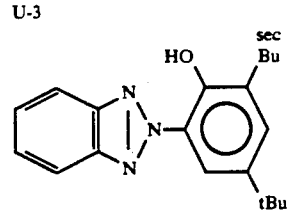

U-4

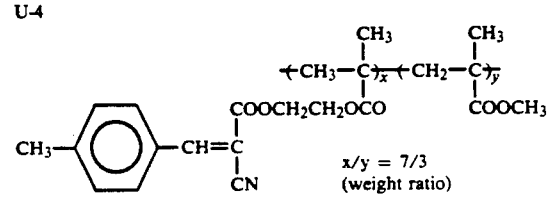

U-5

-continued
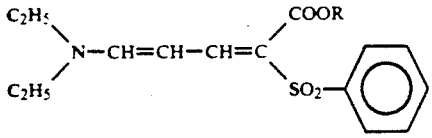
R = $C_8H_{17}$
EX-1
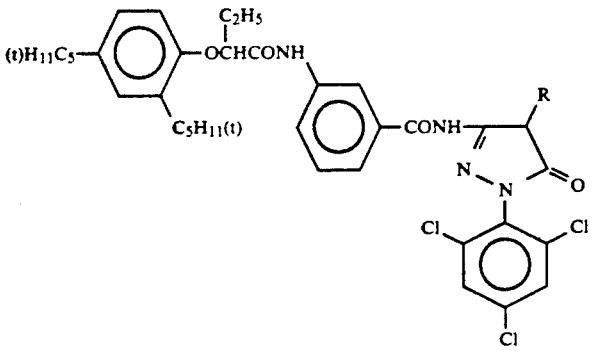
R = 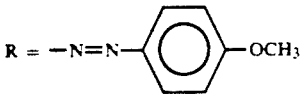
EX-2
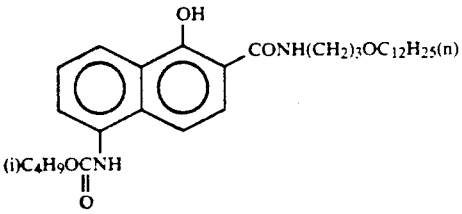
EX-3
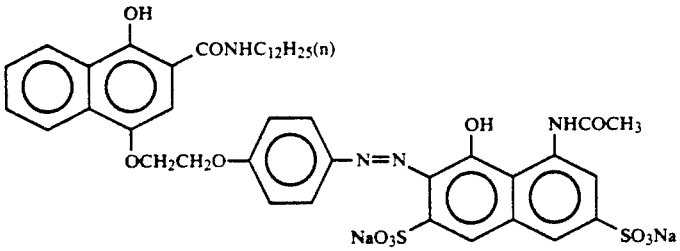
EX-4
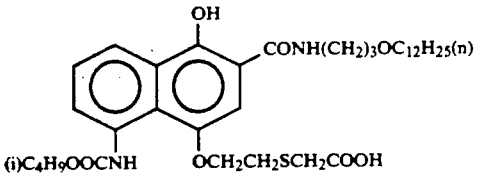
EX-5
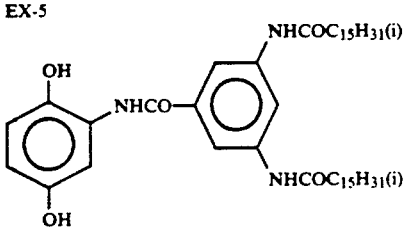
EX-6

-continued
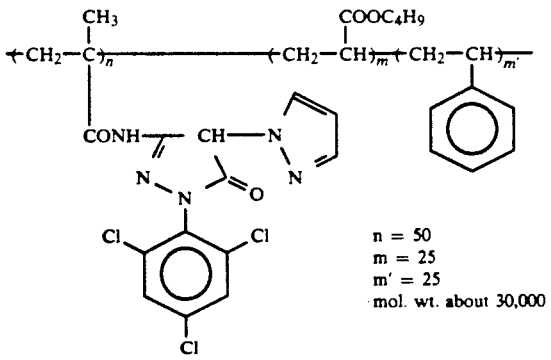
EX-7
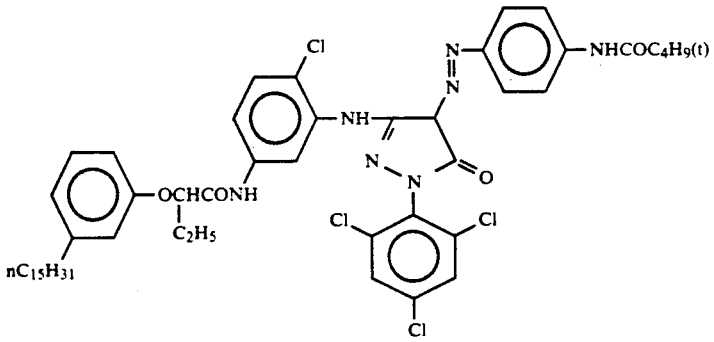
EX-8
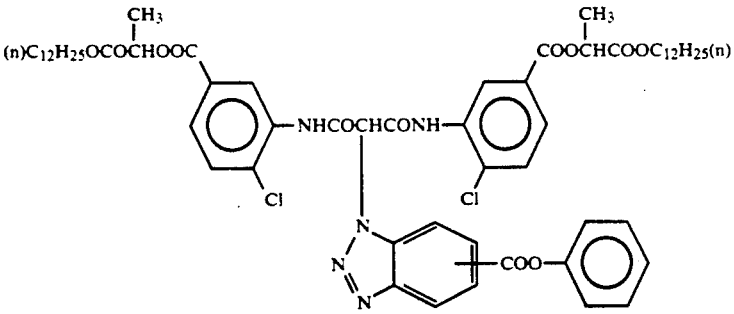
EX-9
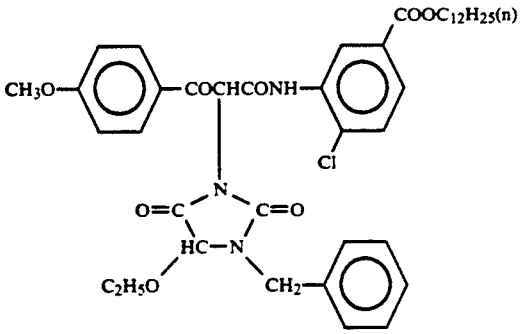
EX-10

-continued
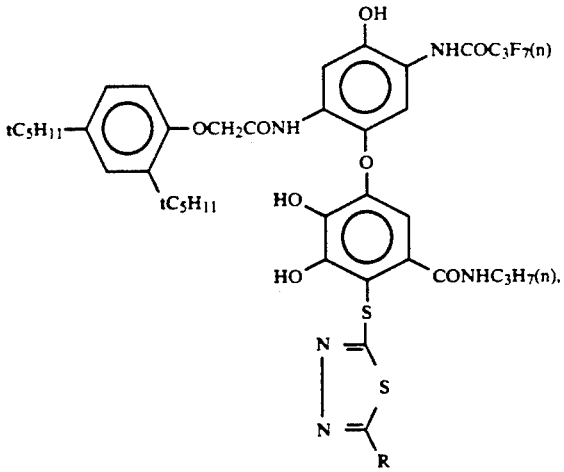
wherein R = $SCH(CH_3)COOCH_3$
EX-11; the same as EX-1 except that R = H
EX-12
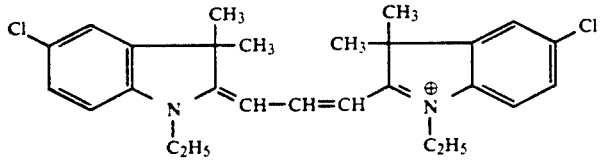
S-1
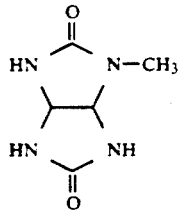
S-2
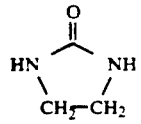
HBS-1; Tricresylphosphate
HBS-2; Dibutylphtalate
HBS-3; Bis(2-ethylexyl)phtalate
HBS-4
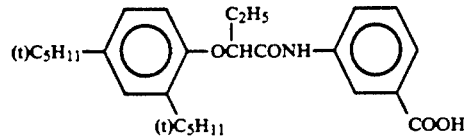
H-1
$CH_2{=}CH{-}SO_2{-}CH_2{-}CONH{-}CH_2$
$CH_2{=}CH{-}SO_2{-}CH_2{-}CONH{-}CH_2$
Sensitizing dye
I -continued
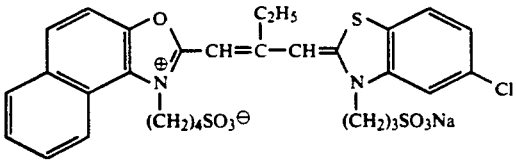
II
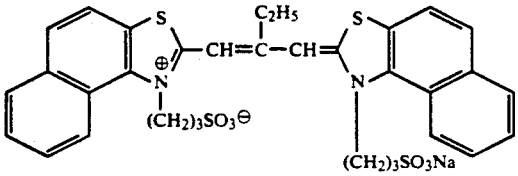
III
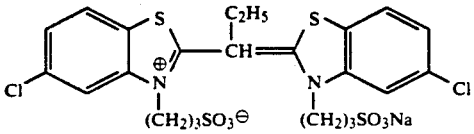
IV
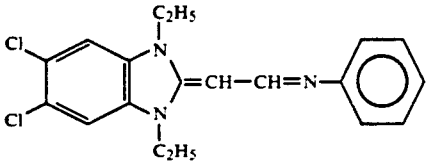
V
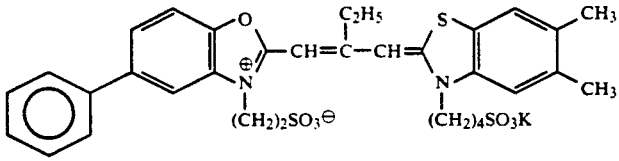
VI
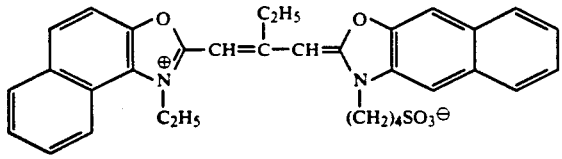
VII
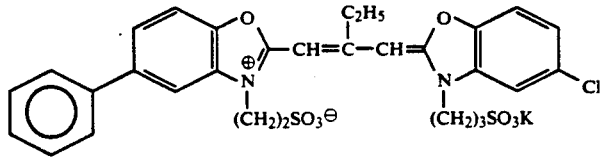
VIII
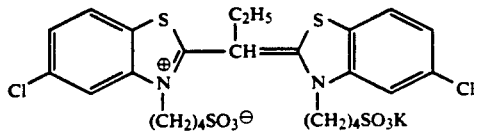
IX -continued

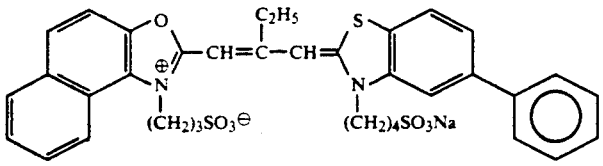

Samples 1101, 1102 and 1103 which had been prepared in this way were cut into 35 mm widths and then subjected to a standard exposure in a camera, 1 $m^2$ of each was subjected to mixed processing (processing Samples 1101, 1102 and 1103 concurrently) in a day by means of the following processing using the automatic developing apparatus and this was continued for 10 days.

The transmitted magenta densities in the unexposed portions of the processed samples were measured at the beginning (fresh processing) and the end (running processing) of the above processing using the Ekkusuraito model 310 photographic densitometer, and the value for (running processing)−(fresh processing), which is to say the change in the magenta density due to the running, was determined.

Furthermore, the running-processed samples were stored for 1 week under conditions of a relative humidity of 70% at 60° C. to evaluate the changes in the transmitted magenta density over this period.

The results are given in Table 11.

| Stage | Processing time | Processing temperature | Replenishment amount (per 1 $m^2$) | Tank capacity |
|---|---|---|---|---|
| Color development | 2 min. 00 sec. | 38° C. | 390 ml | 10 l |
| Bleaching | 45 sec. | 38° C. | 270 ml | 4 l |
| Bleach fixing | 1 min. 30 sec. | 38° C. | 530 ml | 8 l |
| Washing (1) | 15 sec. | 35° C. | Countercurent piping system from (2) to (1) | 4 l |
| Washing (2) | 15 sec. | 35° C. | 270 ml | 4 l |
| Stabilization | 15 sec. | 38° C. | 270 ml | 4 l |
| Drying | 1 min. 15 sec. | 55° C. | | |

In the above, the wet processing time from When the photographic material is immersed in the color developing solution until it emerges from the stabilizing solution is 5 minutes 00 seconds. In addition, the total amount of replenishment solution is 1730 ml.

| | Main solution (g) | Replenishment solution (g) |
|---|---|---|
| (Color developing solution) | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 5.8 |
| Potassium carbonate | 30.0 | 37.0 |
| Potassium bromide | 1.4 | — |
| Potassium iodide | 1.5 mg | — |
| Hydroxylamine sulfate | 2.4 | 3.5 |
| 4-(N-Ethyl-N-β-hydroxyethylamino)-2-methylaniline sulfate | 4.5 | 7.2 |
| Water (mains water) added to | 1.0 l | 1.0 l |
| pH | 10.05 | 10.20 |
| (Bleaching solution) the main solution and replenishment solution were the same (units g) | | |
| Ethylenediaminetetraacetic acid, ferric ammonium salt, dihydrate | 160.0 | |
| Disodium ethylenediaminetetraacetate | 10.0 | |
| Ammonium bromide | 160.0 | |
| Ammonium nitrate | 10.0 | |
| Bleach accelerator | 0.010 mole | |

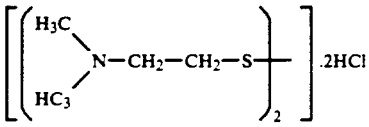

| | |
|---|---|
| Ammonia water (27%) | 5.0 ml |
| Water (main water) | added to 1.0 l |
| pH | 5.3 |
| (Bleach-fixing solution) the main solution and replenishment solution were the same (units g) | |
| Ethylenediaminetetraacetic acid, ferric ammonium salt, dihydrate | 80.0 |
| Disodium ethylenediaminetetraacetate | 5.0 |
| Ammonium sulfite | 15.0 |
| Aqueous solution of ammonium thiosulfate (700 g/l) | 300.0 ml |
| Ammonia water (27%) | 6.0 ml |
| Water | added to 1.0 l |
| pH | 7.2 |
| (Washing water) the main solution and replenishment solution were the same | |

The following water quality was obtained by passing mains water through a mixed bed column charged with a H-type strongly acidic cation exchange resin (Amberlite IR-120B made by the Rohm and Haas company) and a OH-type anion exchange resin (Amberlite IR-400 from the same company).

| | |
|---|---|
| Calcium | 0.3 mg/l |
| Magnesium | 0.1 mg/l or below |
| pH | 6.5 |
| Conductivity | 5.0 μs/cm |

-continued

| | |
|---|---|
| (Stabilizing solution) the main solution and the replenishment solution were the same (units g) | |
| Formalin (37%) | 1.0 ml |
| Polyoxyethylene-p-monononyl phenyl ether (average degree of polymerization 10) | 0.3 |
| Disodium ethylenediaminetetraacetic acid | 0.05 |
| Water (mains water) added to | 1.0 l |
| pH | 5.0 to 8.0 |

TABLE 11

| | No. | Sample | Additive in the 2nd layer | Change in the magenta density due to running | Change in the magenta density after 1 week at 60° C., 70% RH |
|---|---|---|---|---|---|
| Comp. Ex. | 1 | 1101 | None | +0.07 | +0.13 |
| Comp. Ex. | 2 | 1102 | " | +0.06 | +0.11 |
| Comp. Ex. | 3 | 1103 | " | +0.06 | +0.10 |
| This inv. | 4 | 1101 | (1) | +0.02 | +0.02 |
| This inv. | 5 | 1102 | (2) | +0.01 | +0.01 |
| This inv. | 6 | 1103 | (3) | +0.01 | +0.01 |
| This inv. | 7 | 1101 | (5) | +0.02 | +0.03 |
| This inv. | 8 | 1102 | (8) | +0.02 | +0.03 |
| This inv. | 9 | 1103 | (10) | ±0 | +0.01 |
| This inv. | 10 | 1101 | (11) | +0.04 | +0.04 |
| This inv. | 11 | 1102 | (14) | +0.01 | +0.01 |
| This inv. | 12 | 1103 | (15) | +0.01 | +0.02 |
| This inv. | 13 | 1101 | (16) | +0.01 | +0.01 |
| This inv. | 14 | 1102 | (20) | ±0 | +0.01 |
| This inv. | 15 | 1103 | (21) | +0.01 | +0.02 |

Comp. Ex. = Comparative Example
This inv. = This invention

As Table 11 shows, it is possible to control the rise in the magenta density in the non-exposed portion caused by running at a level at which there is no practical impairment. Further, the rise in the magenta density in the unexposed portion when stored at a high temperature or at a high humidity can also be controlled simultaneously. It is also clear that the above effets are improved by reducing the thickness of the photographic structural layers and accelerating the swelling rate T½.

EXAMPLE 12

The multi-layer color photographic material 1201 was prepared by the multi-layer coating of the various layers with the compositions shown below onto a subbed cellulose triacetate film support.

Photosensitive layer compositions

The figures corresponding to each of the constituents denote coated amounts given in units of g/m$^2$, while for the silver halides they denote the coated amount calculated as silver. However, the figures corresponding to the sensitizing dyes denote the molar unit for the coated amount with respect to 1 mole of silver halide in the same layer, and the figures corresponding to the compounds of this invention donate the molar unit for the coated amount with respect to 1 mole of silver halide in the total layers.

| (Sample 1201) | |
|---|---|
| First layer (antihalation layer) | |
| Black colloidal silver | 0.2 |
| Gelatin | 1.2 |
| Ultraviolet absorber UV-1 | 0.05 |
| Ultraviolet absorber UV-2 | 0.1 |
| Ultraviolet absorber UV-3 | 0.1 |
| Dispersing oil OIL-1 | 0.02 |
| Second layer (intermediate layer) | |
| Fine silver bromide grains (average grain size 0.07 μ) | 0.15 |
| Gelatin | 1.2 |
| Third layer (first red-sensitive emulsion layer) | |
| Monodisperse emulsion (silver iodide 6 mol %, average grain size 0.4 μm with a variation coefficient 15%) | 1.42 |
| Gelatin | 1.1 |
| Sensitizing dye A | $2.0 \times 10^{-4}$ |
| Sensitizing dye B | $1.0 \times 10^{-4}$ |
| Sensitizing dye C | $0.3 \times 10^{-4}$ |
| Cp-b | 0.35 |
| Cp-c | 0.052 |
| Cp-d | 0.047 |
| D-1 | 0.023 |
| D-2 | 0.035 |
| HBS-1 | 0.10 |
| HBS-2 | 0.10 |
| Fourth layer (intermediate layer) | |
| Gelatin | 1.0 |
| Cp-b | 0.10 |
| HBS-1 | 0.05 |
| Fifth layer (2nd red-sensitive emulsion layer) | |
| Monodisperse emulsion (silver iodide 6 mol %, average grain size 0.5 μm with a variation coefficient 15%) | 1.38 |
| Gelatin | 1.2 |
| Sensitizing dye A | $1.5 \times 10^{-4}$ |
| Sensitizing dye B | $2.0 \times 10^{-4}$ |
| Sensitizing dye C | $0.5 \times 10^{-4}$ |
| Cp-b | 0.150 |
| Cp-d | 0.027 |
| D-1 | 0.005 |
| D-2 | 0.010 |
| HBS-1 | 0.050 |
| HBS-2 | 0.060 |
| Sixth layer (3rd red-sensitive emulsion layer) | |
| Monodisperse emulsion (silver iodide 7 mol %, average grain size 1.1 μm with a variation coefficient 16%) | 2.08 |
| Gelatin | 1.7 |
| Cp-a | 0.060 |
| Cp-c | 0.024 |
| Cp-d | 0.038 |
| D-1 | 0.006 |
| HBS-1 | 0.012 |
| Seventh layer (intermediate layer) | |
| Gelatin | 1.2 |
| Compound of this invention (refer to Table 12) | $1.0 \times 10^{-3}$ |
| Cpd-A | 0.05 |
| HBS-2 | 0.05 |
| Eighth layer (1st green-sensitive emulsion layer) | |
| Monodisperse silver iodobromide emulsion (silver iodide 3 mol %, average grain size 0.4 μm, variation coefficient 19%) | 0.64 |
| Monodisperse silver iodobromide emulsion (silver iodide 6 mol %, average grain size 0.7 μm, variation coefficient 18%) | 1.12 |
| Gelatin | 1.2 |
| Sensitizing dye D | $1 \times 10^{-4}$ |
| Sensitizing dye E | $4 \times 10^{-4}$ |
| Sensitizing dye F | $1 \times 10^{-4}$ |

-continued (Sample 1201)

| | |
|---|---|
| Cp-h | 0.20 |
| Cp-f | 0.61 |
| Cp-g | 0.084 |
| Cp-k | 0.035 |
| Cp-l | 0.036 |
| D-3 | 0.041 |
| D-4 | 0.018 |
| HBS-1 | 0.25 |
| HBS-2 | 0.45 |
| Ninth layer (2nt green-sensitive emulsion layer) | |
| Monodisperse silver iodobromide emulsion (silver iodide 7 mol %, average grain size 1.0 μm, variation coefficient 18%) | 2.07 |
| Gelatin | 1.7 |
| Sensitizing dye D | $1.5 \times 10^{-4}$ |
| Sensitizing dye E | $2.3 \times 10^{-4}$ |
| Sensitizing dye F | $1.5 \times 10^{-4}$ |
| Cp-f | 0.007 |
| Cp-h | 0.012 |
| Cp-g | 0.009 |
| HBS-2 | 0.088 |
| Tenth layer (intermediate layer) | |
| Yellow colloidal silver | 0.06 |
| Gelatin | 1.4 |
| Cpd-A | 0.3 |
| HBS-1 | 0.3 |
| Eleventh layer (1st blue-sensitive emulsion layer) | |
| Monodisperse silver iodobromide emulsion (silver iodide 6 mol %, average grain size 0.4 μm, variation coefficient 20%) | 0.31 |
| Monodisperse silver iodobromide emulsion (silver iodide 5 mol %, average grain size 0.9 μm, variation coefficient 17%) | 0.38 |
| Gelatin | 2.0 |
| Sensitizing dye G | $1 \times 10^{-4}$ |
| Sensitizing dye H | $1 \times 10^{-4}$ |

-continued (Sample 1201)

| | |
|---|---|
| Cp-i | 0.63 |
| Cp-j | 0.57 |
| D-1 | 0.020 |
| D-4 | 0.015 |
| HBS-1 | 0.05 |
| Twelfth layer (2nt blue-sensitive emulsion layer) | |
| Monodisperse silver iodobromide emulsion (silver iodide 8 mol %, average particle size 1.3 μm, variation coefficient 18%) | 0.77 |
| Gelatin | 0.7 |
| Sensitizing dye G | $5 \times 10^{-5}$ |
| Sensitizing dye H | $5 \times 10^{-5}$ |
| Cp-i | 0.10 |
| Cp-j | 0.10 |
| D-4 | 0.005 |
| HBS-2 | 0.10 |
| Thirteenth layer (intermediate layer) | |
| Gelatin | 0.7 |
| Cp-m | 0.1 |
| UV-1 | 0.1 |
| UV-2 | 0.1 |
| UV-3 | 0.1 |
| HBS-1 | 0.05 |
| HBS-2 | 0.05 |
| Fourteenth layer (protective layer) | |
| Monodisperse silver iodobromide emulsion (silver iodide 4 mol %, average grain size 0.05 μm, variation coefficient 10%) | 0.1 |
| Gelatin | 1.5 |
| Polymethyl methacrylate grains (average 1.5 μ) | 0.1 |
| S-1 | 0.2 |
| S-2 | 0.2 |

In addition, the surfactant K-1 and the gelatin hardener H-1 were also added.

Sensitizing dye A

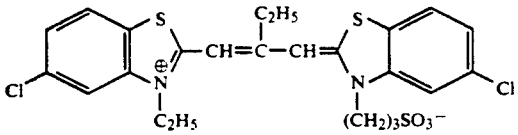

Sensitizing dye B

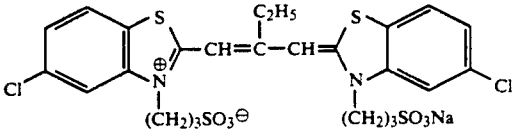

Sensitizing dye C

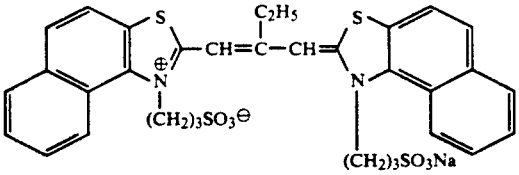

Sensitizing dye D

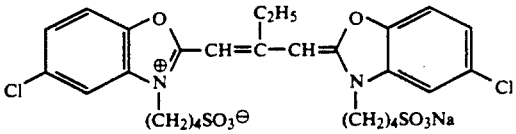

Sensitizing dye E

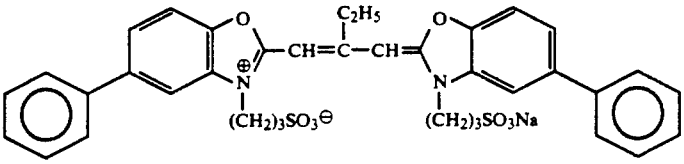

Sensitizing dye F

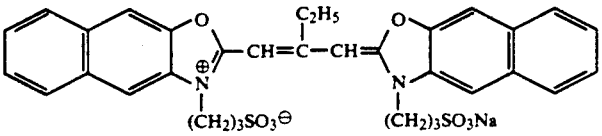

Sensitizing dye G

-continued
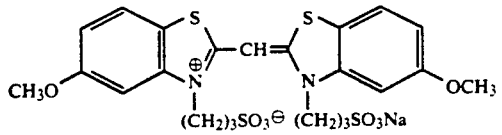
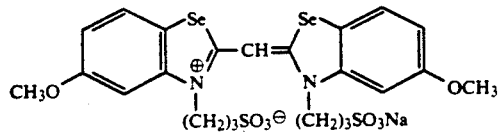
D-1
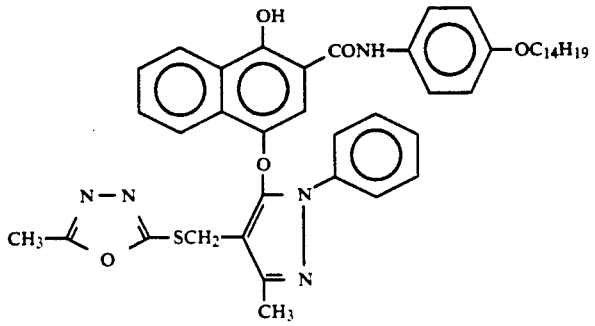
D-2
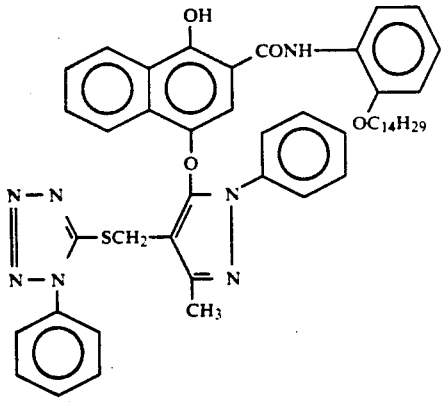
D-3
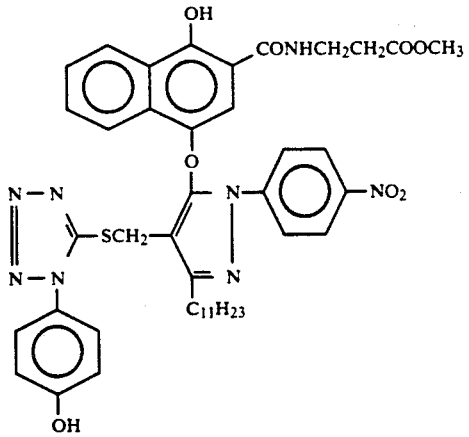
D-4
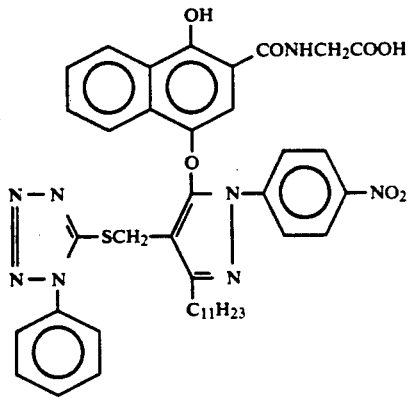
OIL-1
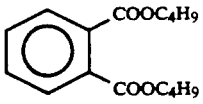
Cp-a
Cp-b -continued
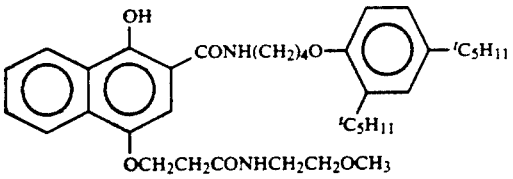
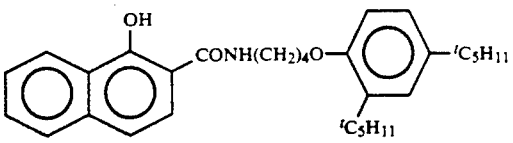
Cp-c
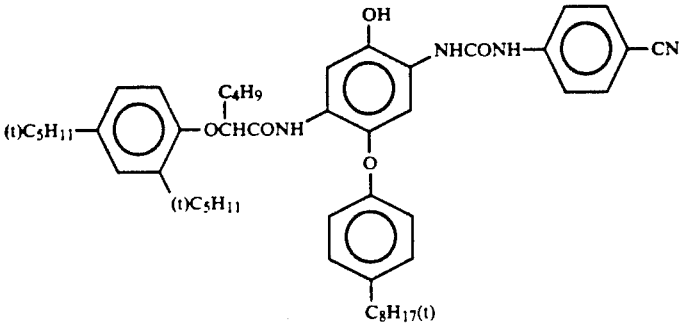
Cp-d
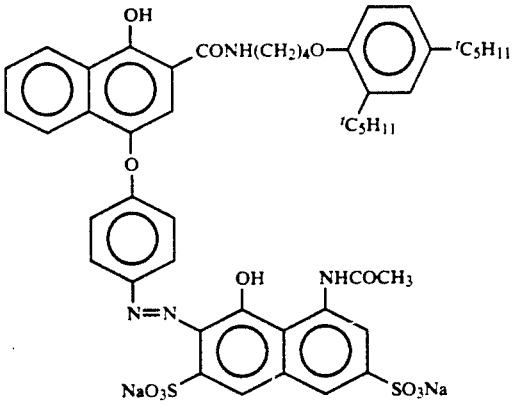
Cp-f
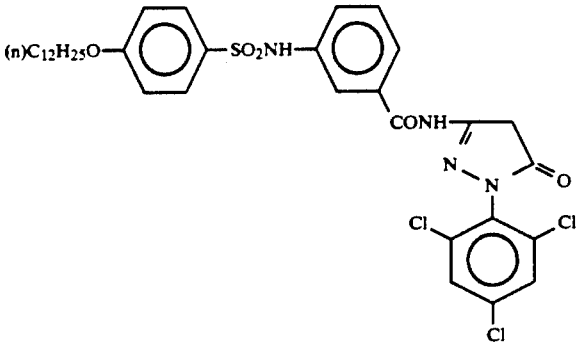
Cp-g
Cp-h -continued
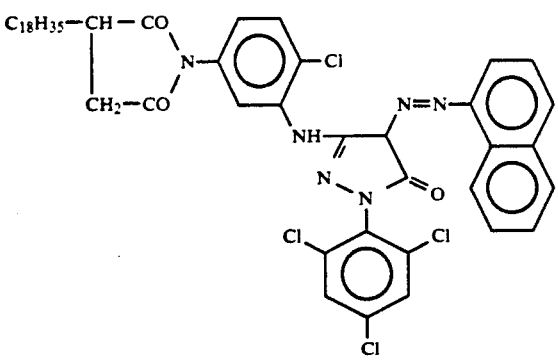
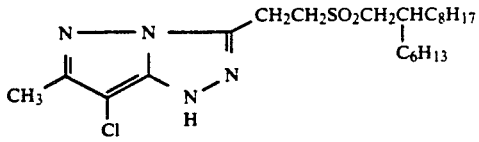
Cp-i
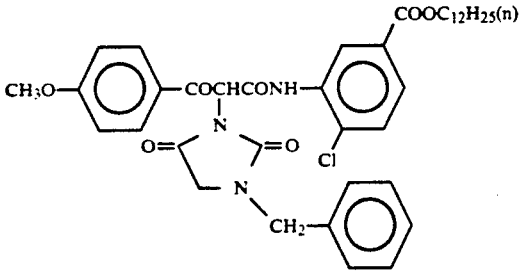
Cp-j
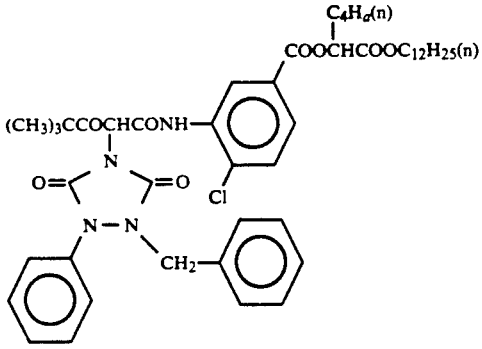
Cp-k
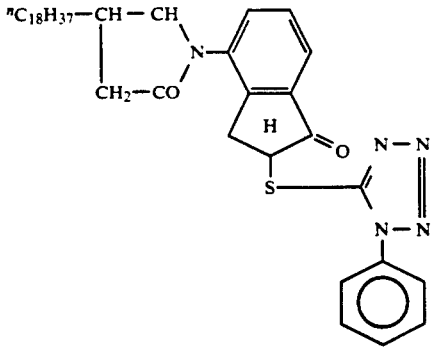
Cp-l
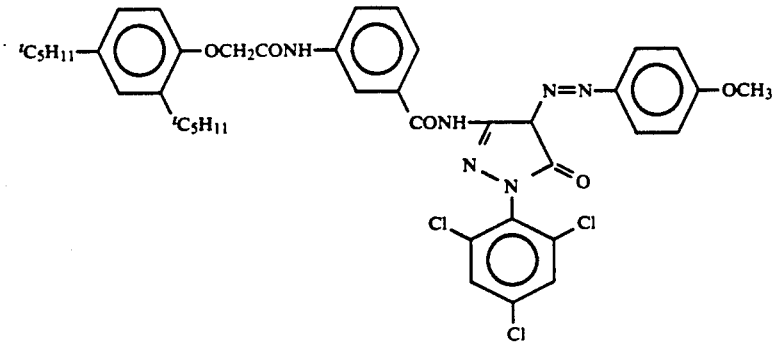
Cp-m -continued

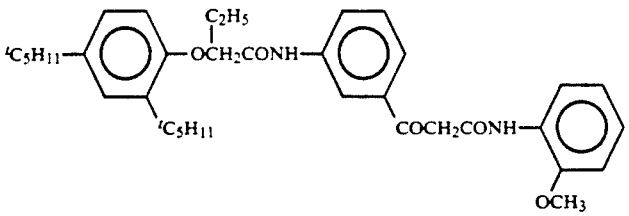

HBS-1

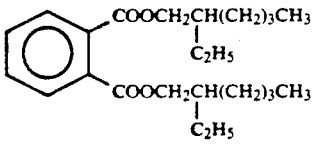

HBS-2

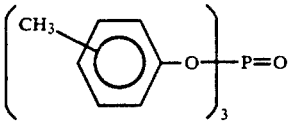

K-1

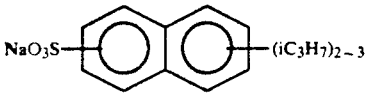

S-1

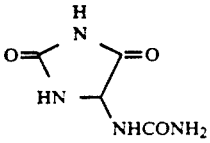

S-2

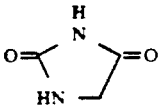

UV-1

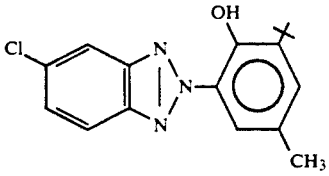

UV-2

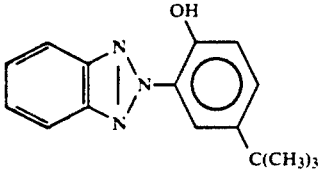

UV-3

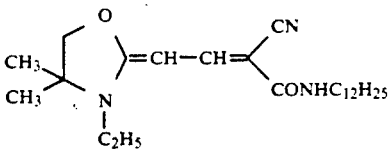

CpdA

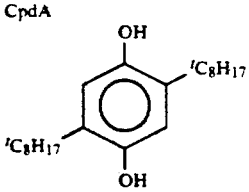

H-1

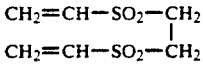

The amount of gelatin and the amount of film hardener in the above sample 1201 was reduced to prepare the following samples overall.

| Thickness of the photographic Film swelling | | |
|---|---|---|
| Sample | structural layer | rate $T\frac{1}{2}$ |
| 1201 | 24 μ | 12 sec. |
| 1202 | 19 μ | 8 sec. |
| 1203 | 16 μ | 6 sec. |

The above samples were subjected to exposures in a camera then each sample was subjected to mixed processing at 1 $m^2$ a day in the same way as in Example 11 and this was continued for a total of 10 days.

Furthermore, the processing which was carried out was as shown below.

Processing and evaluation of the samples were undertaken in the same way as in Example 11.

| Stage | Processing time | Processing temperature | Replenishment amount (per 1 $m^2$) | Tank capacity |
|---|---|---|---|---|
| Color development | 1 min. 30 sec. | 37.8° C. | 350 ml | 10 l |
| Bleaching | 30 sec. | 37.8° C. | 130 ml | 5 l |
| Fising | 1 min. 15 sec. | 37.8° C. | 500 ml | 10 l |
| Stabili- (1) zation | 15 sec. | 35° C. | 3-stage counter-current system from (3) to (1) | 5 l |
| Stabili- (2) zation | 15 sec. | 35° C. | | 5 l |
| Stabili- (3) zation | 15 sec. | 35° C. | 350 ml | 5 l |
| Drying | 1 min. | 55° C. | | |

-continued

| Stage | Processing time | Processing temperature | Replenishment amount (per 1 $m^2$) | Tank capacity |
|---|---|---|---|---|
| | 00 sec. | | | |

The replenishment amounts are per 1 $m^2$.

In the above, the wet processing time was 4 minutes and the total replenishment amount was 1,330 ml.

| | Main solution (g) | Replenishment solution (g) |
|---|---|---|
| (Color developing solution) | | |
| Diethylenetriamine-pentaacetic acid | 5.0 | 6.0 |
| Sodium sulfite | 4.0 | 6.0 |
| Potassium carbonate | 30.0 | 37.0 |
| Potassium bromide | 1.3 | — |
| Potassium iodide | 1.2 mg | — |
| Hydroxylamine sulfate | 2.0 | 3.8 |
| 4-(N-Ethyl-N-β-hydroxyethyl-amino)-2-methylaniline sulfate | 4.7 | 7.5 |
| Water (mains water) added to | 1.0 l | 1.0 l |
| pH | 10.00 | 10.20 |
| (Bleaching solution) | | |
| Ferric 1,3-diamino-propanetetraacetate | 140 | 190 |
| Ethylenediaminetetra-acetic acid | 4.0 | 5.0 |
| Ammonium bromide | 160.0 | 220.0 |
| Ammonium nitrate | 30.0 | 50.0 |
| Ammonia water (27%) | 20.0 ml | 23.0 ml |
| Acetic acid (98%) | 80.0 ml | 120.0 ml |
| Water added to | 1.0 l | 1.0 l |
| pH | 4.3 | 4.0 |
| (Fixing solution) | | |
| Disodium ethylene-diaminetetraacetate | 0.5 | 0.7 |
| Ammonium sulfite | 15.0 | 25.0 |
| Sodium bisulfite | 5.0 | 10.0 |
| Ammonia thiosulfate aqueous solution (700 g/l) | 270.0 ml | 320.0 ml |
| Water added to | 1.0 l | 1.0 l |
| pH | 6.7 | 6.6 |
| (Stabilizing solution) The main solution and the replenishment solution were the same (units g) | | |
| Mains water | 1.0 l | |
| Formalin (37%) | 1.2 ml | |
| 5-Chloro-2-methyl-4-isothiazolin-3-one | 6.0 mg | |
| 2-Methyl-4-isothioazolin-3-one | 3.0 mg | |
| Surfactant [$C_{10}H_{21}$—O-(-$CH_2CH_2O$-)$_{10}$H] | 0.4 | |
| Ethylene glycol | 1.0 | |

The results are given in Table 12.

As in Example 12, this invention arrests a rise in the magenta density of the unexposed portions and is effective in arresting the rise in the cyan density in the unexposed portions during storage at high temperatures and a high humidity.

TABLE 12

| | No. | Sample | Compound added to the 7th layer | Change in the magenta density during running | Change in the cyan density after 1 week at 60° C., 70% RH |
|---|---|---|---|---|---|
| Comp. Ex. | 1 | 1101 | None | +0.08 | +0.14 |
| Comp. Ex. | 2 | 1202 | " | +0.07 | +0.12 |
| Comp. Ex. | 3 | 1203 | " | +0.07 | +0.11 |
| This inv. | 4 | 1201 | (1) | +0.03 | +0.04 |
| This inv. | 5 | 1202 | (2) | +0.01 | +0.02 |
| This inv. | 6 | 1203 | (3) | +0.01 | +0.02 |
| This inv. | 7 | 1201 | (5) | +0.02 | +0.04 |
| This inv. | 8 | 1202 | (8) | +0.02 | +0.03 |
| This inv. | 9 | 1203 | (10) | +0.01 | +0.02 |
| This inv. | 10 | 1201 | (11) | +0.05 | +0.05 |
| This inv. | 11 | 1202 | (14) | +0.02 | +0.03 |
| This inv. | 12 | 1203 | (15) | +0.02 | +0.03 |
| This inv. | 13 | 1201 | (16) | +0.02 | +0.03 |
| This inv. | 14 | 1202 | (20) | +0.01 | +0.02 |
| This inv. | 15 | 1203 | (21) | +0.01 | +0.02 |

Comp. Ex. = Comparative Example
This inv. = This invention

EXAMPLE 13

A multi-layer color printing paper with the following layer structures was prepared on a paper support which had been laminated on both sides with polyethylene. The coating solutions were prepared as given below.

Preparation of the Coating Solution for the First Layer 27.2 cc of ethyl acetate and 8.2 g of a solvent (Solv-3) were added to 19.1 g of a yellow coupler (ExY), 4.4 g of a color image stabilizer (Cpd-1) and 0.7 g of a color image stabilizer (Cpd-7) to dissolve them, and this solution was subjected to emulsification and dispersion in 185 cc of a 10% aqueous gelatin solution containing 8 cc of 10% sodium dodecylbenzenesulfonate. Meanwhile, the following blue-sensitizing dyes were added to a silver chlorobromide emulsion (cubic, a 3:7 mixture (silver molar ratio) of grains with an average grain size of 0.88 μm and grains with an average grain size of 0.70 μm. Variation coefficients in the grain size distributions were 0.08 and 0.10, each emulsion containing 0.2 mol % of silver bromide localized at the grain surface) respectively in amounts of $2.0\times10^{-4}$ moles per mole of silver halide in the large-sized emulsion and respectively in amounts of $2.5\times10^{-4}$ moles per mole of silver halide in the small-sized emulsion, and after this sulfur sensitization was carried out. The above emulsified dispersion and this emulsion were mixed and dissolved to prepare a first coating solution with the composition given below.

The coating solutions for the second layer to the seventh layer were also prepared by methods similar to that for the first layer coating solution. Sodium 1-oxy-3,5-dichloro-s-triazine was used as a gelatin hardener in each layer.

The following spectrally sensitizing dyes were used in each layer.

Blue-sensitive emulsion layer

-continued

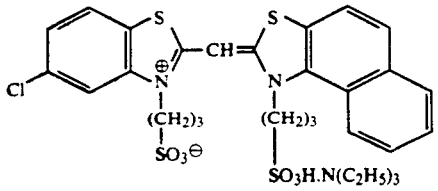

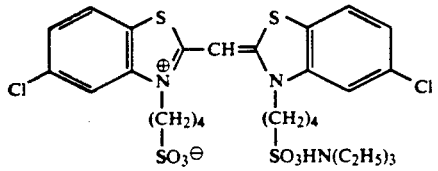

(with respect to 1 mole of silver halide, respectively $2.0 \times 10^{-4}$ mole in the large-sized emulsion and respecitively $2.5 \times 10^{-4}$ mole in the small-sized emulsion)

Green-sensitive emulsion Layer

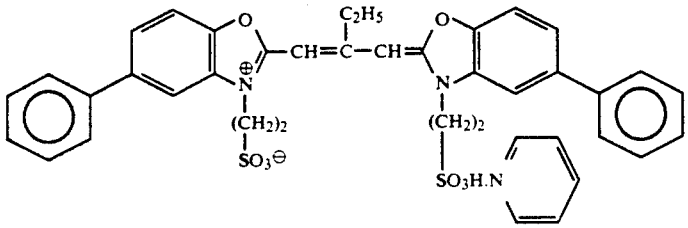

(with respect to 1 mole of silver halide, $6.0 \times 10^{-4}$ mole in the large-sized emulsion and $8.4 \times 10^{-4}$ mole in the small-sized emulsion) and

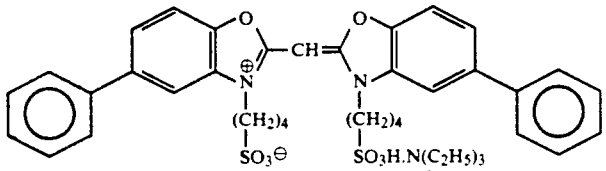

(with respect to 1 mole of silver halide, $10.0 \times 10^{-5}$ mole in the large-sized emulsion and $1.5 \times 10^{-5}$ mole in the small-sized emulsion)

Red-sensitive emulsion Layer

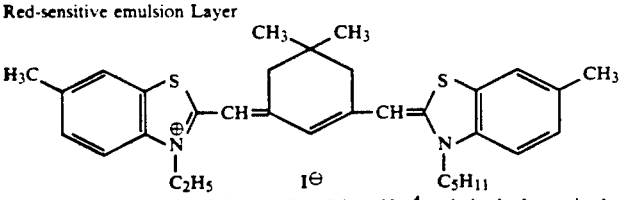

(with respect to 1 mole of silver halide, $0.9 \times 10^{-4}$ mole in the large-sized emulsion and $1.1 \times 10^{-4}$ mole in the small-sized emulsion)

The following compound was added to the red-sensitive emulsion layer in an amount of $2.6 \times 10^{-3}$ mole per mole of silver halide.

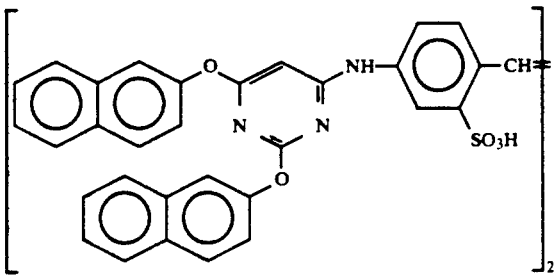

Further, 1-(5-methylureidophenyl)-5-mercaptotetrazole was added to the blue-sensitive emulsion layer, green-sensitive emulsion layer and red-sensitive emulsion layer in amounts of $8.5 \times 10^{-5}$ mole, $7.7 \times 10^{-4}$ mole and $2.5 \times 10^{-4}$ mole per mole of silver halide, respectively.

The following dyes were added to the emulsion layers to prevent irradiation.

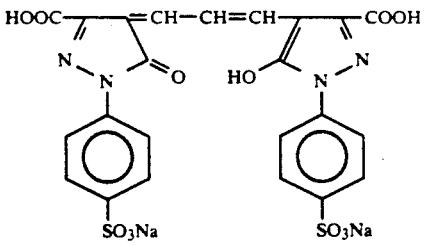

and

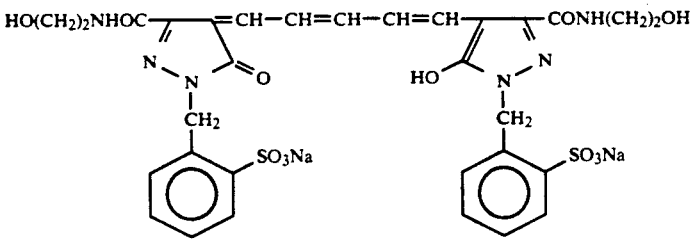

Compound (3) of this invention was added to the green-sensitive emulsion layer in an amount of $1.0\times10^{-3}$ mole per mole of silver halide.

Layer Structure

The composition of each layer is given below. The figures represent coated amounts (g/m$^2$). With the silver halide emulsions, they represent the coated amount calculated as silver.

Support

Polyethylene-laminated paper (containing a white pigment ($TiO_2$) and a blue dye (ultramarine) in the polyethylene on the first layer side)

| | |
|---|---|
| First layer (blue-sensitive layer) | |
| The silver chlorobromide emulsion mentioned above | 0.30 |
| Gelatin | 1.86 |
| Yellow coupler (ExY) | 0.82 |
| Color image stabilizer (Cpd-1) | 0.19 |
| Solvent (Solv-3) | 0.35 |
| Color image stabilizer (Cpd-7) | 0.06 |
| Second layer (anti color mixing layer) | |
| Gelatin | 0.99 |
| Anti color mixing agent (Cpd-5) | 0.08 |
| Solvent (Solv-1) | 0.16 |
| Solvent (Solv-4) | 0.08 |
| Third layer (green-sensitive layer) | |
| Silver chlorobromide emulsion (cubic, a 1:3 mixture (Ag molar ratio) of grains with an average grain size of 0.55 μm and grains with an average grain size of 0.39 μm. The variation coefficients in the grain size distributions were 0.10 and 0.08, each emulsion contained 0.8 mol % of AgBr locally at the grain surface). | 0.12 |
| Gelatin | 1.24 |
| Magenta coupler (ExM) | 0.20 |
| Color image stabilizer (Cpd-2) | 0.03 |
| Color image stabilizer (Cpd-3) | 0.15 |
| Color image stabilizer (Cpd-4) | 0.02 |
| Color image stabilizer (Cpd-9) | 0.02 |
| Solvent (Solv-2) | 0.40 |
| Fourth layer (ultraviolet absorbing layer) | |
| Gelatin | 1.58 |
| Ultraviolet absorber (UV-1) | 0.47 |
| Anti color mixing agent (Cpd-5) | 0.05 |
| Solvent (Solv-5) | 0.24 |
| Fifth layer (red-sensitive layer) | |
| Silver chlorobromide emulsion (cubic, a 1:4 mixture (Ag molar ratio) of grains with an average grain size of 0.58 μm and grains with an average grain size of 0.45 μm. The variation coefficients in the grain size distributions were 0.09 and 0.11, each emulsion contained 0.6 mol % of AgBr locally at the grain surface). | 0.23 |
| Gelatin | 1.34 |
| Cyan coupler (ExC) | 0.32 |
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |
| Sixth layer (ultraviolet absorbing layer) | |
| Gelatin | 0.53 |
| Ultraviolet absorber (UV-1) | 0.16 |
| Anti color mixing agent (Cpd-5) | 0.02 |

-continued
| | |
|---|---|
| Solvent (Solv-5) | 0.08 |
| Seventh layer (protective layer) | |
| Gelatin | 1.33 |
| Acrylic-modified copolymer of polyvinyl alcohol (degree of modification 17%) | 0.17 |
| Liquid paraffin | 0.03 |
(ExY) yellow coupler a 1:1 mixture (molar ratio) of
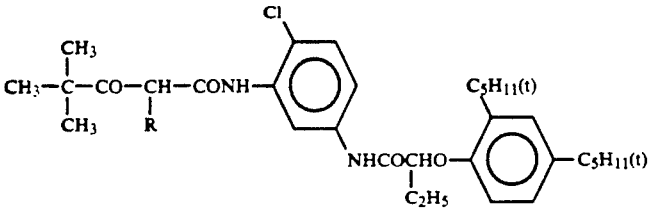
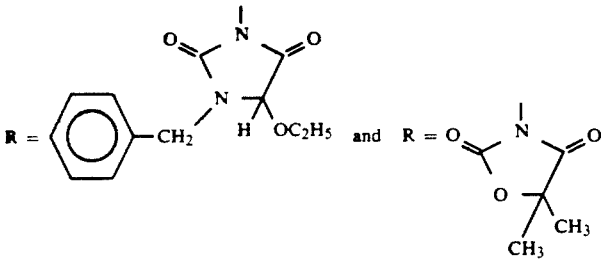
(ExM) magenta coupler a 1:1 mixture (molar ratio) of
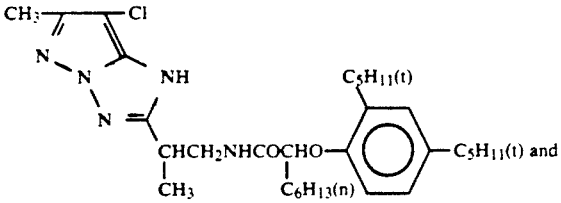
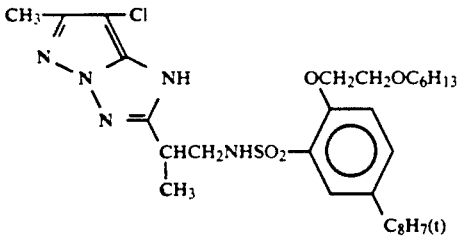
(ExC) cyan coupler a 2:4:4 mixture by weight of
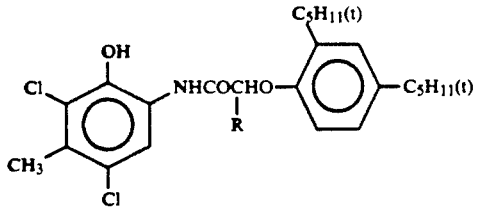
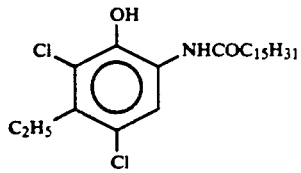
(Cpd-1) color image stabilizer -continued
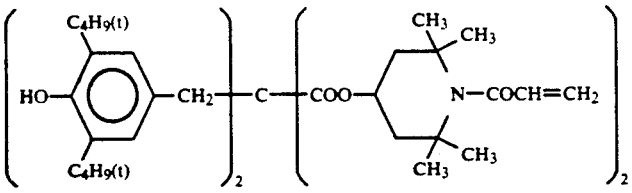
(Cpd-2) color image stabilizer
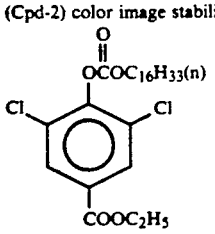
(Cpd-3) color image stabilizer
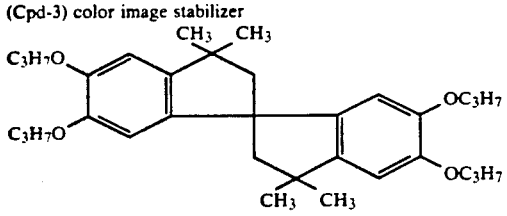
(Cpd-4) color image stabilizer
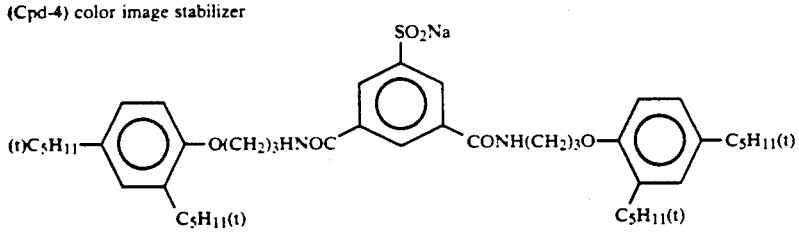
(Cpd-5) anticolor mixing agent
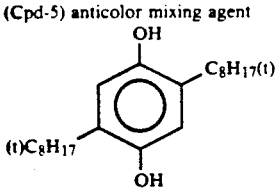
(Cpd-6) color image stabilizer a 2:4:4 mixture (weight ratio) of
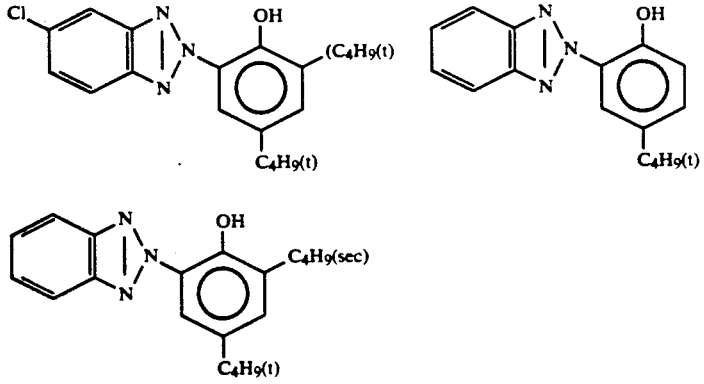
(Cpd-7) color image stabilizer
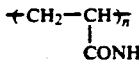
average molecular weight: 60,000
(Cpd-8) color image stabilizer -continued
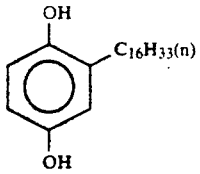
(Cpd-9) color image stabilizer
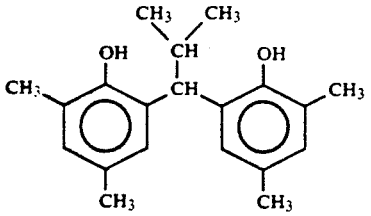
(UV-1) ultraviolet absorber a 4:2:4 mixture (weight ratio) of
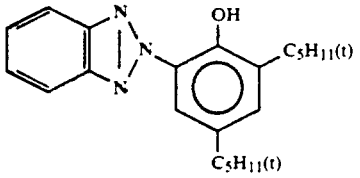
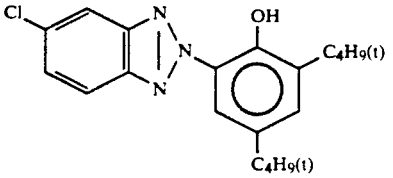
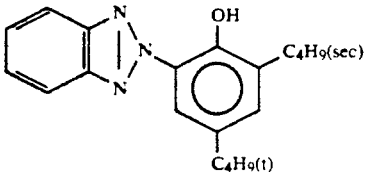
(Solv-1) solvent
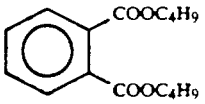
(Solv-2) solvent a 2:1 mixture (by volume) of
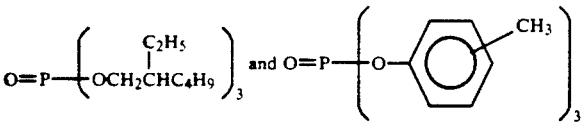
(Solv-3) Solvent
$O{=}P{+}O{-}C_9H_{19}\text{-(iso)})_3$
(Solv-4) solvent
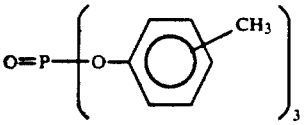
(Solv-5) Solvent
$$\begin{array}{l} COOC_8H_{17} \\ | \\ (CH_2)_8 \\ | \\ COOC_8H_{17} \end{array}$$
(Solv-6) solvent -continued

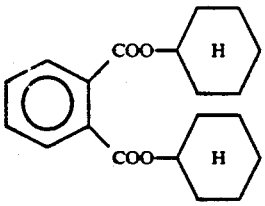

Firstly, each of the samples was subjected to continuous processing (a running test) comprising the following processing stages and a paper processing machine until the color development tank capacity had been replenished twice.

| Processing stage | Temperature | Time | Replenishing solution* | Tank capacity |
|---|---|---|---|---|
| Color development | 38° C. | 20 sec. | 161 ml | 17 l |
| Bleach fixing | 35 to 38° C. | 20 sec. | 215 ml | 17 l |
| Rinse (1) | 35 to 38° C. | 7 sec. | — | 10 l |
| Rinse (2) | 35 to 38° C. | 7 sec. | — | 10 l |
| Rinse (3) | 35 to 38° C. | 6 sec. | 350 ml | 10 l |
| Drying | 70 to 80° C. | 30 sec. | | |

*The replenishment amount is per 1 $m^2$ of photographic material (A 3-tank countercurrent system from rinse (3) to (1) was adopted).

The compositions of the processing solutions were as given below.

| | Tank solution | Replenishment solution |
|---|---|---|
| Color developing solution | | |
| Water | 800 ml | 800 ml |
| Ethylenediamine-N,N,N,N-tetramethylene phosphonate | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)-hydrazine | 5.5 g | 7.0 g |
| Water added to | 1,000 ml | 1,000 ml |
| pH (25° C.) | 10.05 | 10.45 |
| Bleach fixing solution (the tank solution and replenishment solution were the same) | | |
| Water | 400 ml | |
| Ammonium thiosulfate (70%) | 100 ml | |
| Sodium sulfite | 17 g | |
| Iron(III) ammonium ethylenediaminetetraacetate | 55 g | |
| Disodium ethylenediaminetetraacetate | 5 g | |
| Ammonium bromide | 40 g | |
| Water added to | 1,000 ml | |
| pH (25° C.) | 6.0 | |
| Rinse solution (the tank solution and the replenishment solution were the same | | |

Ion exchange water (calcium and magnesium both at 3 ppm or less).

The reflected density of the photographic materials is measured by means of a conventional reflection spectrum measurement apparatus using visible light.

Upon processing the photographic material containing a compound of this invention obtained as described above, the reflected density based on the residual color from the sensitizing dye in the unexposed portion was markedly improved being lower than a photographic material which did not contain a compound of this invention by 0.051.

EXAMPLE 14

Preparation of an Emulsion A (Tabular Grains of Silver Iodobromide)

The double jet method was used for 1 minute, with stirring, to add an aqueous solution of silver nitrate (5 g as silver nitrate) and an aqueous solution of potassium bromide containing 0.15 g of potassium iodide to a vessel in which 30 g of gelatin and 6 g of potassium bromide had been added to 1 l of water and which was maintained at 60° C. In addition, the double jet method was used to add an aqueous solution solution of silver nitrate (145 g as silver nitrate) and an aqueous solution of potassium bromide containing 4.2 g of potassium iodide. At this time, the addition flow rate was accelerated so that the flow rate at the end of addition was 5 times that at the start of addition. After the end of the addition, the soluble salts were removed by precipitation at 35° C. and then the pH was adjusted to 6.7. The resulting emulsion comprised tabular grains with a projected surface area diameter of 0.98 μm and an average thickness of 0.138 μm and had a silver iodide content of 3 mol %. The emulsion was chemically sensitized by conjoint use of gold and sulfur sensitization to provide an Emulsion A.

Preparation of Photographic Material 1

Use was made of an aqueous gelatin solution containing a film hardener, polyacrylamide with an average molecular weight of 8,000 poly(sodium sulfonate), poly(methyl methacrylate) particles (average particle size 3.0 μm), poly(ethylene oxide) as well as gelatin as the surface protective layer.

Anhydro-5,5'-dichloro-9-ethyl-3,3'-di(3sulfopropyl-)oxacarbocyanine hydroxide, sodium salt as a sensitizing dye in a ratio of 500 ml/1 mole of Ag, potassium iodide in a ratio of 200 mg/1 mole of Ag, and 200 ml, per mole of Ag, of a $10^{-3}$ mole methanol solution of a compound of this invention (refer to Table 14) were added to the Emulsion A. Furthermore, a photographic material 1 was produced by preparing a coating solution by adding 4-hydroxy-6-methyl-1,3,3*a*,7-tetraazaindene and 2,6-bis(hydroxyamino)-4-diethylamino-1,3,5-triazine and nitron as stabilizers, methylol propane as a dry antifoggant and adding auxiliary coating agents and film hardeners, coating this onto both sides of a polyethylene terephthalate support simultaneously with the respective surface protective layers and drying. The coated silver amount in this photographic material was 2.0 g/$m^2$ on each side.

Prefrably, the photographic materials to be processed in the present invention are fully hardened in advance by the hardener in the coating compositions. The percentage swelling is 180% or less as described above. The photographic materials having the percentage swelling of more than 200% result in some troubles such as poorness in drying, poor haze of the rough image portions, and coming-off of layers during conveying.

Processing

Compositions of the concentrated solutions for the developing solution and the fixing solution are as follow.

| Concentrated solution for developing solution | |
|---|---|
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethylene glycol | 40 g |
| 4-Hydroxymethyl-4-methyl-1-phenyl-3-pyrazolidone | 5.5 g |
| 5-Methylbenzotriazole | 2 g |
| Water | added to 1 l |
| pH adjusted to 10.60. | |
| **Concentrated solution for Fixing solution** | |
| Ammonium thiosulfate | 560 g |
| Sodium sulfite | 60 g |
| Disodium ethylenediaminetetraacetate dihydrate | 0.10 g |
| Sodium hydroxide | 24 g |
| Water | added to 1 l |
| pH adjusted to 5.10 with an acetic acid. | |

| Automatic Developing Apparatus | | Conditions |
|---|---|---|
| Tank for developing | 6.5 l | 35° C. × 12 sec. |
| Tank for fixing | 6.5 l | 35° C. × 10 sec. |
| Tank for washing with water | 6.5 l | 20° C. × 7 sec. |
| Drying | | 50° C. |
| Processing time from dry to dry | | 37 sec |

When starting to process the photographic materials, each of these tanks was filled with the following processing solutions.

Tank for Developing 333 ml of the above-mentioned concentrated solution for developing, 667 ml of water, and 10 ml of a starter containing 2 g of potassium bromide and 1.8 g of acetic acid were added in the tank for developing and the pH was adjusted to 10.15.

Tank for Fixing 250 ml of the above-mentioned concentrated solution for fixing and 750 ml of water were added in the tank for fixing.

Every processing one quarter (10 inch×12 inch) of the photographic materials, 15 ml of the concentrated solution for developing and 30 ml of diluted water were replenished automatically to the tank for developing, 10 ml of the concentrated solution for fixing solution and 30 ml of diluted water were replenished automatically to the tank for fixing and the running processing was continued. During the processing, when the developing solution, the fixing solution, or water was run out, the replenishment solutions were added in the same ways.

Table 14 shows the residual color after processing (the value obtained by measuring the transmitted optical density of the non-image portion using green light).

TABLE 14

| Sample No. | Compound of this invention which was added | Residual color after processing |
|---|---|---|
| 1 | None | 0.023 |
| 2 | (1) | 0.163 |
| 3 | (3) | 0.160 |
| 4 | (5) | 0.162 |
| 5 | (8) | 0.165 |
| 6 | (14) | 0.165 |
| 7 | (16) | 0.158 |
| 8 | (19) | 0.155 |
| 9 | (20) | 0.157 |
| 10 | (21) | 0.155 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support, a sensitizing dye, and at least one silver halide emulsion layer on said support, wherein at least one compound represented by general formula (II) is contained in said silver halide emulsion layer or another hydrophilic colloid layer to reduce residual staining caused by the sensitizing dye:

$$A'\text{-}(X_1)_{m_1}D \qquad \text{(II)}$$

wherein A' represents a blocking group that is capable of releasing $\text{-}(X_1)_{m_1}D$ during processing and that blocks a residual color improving function of D prior to release of $\text{-}(X_1)_{m_1}D$ from A'; D represents a residual color improving agent which is a hetero ring system with 3 to 4 rings that satisfies Condition 1 after being released from A' and is linked to $X_1$ or A' via a hetero atom in D; $X_1$ represents a divalent linking group which is linked to A' via a hetero atom in $X_1$; $m_1$ represents 0 or 1; and Condition 1 is as follows:

Condition 1:

When a 2 ml aqueous solution of $4.0\times10^{-4}$ mole/l of anhydro-5,5'-dichloro-9-ethyl,3,3'-bis(3-sulfo-propyl)-thiacarbocyanine hydroxide pyridinium salt is mixed with a 1 ml aqueous solution of $1.0\times10^{-1}$ mole/l of potassium chloride, and 4 ml of an aqueous solution of $8.0\times10^{-2}$ mole/l of said residual color improving agent are further added to this mixture, which is then diluted with water to a set volume of 10 ml to form a diluted aqueous solution, the molecular extinction coefficient of this diluted aqueous solution at 624 nm is $1.0\times10^{5}$ or less.

2. The silver halide photographic material of claim 1, wherein D comprises a ring system selected from the ring systems represented by the following structural formulas, wherein the positions to be bonded to $X_1$ or A' are denoted by arrows:

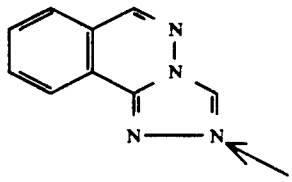

-continued
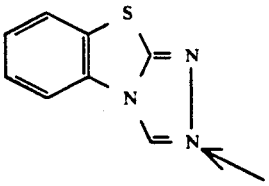
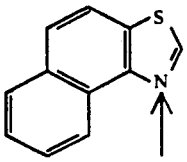
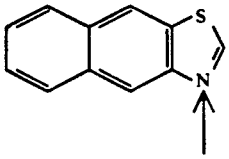
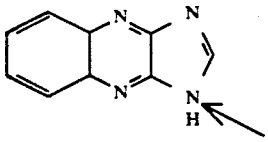
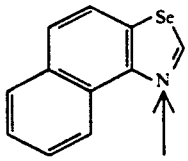
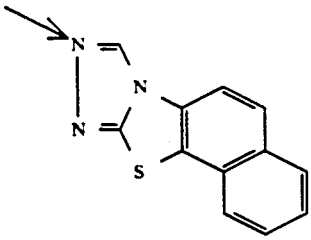
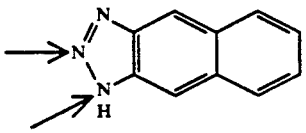
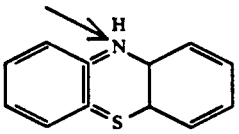
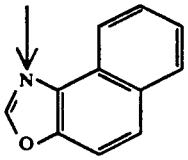
-continued
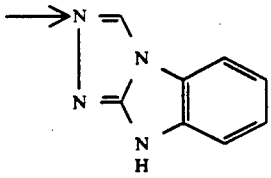
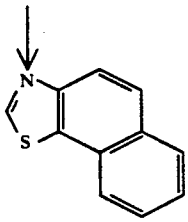
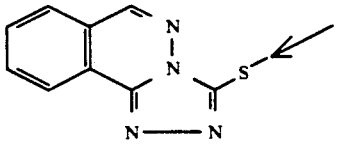
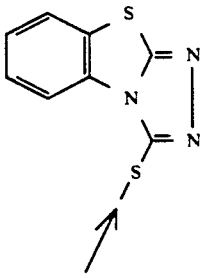
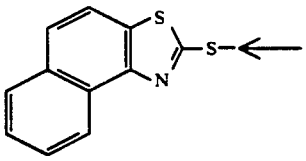
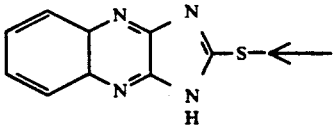
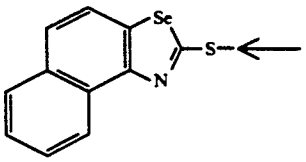

-continued

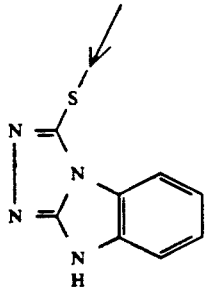

3. The sliver halide photographic material of claim 1, wherein D is represented by general formula (III):

(III)

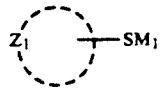

wherein $Z_1$ represents a group of atoms necessary to form a hetero ring system with 3 to 4 rings and $M_1$ represents a hydrogen atom or a counter-cation.

4. The silver halide photographic material of claim 1, wherein D is represented by general formula (IV):

(IV)

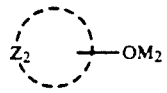

wherein $Z_2$ represents a group of atoms necessary to form a hetero ring system with 3 to 4 rings and $M_2$ represents a hydrogen atom or a counter-cation.

5. The sliver halide photographic material of claim 1, wherein D is represented by general formula (V):

(V)

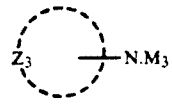

wherein $Z_3$ represents a group of atoms necessary not only to form a hetero ring system with 3 to 4 rings but also to form a compound which can form iminosilver, and $M_3$ represents a hydrogen atom or a counter-cation.

6. The silver halide photographic material of claim 1, wherein D represents a hetero ring system with 3 to 4 rings which contains a structure represented by general formula (i) or (ii):

(i)

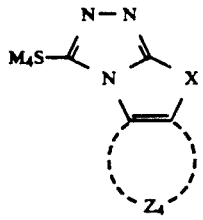

-continued (ii)

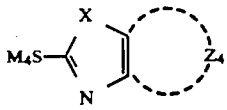

wherein $Z_4$ in formula (i) represents a group of non-metallic atoms necessary to form a benzene ring, a naphthalene ring, or a 5-membered or 6-membered hetero ring, $Z_4$ in formula (ii) represents a group of non-metallic atoms necessary to form a naphthalene ring or

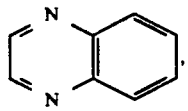

X represents -O-, -S-, or

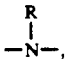

wherein R represents a hydrogen atom, an alkyl group, an aryl group, an acyl group, an allyl group, an alkanesulfonyl group, or an allenesulfonyl group, and $M_4$ represents a hydrogen atom or a counter-cation.

7. The silver halide photographic material of claim 1, wherein $A'(X_1)_{m1}D$ is represented by general formula (VI):

(VI)

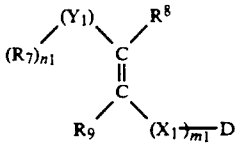

wherein $R_7$, $R_8$ and $R_9$ may be identical or different and each represents a hydrogen atom or a group capable of being substituted, and $R_7$ and $R_8$ or $R_7$ and $R_9$ may link to form a carbon ring or hetero ring system; $n_1$ is 0 or 1; $Y_1$ represents a cyano group or a nitro group when $n_1=1$ and $Y_1$ represents

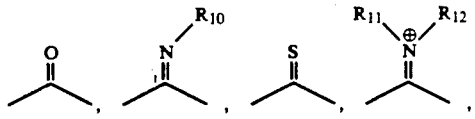

when n=1, and $R_{10}$, $R_{11}$, $R_{12}$, $R_{13}$ and $R_{14}$ may be identical or different and each represents a hydrogen atom or a

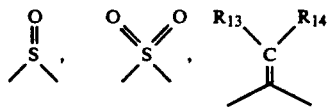

group capable of being substituted; and $X_1$, $m_1$, and D have the same signification as they do in claim 1.

* * * * *